US008638282B2

(12) United States Patent
Shimoshikiryoh et al.

(10) Patent No.: US 8,638,282 B2
(45) Date of Patent: Jan. 28, 2014

(54) LIQUID CRYSTAL DISPLAY DEVICE

(75) Inventors: Fumikazu Shimoshikiryoh, Matsusaka (JP); Masae Kitayama, Tsu (JP); Kentaro Irie, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 1202 days.

(21) Appl. No.: 12/310,360

(22) PCT Filed: Aug. 13, 2007

(86) PCT No.: PCT/JP2007/065832
§ 371 (c)(1),
(2), (4) Date: Feb. 23, 2009

(87) PCT Pub. No.: WO2008/023601
PCT Pub. Date: Feb. 28, 2008

(65) Prior Publication Data

US 2009/0195487 A1 Aug. 6, 2009

(30) Foreign Application Priority Data

Aug. 24, 2006 (JP) ..... 2006-228476

(51) Int. Cl.
*G09G 3/36* (2006.01)
*G09G 3/30* (2006.01)

(52) U.S. Cl.
USPC ..... 345/89; 345/79

(58) Field of Classification Search
USPC ..... 345/84
See application file for complete search history.

(56) References Cited

U.S. PATENT DOCUMENTS 5,561,440 A * 10/1996 Kitajima et al. ..... 345/87
5,847,688 A * 12/1998 Ohi et al. ..... 345/98
6,295,043 B1 * 9/2001 Hashimoto et al. ..... 345/96
6,724,452 B1 4/2004 Takeda et al.

(Continued)

FOREIGN PATENT DOCUMENTS

EP 1 564 714 8/2005
EP 1818903 8/2007

(Continued)

OTHER PUBLICATIONS

European Search Report dated Aug. 14, 2009.

(Continued)

*Primary Examiner* — Alexander S Beck
*Assistant Examiner* — Mihir Rayan
(74) *Attorney, Agent, or Firm* — Harness, Dickey & Pierce, P.L.C.

(57) ABSTRACT

In one embodiment of the present invention, a liquid crystal display device according to the present invention includes a plurality of pixels, each including first and second subpixels. When a predetermined grayscale tone is displayed continuously through four or more consecutive even number of vertical scanning periods, the first and second subpixels have different luminances in at least two of the even number of vertical scanning periods, first polarity periods that are included in the vertical scanning periods and that maintain a first polarity are as long as second polarity periods that are also included in the vertical scanning periods and that maintain a second polarity for each of the first and second subpixels, and in each of the first and second polarity periods, the difference between the average of effective voltages applied to the liquid crystal layer of the first subpixel and that of effective voltages applied to the liquid crystal layer of the second subpixel is substantially equal to zero.

16 Claims, 34 Drawing Sheets

(56) References Cited

U.S. PATENT DOCUMENTS

| | | | | |
|---|---|---|---|---|
| 6,958,791 | B2 | 10/2005 | Shimoshikiryo | |
| 7,113,159 | B2 * | 9/2006 | Sawabe | 345/89 |
| 7,884,890 | B2 * | 2/2011 | Shimoshikiryoh et al. | 349/39 |
| 2002/0097002 | A1 * | 7/2002 | Lai et al. | 315/169.3 |
| 2002/0171640 | A1 * | 11/2002 | Bu et al. | 345/208 |
| 2003/0058211 | A1 | 3/2003 | Kim et al. | |
| 2003/0146893 | A1 * | 8/2003 | Sawabe | 345/89 |
| 2003/0227429 | A1 * | 12/2003 | Shimoshikiryo | 345/90 |
| 2003/0234904 | A1 | 12/2003 | Matsuda et al. | |
| 2004/0061711 | A1 | 4/2004 | Kurumisawa et al. | |
| 2004/0109122 | A1 * | 6/2004 | Kumagawa et al. | 349/143 |
| 2004/0119924 | A1 | 6/2004 | Takeda et al. | |
| 2004/0239698 | A1 | 12/2004 | Kamada et al. | |
| 2005/0122441 | A1 * | 6/2005 | Shimoshikiryoh | 349/38 |
| 2005/0184944 | A1 | 8/2005 | Miyata et al. | |
| 2006/0138600 | A1 * | 6/2006 | Miyazawa | 257/630 |
| 2006/0176322 | A1 | 8/2006 | Lee | |
| 2006/0238472 | A1 * | 10/2006 | Lee et al. | 345/89 |
| 2007/0070018 | A1 * | 3/2007 | Moon | 345/98 |
| 2008/0088559 | A1 * | 4/2008 | Lai et al. | 345/89 |
| 2008/0106660 | A1 | 5/2008 | Kitayama et al. | |
| 2008/0158203 | A1 | 7/2008 | Irie et al. | |
| 2008/0170025 | A1 * | 7/2008 | Song et al. | 345/96 |

FOREIGN PATENT DOCUMENTS

| | | |
|---|---|---|
| JP | 7-121144 | 5/1995 |
| JP | 11-242225 | 9/1999 |
| JP | 2003-255306 | 9/2003 |
| JP | 2003-255306 | 10/2003 |
| JP | 2003-295160 | 10/2003 |
| JP | 2004-021069 | 1/2004 |
| JP | 2004-62146 | 2/2004 |
| JP | 2004-85608 | 3/2004 |
| JP | 2004-325571 | 11/2004 |
| JP | 2005-189804 | 7/2005 |
| WO | WO 2006049245 | 5/2006 |
| WO | WO 2006/070829 | 7/2006 |

OTHER PUBLICATIONS

European Search Report dated Jan. 18, 2011.

* cited by examiner (a)

*FIG.14*

| | Sa | Sb | Sc | Sd | Se | Sf |
|---|---|---|---|---|---|---|
| CS1 | 1-a-A B + | 1-b-A D - | 1-c-A B + | 1-d-A D - | 1-e-A B + | 1-f-A D - |
| ONE DOT | | | | | | |
| G1 | | | | | | |
| CS2 | 1-a-B D + | 1-b-B B - | 1-c-B D + | 1-d-B B - | 1-e-B D + | 1-f-B B - |
| | 2-a-A B - | 2-b-A D + | 2-c-A B - | 2-d-A D + | 2-e-A B - | 2-f-A D + |
| G2 | | | | | | |
| CS3 | 2-a-B D - | 2-b-B B + | 2-c-B D - | 2-d-B B + | 2-e-B D - | 2-f-B B + |
| | 3-a-A B + | 3-b-A D - | 3-c-A B + | 3-d-A D - | 3-e-A B + | 3-f-A D - |
| G3 | | | | | | |
| CS4 | 3-a-B D + | 3-b-B B - | 3-c-B D + | 3-d-B B - | 3-e-B D + | 3-f-B B - |
| | 4-a-A B - | 4-b-A D + | 4-c-A B - | 4-d-A D + | 4-e-A B - | 4-f-A D + |
| G4 | | | | | | |
| CS5 | 4-a-B D - | 4-b-B B + | 4-c-B D - | 4-d-B B + | 4-e-B D - | 4-f-B B + |
| | 5-a-A B + | 5-b-A D - | 5-c-A B + | 5-d-A D - | 5-e-A B + | 5-f-A D - |
| G5 | | | | | | |
| CS6 | 5-a-B D + | 5-b-B B - | 5-c-B D + | 5-d-B B - | 5-e-B D + | 5-f-B B - |
| | 6-a-A B - | 6-b-A D + | 6-c-A B - | 6-d-A D + | 6-e-A B - | 6-f-A D + |
| G6 | | | | | | |
| CS7 | 6-a-B D - | 6-b-B B + | 6-c-B D - | 6-d-B B + | 6-e-B D - | 6-f-B B + |
| | 7-a-A B + | 7-b-A D - | 7-c-A B + | 7-d-A D - | 7-e-A B + | 7-f-A D - |
| G7 | | | | | | |
| CS8 | 7-a-B D + | 7-b-B B - | 7-c-B D + | 7-d-B B - | 7-e-B D + | 7-f-B B - |
| | 8-a-A B - | 8-b-A D + | 8-c-A B - | 8-d-A D + | 8-e-A B - | 8-f-A D + |
| G8 | | | | | | |
| CS9 | 8-a-B D - | 8-b-B B + | 8-c-B D - | 8-d-B B + | 8-e-B D - | 8-f-B B + |
| | 9-a-A B + | 9-b-A D - | 9-c-A B + | 9-d-A D - | 9-e-A B + | 9-f-A D - |
| G9 | | | | | | |
| CS10 | 9-a-B D + | 9-b-B B - | 9-c-B D + | 9-d-B B - | 9-e-B D + | 9-f-B B - |
| | 10-a-A B - | 10-b-A D + | 10-c-A B - | 10-d-A D + | 10-e-A B - | 10-f-A D + |
| G10 | | | | | | |
| CS2 | 10-a-B D - | 10-b-B B + | 10-c-B D - | 10-d-B B + | 10-e-B D - | 10-f-B B + |
| | 11-a-A B + | 11-b-A D - | 11-c-A B + | 11-d-A D - | 11-e-A B + | 11-f-A D - |
| G11 | | | | | | |
| CS1 | 11-a-B D + | 11-b-B B - | 11-c-B D + | 11-d-B B - | 11-e-B D + | 11-f-B B - |
| | 12-a-A B - | 12-b-A D + | 12-c-A B - | 12-d-A D + | 12-e-A B - | 12-f-A D + |
| G12 | | | | | | |
| | 12-a- D - | 12-b-B B + | 12-c-B D - | 12-d-B B + | 12-e-B D - | 12-f-B B + |

*FIG.39A*

| | Sa | Sb | Sc | Sd | Se | Sf |
|---|---|---|---|---|---|---|
| CS1 / ONE DOT | 1-a-A B + | 1-b-A D - | 1-c-A B + | 1-d-A D - | 1-e-A B + | 1-f-A D - |
| G1 | 1-a-B D + | 1-b-B B | 1-c-B D + | 1-d-B B | 1-e-B D + | 1-f-B B |
| CS2 | 2-a-A B - | 2-b-A D + | 2-c-A B - | 2-d-A D + | 2-e-A B - | 2-f-A D + |
| G2 | 2-a-B D - | 2-b-B B + | 2-c-B D - | 2-d-B B + | 2-e-B D - | 2-f-B B + |
| CS3 | 3-a-A B + | 3-b-A D - | 3-c-A B + | 3-d-A D - | 3-e-A B + | 3-f-A D - |
| G3 | 3-a-B D + | 3-b-B B - | 3-c-B D + | 3-d-B B - | 3-e-B D + | 3-f-B B - |
| CS4 | 4-a-A B - | 4-b-A D + | 4-c-A B - | 4-d-A D + | 4-e-A B - | 4-f-A D + |
| G4 | 4-a-B D - | 4-b-B B + | 4-c-B D - | 4-d-B B + | 4-e-B D - | 4-f-B B + |
| CS5 | 5-a-A B + | 5-b-A D - | 5-c-A B + | 5-d-A D - | 5-e-A B + | 5-f-A D - |
| G5 | 5-a-B D + | 5-b-B B - | 5-c-B D + | 5-d-B B - | 5-e-B D + | 5-f-B B - |
| CS6 | 6-a-A B - | 6-b-A D + | 6-c-A B - | 6-d-A D + | 6-e-A B - | 6-f-A D + |
| G6 | 6-a-B D - | 6-b-B B + | 6-c-B D - | 6-d-B B + | 6-e-B D - | 6-f-B B + |
| CS7 | 7-a-A B + | 7-b-A D - | 7-c-A B + | 7-d-A D - | 7-e-A B + | 7-f-A D - |
| G7 | 7-a-B D + | 7-b-B B - | 7-c-B D + | 7-d-B B - | 7-e-B D + | 7-f-B B - |
| CS8 | 8-a-A B - | 8-b-A D + | 8-c-A B - | 8-d-A D + | 8-e-A B - | 8-f-A D + |
| G8 | 8-a-B D - | 8-b-B B + | 8-c-B D - | 8-d-B B + | 8-e-B D - | 8-f-B B + |
| CS9 | 9-a-A B + | 9-b-A D - | 9-c-A B + | 9-d-A D - | 9-e-A B + | 9-f-A D - |
| G9 | 9-a-B D + | 9-b-B B - | 9-c-B D + | 9-d-B B - | 9-e-B D + | 9-f-B B - |
| CS10 | 10-a-A B - | 10-b-A D + | 10-c-A B - | 10-d-A D + | 10-e-A B - | 10-f-A D + |
| G10 | 10-a-B D - | 10-b-B B + | 10-c-B D - | 10-d-B B + | 10-e-B D - | 10-f-B B + |
| CS11 | 11-a-A B + | 11-b-A D - | 11-c-A B + | 11-d-A D - | 11-e-A B + | 11-f-A D - |
| G11 | 11-a-B D + | 11-b-B B - | 11-c-B D + | 11-d-B B - | 11-e-B D + | 11-f-B B - |
| CS12 | 12-a-A B - | 12-b-A D + | 12-c-A B - | 12-d-A D + | 12-e-A B - | 12-f-A D + |
| G12 | 12-a-B D - | 12-b-B B + | 12-c-B D - | 12-d-B B + | 12-e-B D - | 12-f-B B + |

*FIG.39B*

| | Sa | Sb | Sc | Sd | Se | Sf |
|---|---|---|---|---|---|---|
| CS1 | 1-a-A M - | 1-b-A M + | 1-c-A M - | 1-d-A M + | 1-e-A M - | 1-f-A M + |
| ONE DOT | | | | | | |
| G1 | 1-a-B M - | 1-b-B M + | 1-c-B M - | 1-d-B M + | 1-e-B M - | 1-f-B M + |
| CS2 | 2-a-A M + | 2-b-A M - | 2-c-A M + | 2-d-A M - | 2-e-A M + | 2-f-A M - |
| G2 | 2-a-B M + | 2-b-B M - | 2-c-B M + | 2-d-B M - | 2-e-B M + | 2-f-B M - |
| CS3 | 3-a-A M - | 3-b-A M + | 3-c-A M - | 3-d-A M + | 3-e-A M - | 3-f-A M + |
| G3 | 3-a-B M - | 3-b-B M + | 3-c-B M - | 3-d-B M + | 3-e-B M - | 3-f-B M + |
| CS4 | 4-a-A M + | 4-b-A M - | 4-c-A M + | 4-d-A M - | 4-e-A M + | 4-f-A M - |
| G4 | 4-a-B M + | 4-b-B M - | 4-c-B M + | 4-d-B M - | 4-e-B M + | 4-f-B M - |
| CS5 | 5-a-A M - | 5-b-A M + | 5-c-A M - | 5-d-A M + | 5-e-A M - | 5-f-A M + |
| G5 | 5-a-B M - | 5-b-B M + | 5-c-B M - | 5-d-B M + | 5-e-B M - | 5-f-B M + |
| CS6 | 6-a-A M + | 6-b-A M - | 6-c-A M + | 6-d-A M - | 6-e-A M + | 6-f-A M - |
| G6 | 6-a-B M + | 6-b-B M - | 6-c-B M + | 6-d-B M - | 6-e-B M + | 6-f-B M - |
| CS7 | 7-a-A M - | 7-b-A M + | 7-c-A M - | 7-d-A M + | 7-e-A M - | 7-f-A M + |
| G7 | 7-a-B M - | 7-b-B M + | 7-c-B M - | 7-d-B M + | 7-e-B M - | 7-f-B M + |
| CS8 | 8-a-A M + | 8-b-A M - | 8-c-A M + | 8-d-A M - | 8-e-A M + | 8-f-A M - |
| G8 | 8-a-B M + | 8-b-B M - | 8-c-B M + | 8-d-B M - | 8-e-B M + | 8-f-B M - |
| CS9 | 9-a-A M - | 9-b-A M + | 9-c-A M - | 9-d-A M + | 9-e-A M - | 9-f-A M + |
| G9 | 9-a-B M - | 9-b-B M + | 9-c-B M - | 9-d-B M + | 9-e-B M - | 9-f-B M + |
| CS10 | 10-a-A M + | 10-b-A M - | 10-c-A M + | 10-d-A M - | 10-e-A M + | 10-f-A M - |
| G10 | 10-a-B M + | 10-b-B M - | 10-c-B M + | 10-d-B M - | 10-e-B M + | 10-f-B M - |
| CS11 | 11-a-A M - | 11-b-A M + | 11-c-A M - | 11-d-A M + | 11-e-A M - | 11-f-A M + |
| G11 | 11-a-B M - | 11-b-B M + | 11-c-B M - | 11-d-B M + | 11-e-B M - | 11-f-B M + |
| CS12 | 12-a-A M + | 12-b-A M - | 12-c-A M + | 12-d-A M - | 12-e-A M + | 12-f-A M - |
| G12 | 12-a-B M + | 12-b-B M - | 12-c-B M + | 12-d-B M - | 12-e-B M + | 12-f-B M - |

LIQUID CRYSTAL DISPLAY DEVICE

TECHNICAL FIELD

The present invention relates to a liquid crystal display device and more particularly relates to a liquid crystal display device that can reduce the viewing angle dependence of the γ characteristic thereof.

BACKGROUND ART

A liquid crystal display (LCD) is a flat-panel display that has a number of advantageous features including high resolution, drastically reduced thickness and weight, and low power dissipation. The LCD market has been rapidly expanding recently as a result of tremendous improvements in its display performance, significant increases in its productivity, and a noticeable rise in its cost effectiveness over competing technologies.

A twisted-nematic (TN) mode liquid crystal display device, which used to be used extensively in the past, is subjected to an alignment treatment such that the major axes of its liquid crystal molecules, exhibiting positive dielectric anisotropy, are substantially parallel to the respective principal surfaces of upper and lower substrates and are twisted by about 90 degrees in the thickness direction of the liquid crystal layer between the upper and lower substrates. When a voltage is applied to the liquid crystal layer, the liquid crystal molecules change their orientation directions into a direction that is parallel to the electric field applied. As a result, the twisted orientation disappears. The TN mode liquid crystal display device utilizes variation in the optical rotatory characteristic of its liquid crystal layer due to the change of orientation directions of the liquid crystal molecules in response to the voltage applied, thereby controlling the quantity of light transmitted.

The TN mode liquid crystal display device allows a broad enough manufacturing margin and achieves high productivity. However, the display performance (e.g., the viewing angle characteristic, in particular) thereof is not fully satisfactory. More specifically, when an image on the screen of the TN mode liquid crystal display device is viewed obliquely, the contrast ratio of the image decreases significantly. In that case, even an image, of which the grayscales ranging from black to white are clearly observable when the image is viewed straightforward, loses much of the difference in luminance between those grayscales when viewed obliquely. Furthermore, the grayscale characteristic of the image being displayed thereon may sometimes invert itself. That is to say, a portion of an image, which looks darker when viewed straight, may look brighter when viewed obliquely. This is a so-called "grayscale inversion phenomenon".

To improve the viewing angle characteristic of such a TN mode liquid crystal display device, an inplane switching (IPS) mode liquid crystal display device, a multi-domain vertical aligned (MVA) mode liquid crystal display device, an axisymmetric aligned (ASM) mode liquid crystal display device, and other types of liquid crystal display devices were developed recently. Liquid crystal displays employing any of the novel modes described above (wide viewing angle modes) solve the concrete problems with viewing angle characteristics, specifically, the problems that the display contrast ratio decreases considerably or the grayscales invert when the display surface of the display is viewed obliquely.

Although the display qualities of LCDs have been further improved nowadays, a viewing angle characteristic problem in a different phase has arisen just recently. Specifically, the γ characteristic of LCDs would vary with the viewing angle. That is to say, the γ characteristic when an image on the screen is viewed straight is different from the characteristic when it is viewed obliquely. As used herein, the "γ characteristic" refers to the grayscale dependence of display luminance. That is why if the γ characteristic when the image is viewed straight is different from the characteristic when the same image is viewed obliquely, then it means that the grayscale display state changes according to the viewing direction. This is a serious problem particularly when a still picture such as a photo is presented or when a TV program is displayed.

According to a known method, such viewing angle dependence of the γ characteristic can be reduced by providing two or more subpixels for each single pixel and by making the luminance of one of the two subpixels different from that of the other when a moderate luminance is displayed (see Patent Documents Nos. 1 and 2, for example).

Specifically, the liquid crystal display device disclosed in Patent Document No. 1 applies a different effective voltage to the liquid crystal layer of a second subpixel from the one applied to the liquid crystal layer of a first subpixel when a moderate luminance is displayed, thereby making the luminances of the first and second subpixels different from each other and reducing the viewing angle dependence of the γ characteristic. The transmittance of the liquid crystal layer changes with the absolute value of the effective voltage irrespective of the direction of the electric field applied to the liquid crystal layer (i.e., the direction of the electric line of force). Thus, the liquid crystal display device disclosed in Patent Document No. 1 inverts the direction of the electric field applied to the liquid crystal layer alternately every vertical scanning period, thereby flattening the uneven distribution of DC levels and overcoming residual image and other reliability-related problems.

Meanwhile, the liquid crystal display device disclosed in Patent Document No. 2 inverts the brightness levels of first and second subpixels every vertical scanning period (e.g., makes the luminance of the first subpixel higher than that of the second subpixel in a first vertical scanning period but makes the luminance of the second subpixel higher than that of the first subpixel in a second vertical scanning period). In addition, the device also inverts the direction of the electric field applied to the liquid crystal layer every vertical scanning period, too. If one of multiple subpixels were always bright, then the image on the screen would look non-smooth. However, the liquid crystal display device disclosed in Patent Document No. 2 minimizes such non-smoothness of the image on the screen by inverting the brightness levels of the first and second subpixels one vertical scanning period after another.

It should be noted that such a display or driving method that reduces the viewing angle dependence of the y characteristic by making the luminances of multiple subpixels different from each other will be referred to herein as a "multi-pixel display", a "multi-pixel drive", an "area grayscale display" or an "area grayscale drive".

Patent Document No. 1: Japanese Patent Application Laid-Open Publication No. 2004-62146 (corresponding to U.S. Pat. No. 6,958,791)

Patent Document No. 2: Japanese Patent Application Laid-Open Publication No. 2003-295160

DISCLOSURE OF INVENTION

Problems to be Solved by the Invention

In the liquid crystal display device disclosed in Patent Document No. 1, as the luminance of the first subpixel is always higher than that of the second subpixel when a moderate luminance is displayed, the difference in brightness level between those subpixels may be quite sensible and the image presented may sometimes look non-smooth.

On the other hand, in the liquid crystal display device disclosed in Patent Document No. 2, as the direction of the electric field applied to the liquid crystal layer and the brightness levels of the subpixels are inverted every vertical scanning period, the direction of the electric field applied to the liquid crystal layer is always the same when one of the two subpixels is brighter than the other subpixel.

For example, in the liquid crystal display device disclosed in Patent Document No. 2, if the absolute value of the effective voltage applied to the first subpixel is greater than that of the effective voltage applied to the second subpixel to make the first subpixel look brighter than the second one in a vertical scanning period, the electric field applied to the liquid crystal layer is directed from a subpixel electrode toward a counter electrode. The electric field with such a direction is supposed to have a first polarity. In the next vertical scanning period, as the absolute value of the effective voltage applied to the second subpixel becomes greater than that of the effective voltage applied to the first subpixel to make the second subpixel look brighter than the first one, the electric field applied to the liquid crystal layer is directed from the counter electrode toward the subpixel electrode. The electric field with such a direction is supposed to have a second polarity. In the next vertical scanning period, as the absolute value of the effective voltage applied to the first subpixel becomes greater than that of the effective voltage applied to the second subpixel to make the first subpixel look brighter than the second subpixel, the electric field has the first polarity. And in the next vertical scanning period, as the absolute value of the effective voltage applied to the second subpixel becomes greater than that of the effective voltage applied to the first subpixel to make the second subpixel look brighter than the first one, the electric field has the second polarity.

In this manner, in the liquid crystal display device disclosed in Patent Document No. 2, the electric field always has the first polarity when the effective voltage applied to the first subpixel has the greater absolute value and always has the second polarity when the effective voltage applied to the second subpixel has the greater absolute value. That is why the average effective voltages applied to the first and second subpixels have the first and second polarities, respectively.

In a normal liquid crystal display device, if the same image continues to be presented for a long time with the average of the voltages applied to a pixel kept unequal to zero (i.e., with a DC voltage component left in the voltage applied to the pixel), then that image that has been presented for a long time will still remain on the screen even when the images on the screen are changed after that. That is to say, a so-called "residual image" phenomenon will occur. To avoid such a residual image phenomenon, a normal liquid crystal display device performs an AC drive on (i.e., applies voltages with two different polarities but with the same absolute value to) pixels, thereby making the average of the voltages applied to the liquid crystal layer equal to zero. Furthermore, if the average of the voltages applied does not become equal to zero even by the AC drive, then the normal liquid crystal display device further regulates the counter voltage, thereby setting the average voltage equal to zero.

In the liquid crystal display device disclosed in Patent Document No. 2, however, the respective effective voltages applied to the first and second subpixels have mutually different averages. That is why even if the counter voltage is regulated, only the average voltage applied to one of the two subpixels can be made equal to zero and the average voltage applied to the other subpixel cannot be zero. In that case, the residual image phenomenon will occur in the subpixel with the non-zero average voltage. As a result, the residual image phenomenon cannot be eliminated from the overall display device. Consequently, in the liquid crystal display device disclosed in Patent Document No. 2, not both of the average voltages applied to the first and second subpixels can be equal to zero, and therefore, the residual image and other reliability-related problems should arise.

In order to overcome the problems described above, the present invention has an object of providing a liquid crystal display device that can resolve those reliability-related problems such as non-smoothness of the image on the screen and the residual image phenomenon.

Means for Solving the Problems

A liquid crystal display device according to the present invention includes a plurality of pixels, each including a first subpixel and a second subpixel. Each of the first and second subpixels includes: a counter electrode; a subpixel electrode; and a liquid crystal layer interposed between the counter electrode and the subpixel electrode. The subpixel electrodes of the first and second subpixels are provided separately from each other as first and second subpixel electrodes, respectively, while the first and second subpixels share the same counter electrode with each other. When a predetermined grayscale tone is displayed continuously through four or more consecutive even number of vertical scanning periods, the first and second subpixels have mutually different luminances in at least two of the even number of vertical scanning periods, first polarity periods that are included in the even number of vertical scanning periods and that maintain a first polarity are as long as second polarity periods that are also included in the even number of vertical scanning periods and that maintain a second polarity for each of the first and second subpixels, and in each of the first and second polarity periods, the difference between the average of effective voltages applied to the liquid crystal layer of the first subpixel and that of effective voltages applied to the liquid crystal layer of the second subpixel is substantially equal to zero.

In one preferred embodiment, if the effective voltages applied to the respective liquid crystal layers of the first and second subpixels of each said pixel are represented by VLspa and VLspb, respectively, then two of the four consecutive vertical scanning periods are the first polarity periods and the other two vertical scanning periods are the second polarity periods. In at least one of the first polarity periods and the second polarity periods, one of the two vertical scanning periods thereof satisfies $|VLspa|>|VLspb|$ and the other vertical scanning period satisfies $|VLspa|<|VLspb|$.

In another preferred embodiment, if the effective voltages applied to the respective liquid crystal layers of the first and second subpixels of each said pixel are represented by VLspa and VLspb, respectively, then two of the four consecutive vertical scanning periods are the first polarity periods and the other two vertical scanning periods are the second polarity periods. In at least one of the first polarity periods and the second polarity periods, the $|VLspa|$ and $|VLspb|$ values of one of the two vertical scanning periods thereof are equal to those of the other vertical scanning period.

In this particular preferred embodiment, of the four vertical scanning periods, the number of vertical scanning periods that satisfy $|VLspa|>|VLspb|$ is equal to that of vertical scanning periods that satisfy $|VLspa|<|VLspb|$.

In still another preferred embodiment, the plurality of the pixels are arranged in column and row directions so as to form a matrix pattern, and in each of the plurality of the pixels, the first and second subpixels are arranged in the column direction.

In yet another preferred embodiment, in each of the plurality of the pixels, voltages applied to the first and second subpixel electrodes change as voltages on their associated storage capacitor lines vary.

In this particular preferred embodiment, in each of the plurality of the pixels, a voltage on a storage capacitor line associated with the first subpixel electrode and a voltage on a storage capacitor line associated with the second subpixel electrode change mutually differently.

In yet another preferred embodiment, a voltage applied to the second subpixel electrode of a particular one of the plurality of the pixels and a voltage applied to the first subpixel electrode of another pixel that is adjacent to the particular pixel in the column direction change as the voltage on their common storage capacitor line varies.

In an alternative preferred embodiment, a voltage applied to the second subpixel electrode of a particular one of the plurality of the pixels and a voltage applied to the first subpixel electrode of another pixel that is adjacent to the particular pixel in the column direction change as voltages on their associated storage capacitor lines vary.

In yet another preferred embodiment, in each of the plurality of the pixels, the first and second subpixel electrodes are connected to the same signal line by way of their associated switching element.

In yet another preferred embodiment, in each of the plurality of the pixels, the first and second subpixel electrodes are respectively connected to first and second signal lines by way of first and second switching elements, respectively.

In yet another preferred embodiment, in each of the first and second polarity periods, one of the two vertical scanning periods satisfies $|VLspa|>|VLspb|$ and the other vertical scanning period satisfies $|VLspa|<|VLspb|$.

In yet another preferred embodiment, in each of the plurality of the pixels, $|VLspa|$ and $|VLspb|$ switch their magnitudes every vertical scanning period and the polarities of the first and second subpixels are inverted every other vertical scanning period.

In yet another preferred embodiment, the frame frequency is 60 Hz.

In yet another preferred embodiment, in each of the plurality of the pixels, $|VLspa|$ and $|VLspb|$ switch their magnitudes every other vertical scanning period and the polarities of the first and second subpixels are inverted every vertical scanning period.

In yet another preferred embodiment, the frame frequency is 120 Hz.

In yet another preferred embodiment, in each of the plurality of the pixels, $|VLspa|$ and $|VLspb|$ switch their magnitudes every other vertical scanning period and the polarities of the first and second subpixels are inverted every other vertical scanning period. $|VLspa|$ and $|VLspb|$ switch their magnitudes non-synchronously with the inversion of the polarities of the first and second subpixels.

In yet another preferred embodiment, in either the first polarity periods or the second polarity periods, one of the two vertical scanning periods satisfies $|VLspa|>|VLspb|$ and the other vertical scanning period satisfies $|VLspa|<|VLspb|$. In the other polarity periods, VLspa is equal to VLspb in each of the two vertical scanning periods.

In this particular preferred embodiment, voltages on storage capacitor lines associated with the first and second subpixel electrodes change between a first level, a second level that is higher than the first level, and a third level that is higher than the second level.

In yet another preferred embodiment, the first and second subpixel electrodes have the same display area.

Effects of the Invention

The present invention provides a liquid crystal display device that can minimize the occurrence of reliability problems such as non-smoothness of image displayed or residual images.

BRIEF DESCRIPTION OF DRAWINGS

FIG. 14 is a schematic representation illustrating the arrangement, brightness levels and polarities of multiple subpixels in the liquid crystal display device of the first preferred embodiment.

Figure 18:
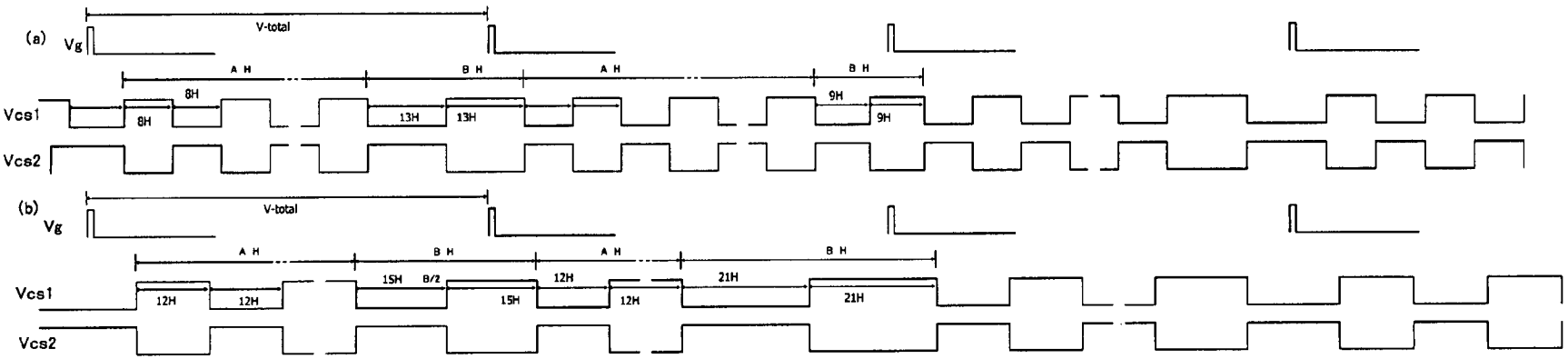

Portions (*a*) and (*b*) of FIG. 18 show exemplary waveforms of various voltages to be applied over a number of vertical scanning periods to the liquid crystal display device of the first preferred embodiment.

Figure 19:
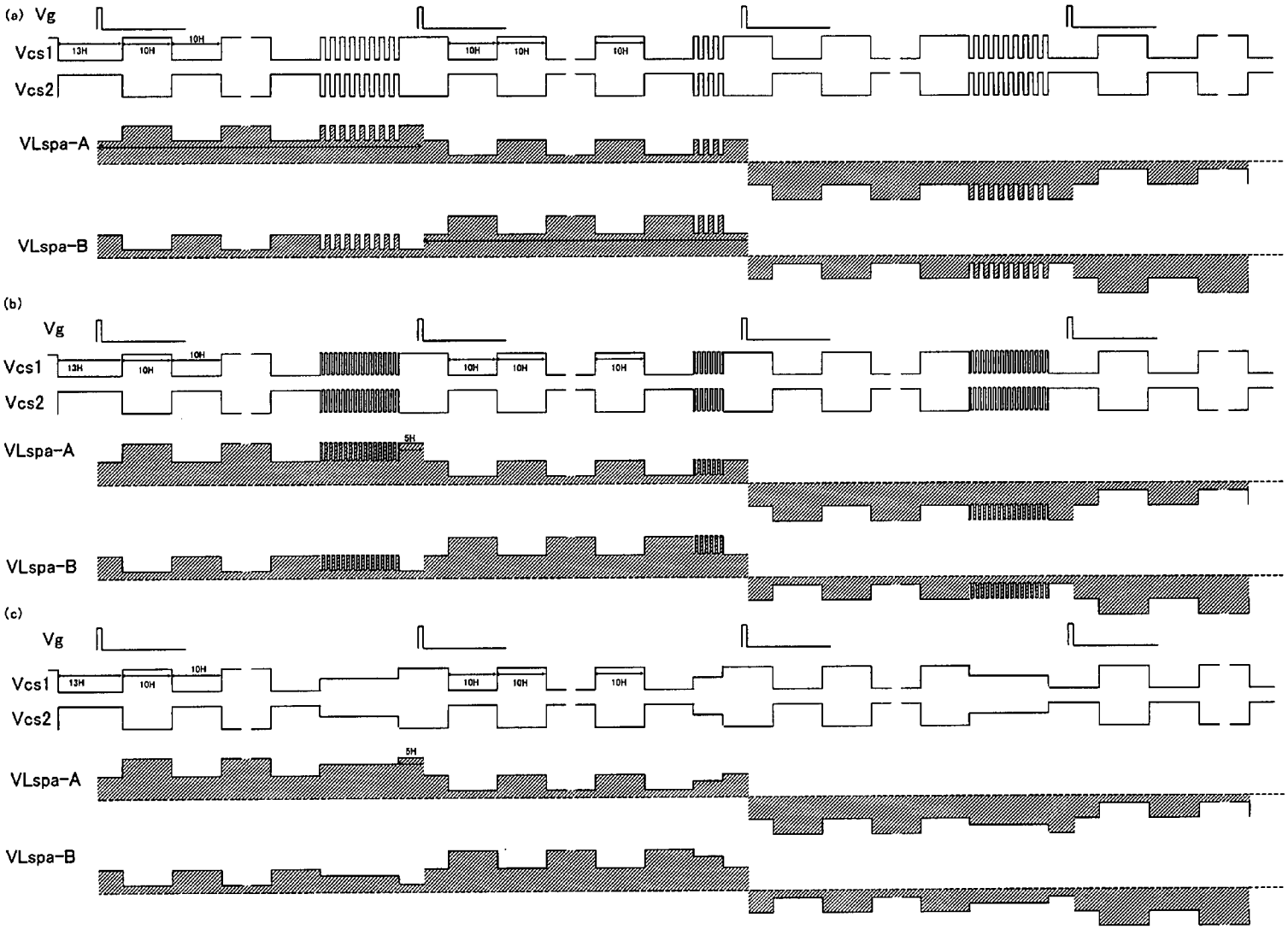

Portions (*a*) to (*c*) of FIG. 19 show exemplary waveforms of various voltages to be applied over a number of vertical scanning periods to the liquid crystal display device of the first preferred embodiment.

Figure 20:
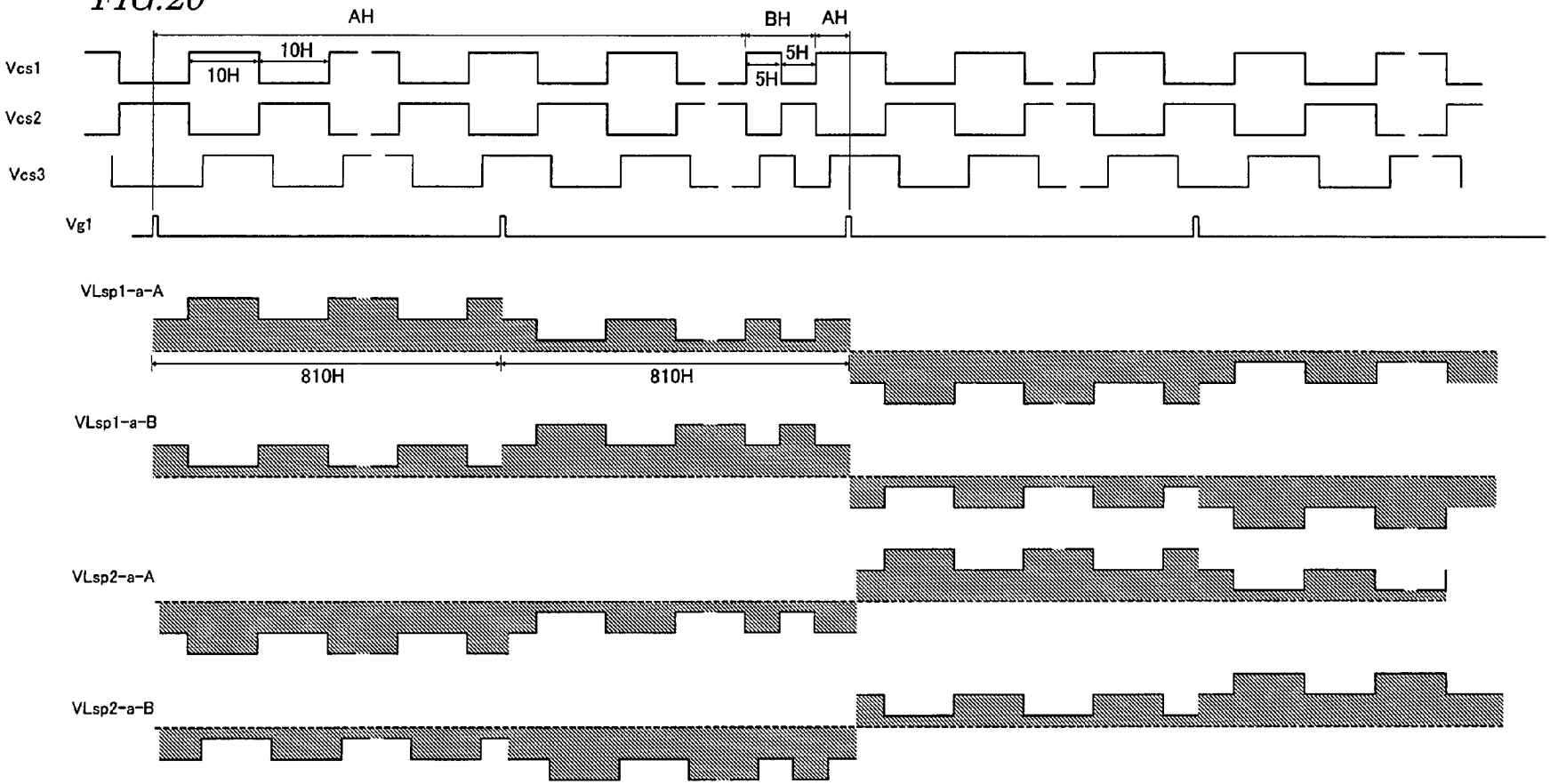

FIG. 20 shows exemplary waveforms of various voltages to be applied over a number of vertical scanning periods to the liquid crystal display device of the first preferred embodiment.

Figure 21:
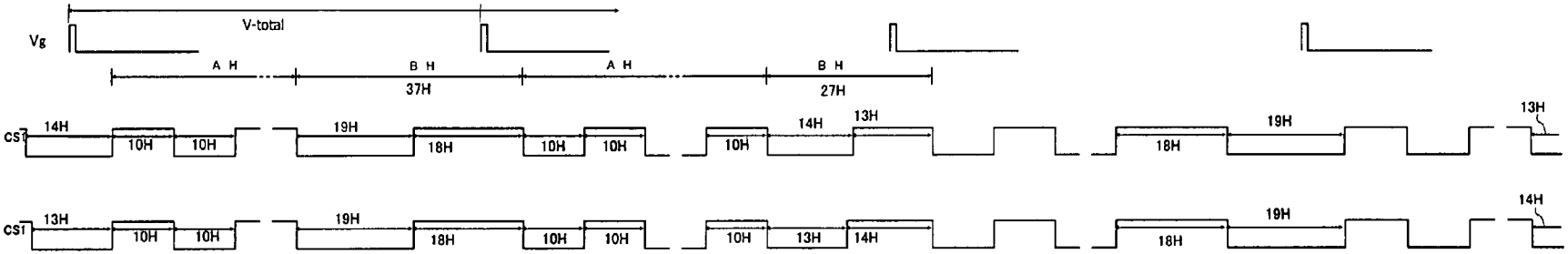

FIG. 21 shows exemplary waveforms of various voltages to be applied over a number of vertical scanning periods to the liquid crystal display device of the first preferred embodiment.

Figure 22:
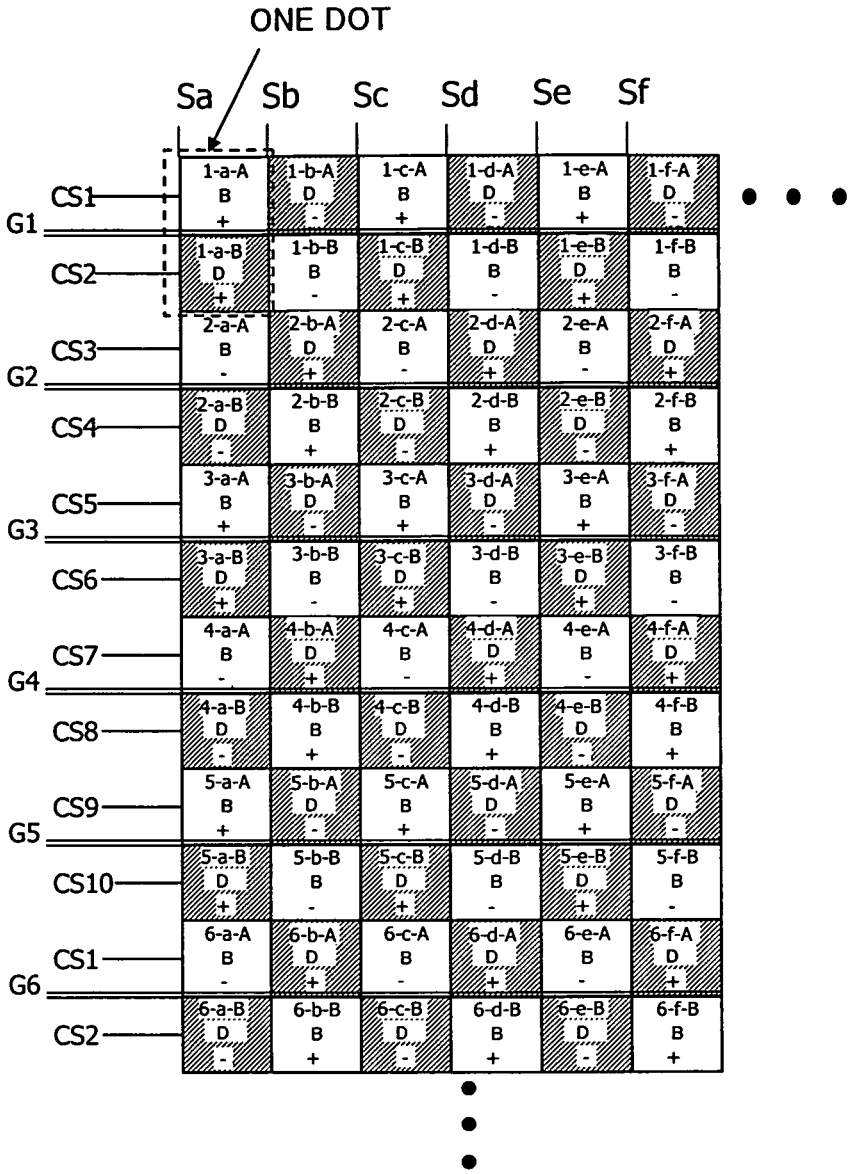

FIG. 22 is a schematic representation illustrating the brightness levels and polarities of respective subpixels and the first change of storage capacitor voltages in respective vertical scanning periods of each subpixel in the liquid crystal display device of the first preferred embodiment.

Figure 23:
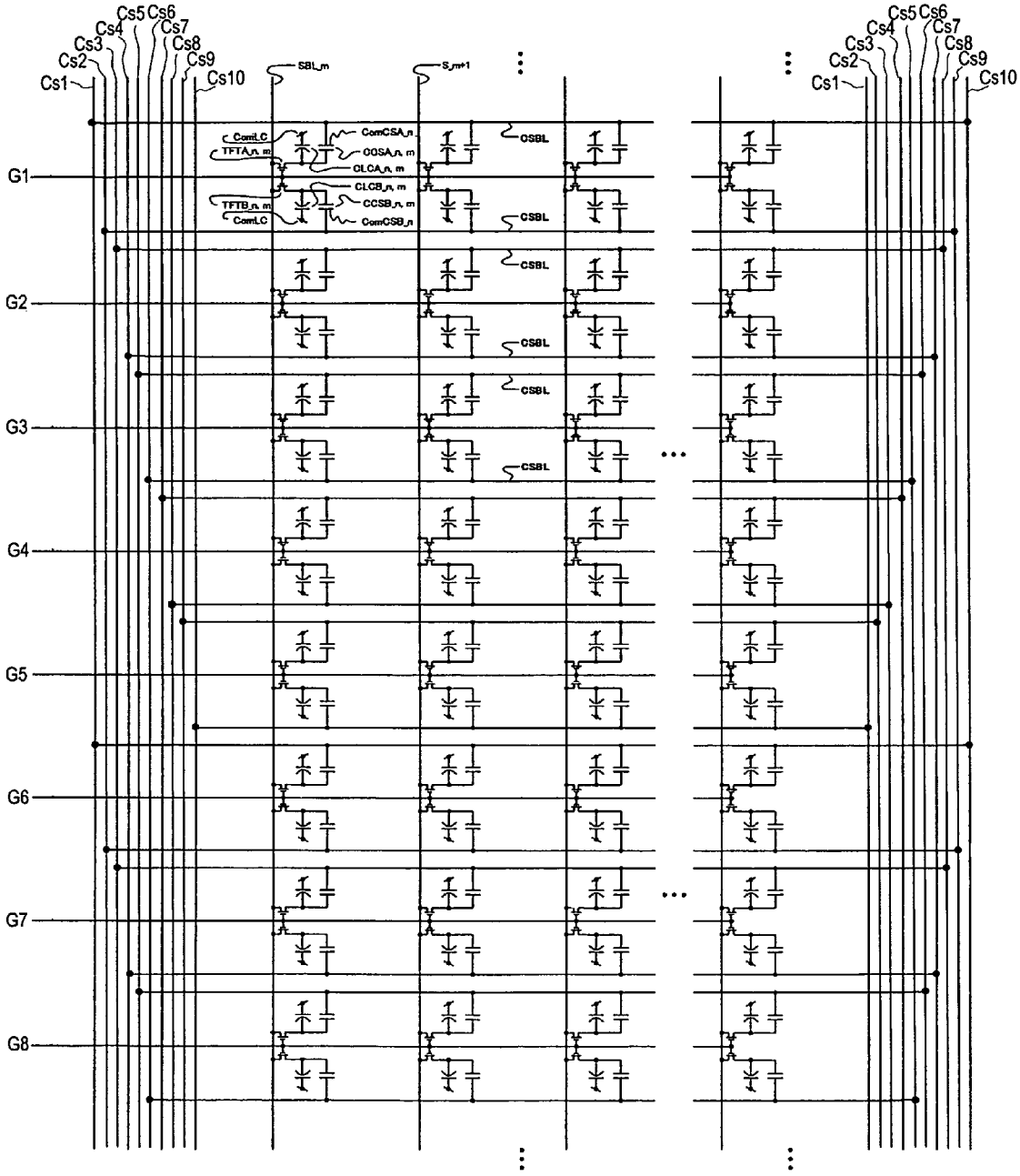

FIG. 23 shows an exemplary equivalent circuit diagram of the liquid crystal display device of the first preferred embodiment.

Figure 24:
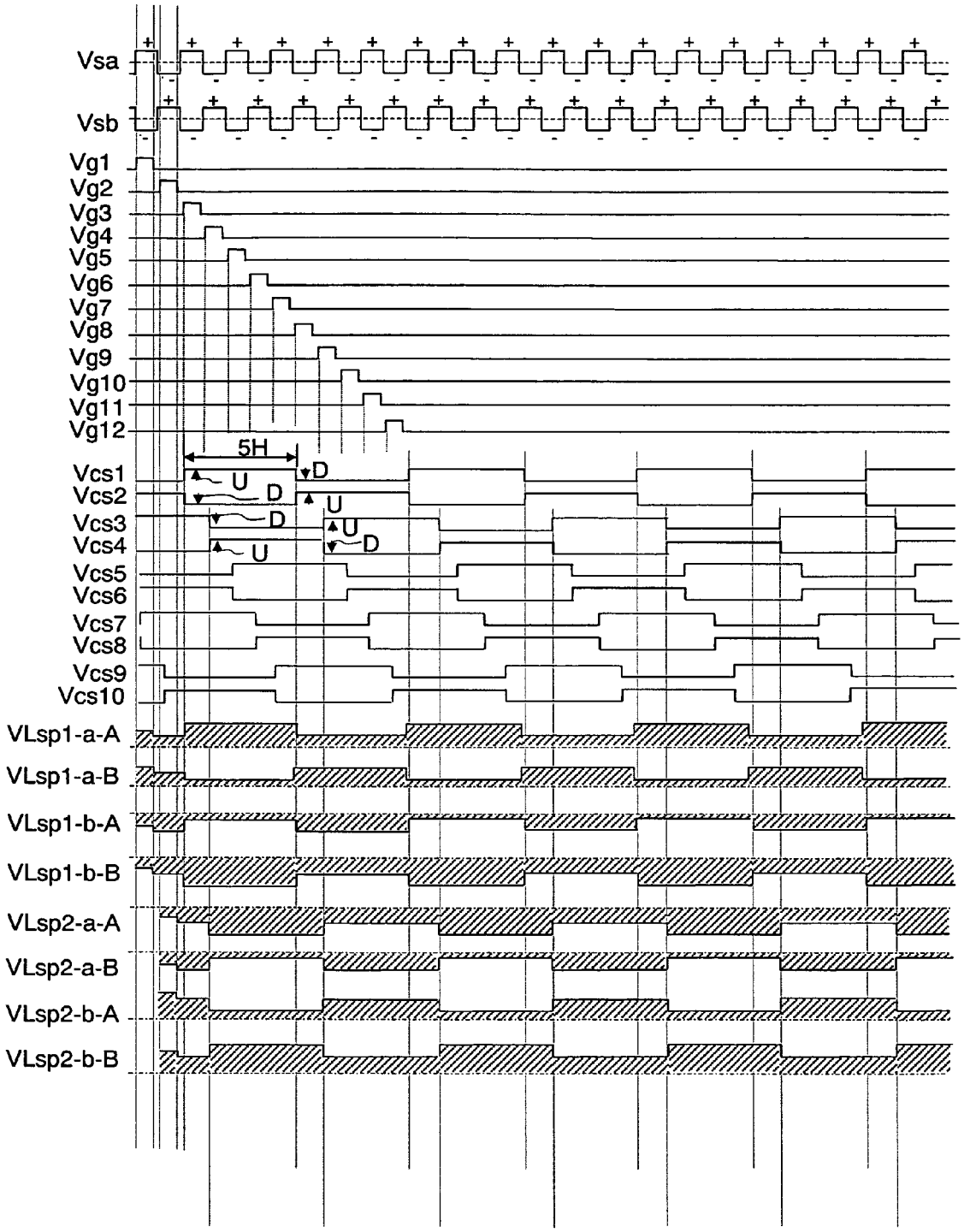

FIG. 24 shows exemplary waveforms of various voltages to be applied to the liquid crystal display device of the first preferred embodiment.

Figure 25:
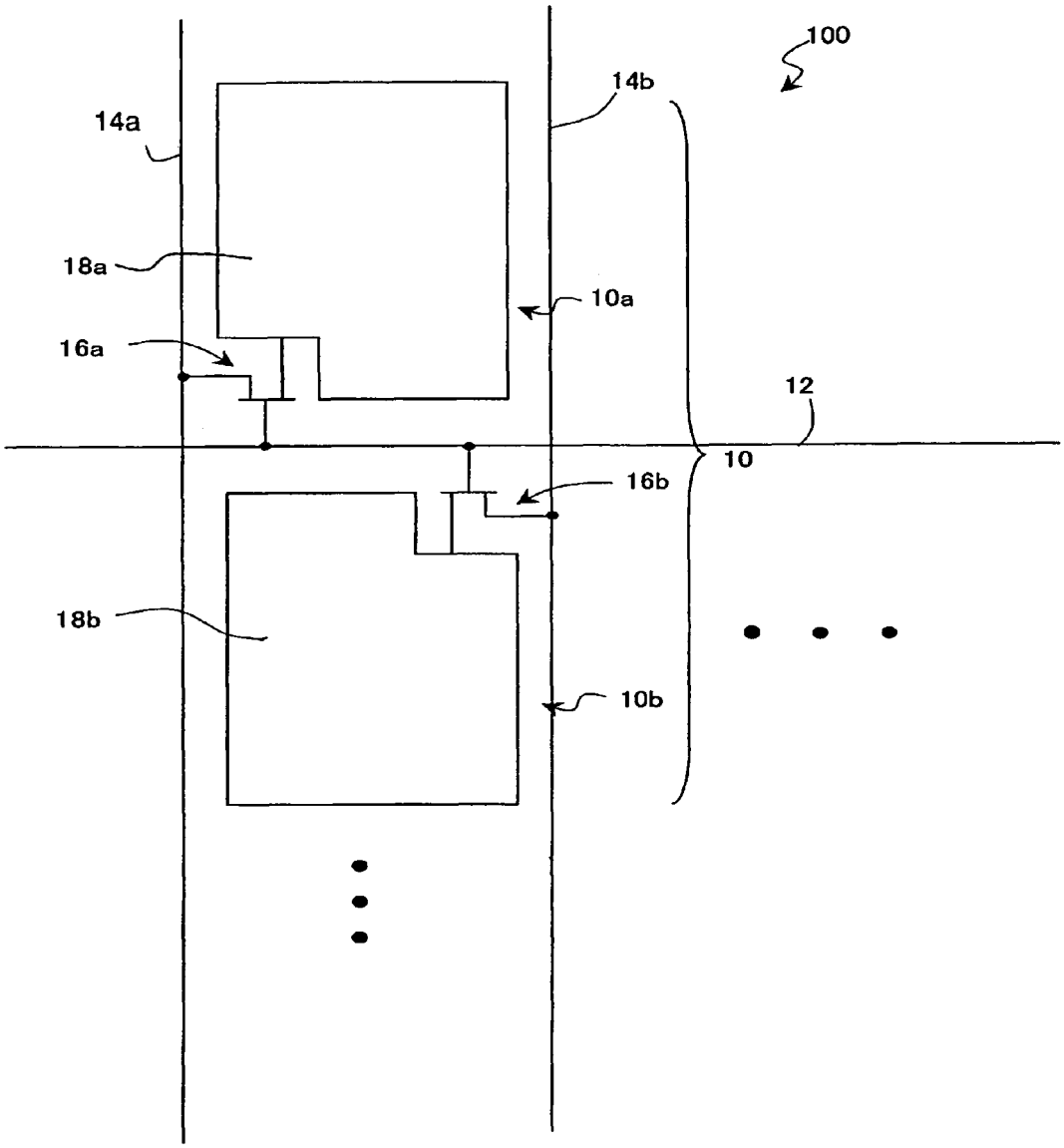

FIG. 25 is a schematic representation illustrating an exemplary pixel structure for the liquid crystal display device of the first preferred embodiment.

Figure 26:
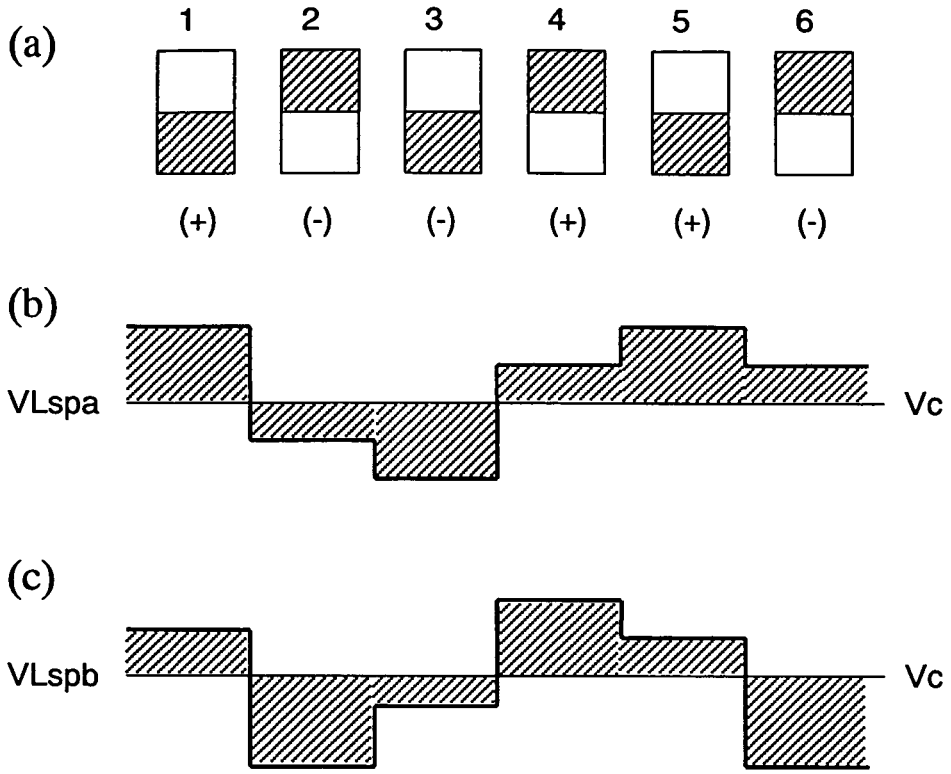

FIG. 26 schematically shows how first and second subpixels change their brightness levels, polarities and effective voltages in a liquid crystal display device as a second preferred embodiment of the present invention, wherein portion (*a*) schematically shows how the first and second subpixels change their brightness levels and polarities and portions (*b*) and (*c*) schematically show how the effective voltages applied to the respective liquid crystal layers of the first and second subpixels change.

Figure 27:
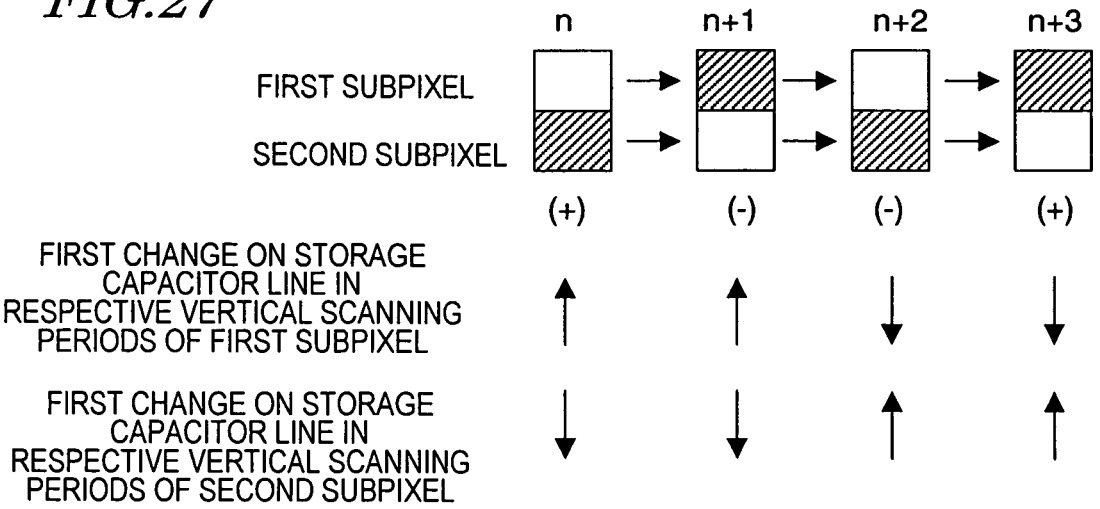

FIG. 27 is a schematic representation illustrating the brightness levels and polarities of respective subpixels and the first change of storage capacitor voltages in respective vertical scanning periods of each subpixel in the liquid crystal display device of the second preferred embodiment.

Figure 28:
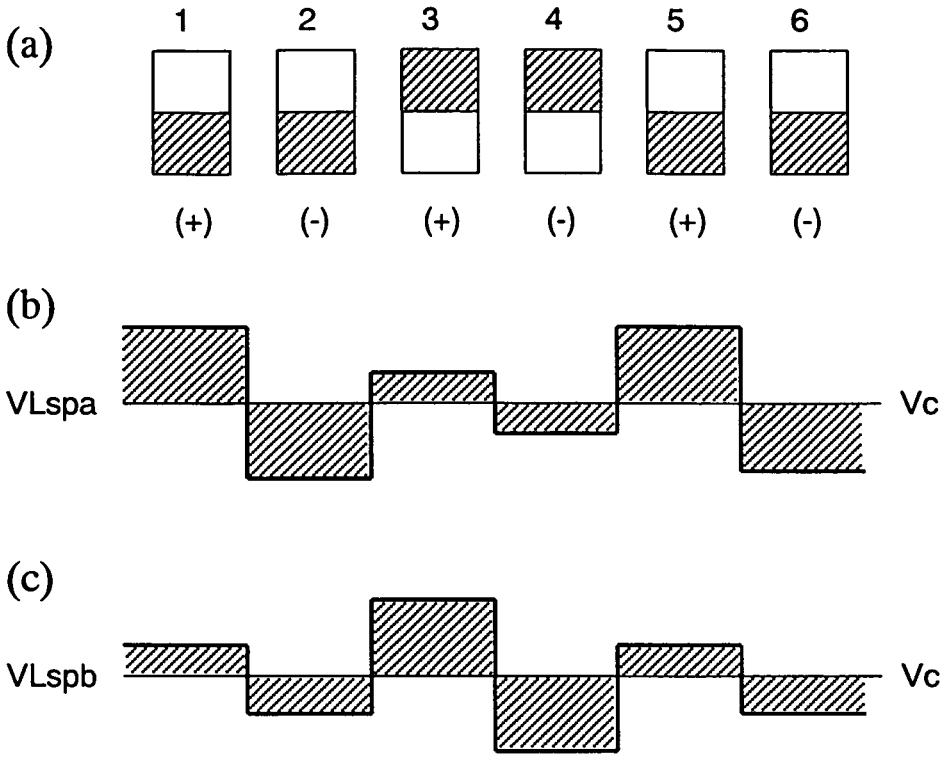

FIG. 28 schematically shows how first and second subpixels change their brightness levels, polarities and effective voltages in a liquid crystal display device as a third preferred embodiment of the present invention, wherein portion (*a*) schematically shows how the first and second subpixels change their brightness levels and polarities and portions (*b*) and (*c*) schematically show how the effective voltages applied to the respective liquid crystal layers of the first and second subpixels change.

Figure 29:
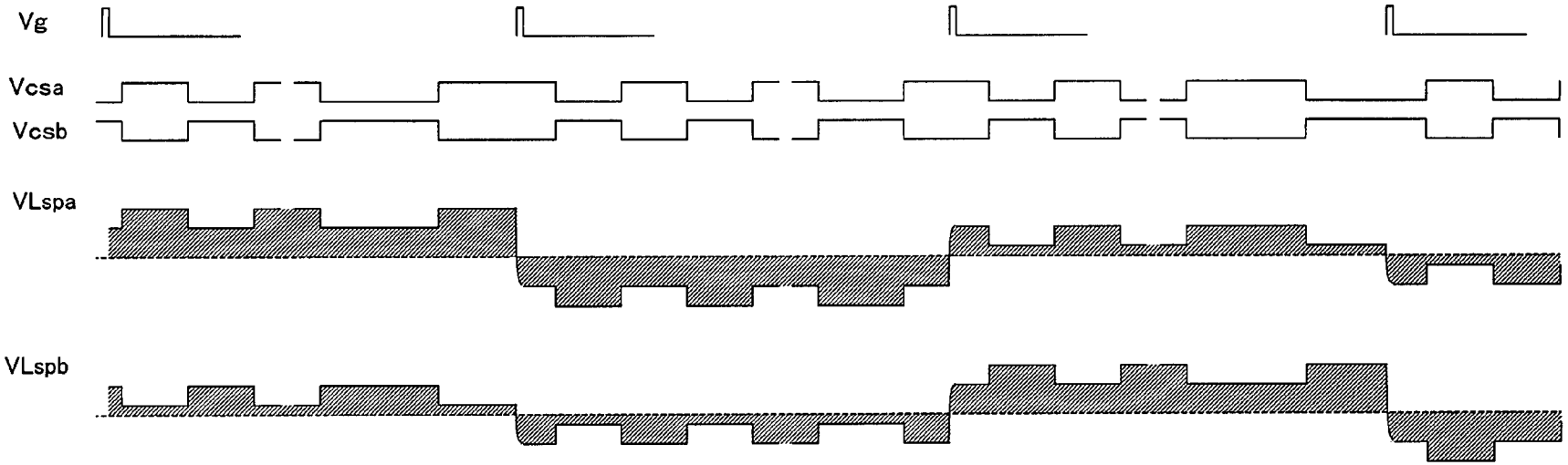

FIG. 29 shows exemplary waveforms of various voltages to be applied to the liquid crystal display device of the third preferred embodiment.

Figure 30:
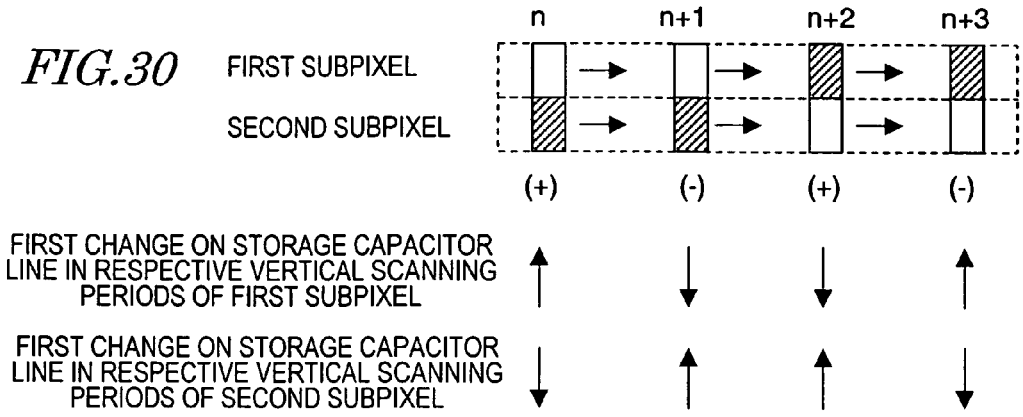

FIG. 30 is a schematic representation illustrating the brightness levels and polarities of respective subpixels and the first change of storage capacitor voltages in respective vertical scanning periods of each subpixel in the liquid crystal display device of the third preferred embodiment.

Figure 31:
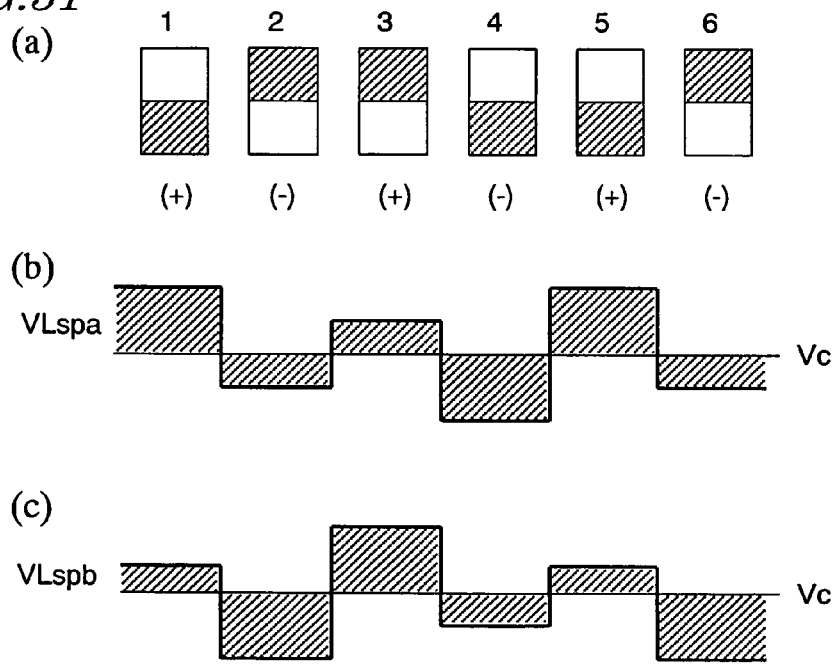

FIG. 31 schematically shows how first and second subpixels change their brightness levels, polarities and effective voltages in a liquid crystal display device as a fourth preferred embodiment of the present invention, wherein portion (*a*) schematically shows how the first and second subpixels change their brightness levels and polarities and portions (*b*) and (*c*) schematically show how the effective voltages applied to the respective liquid crystal layers of the first and second subpixels change.

Figure 32:
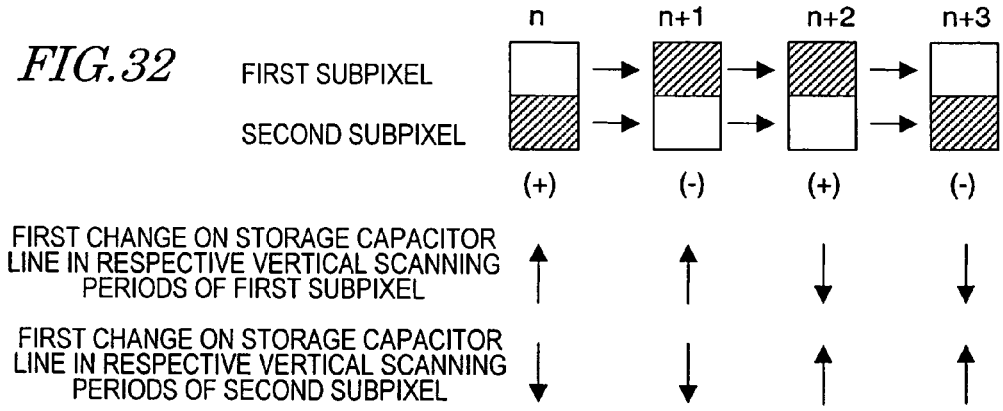

FIG. 32 is a schematic representation illustrating the brightness levels and polarities of respective subpixels and the first change of storage capacitor voltages in respective vertical scanning periods of each subpixel in the liquid crystal display device of the fourth preferred embodiment.

Figure 33:
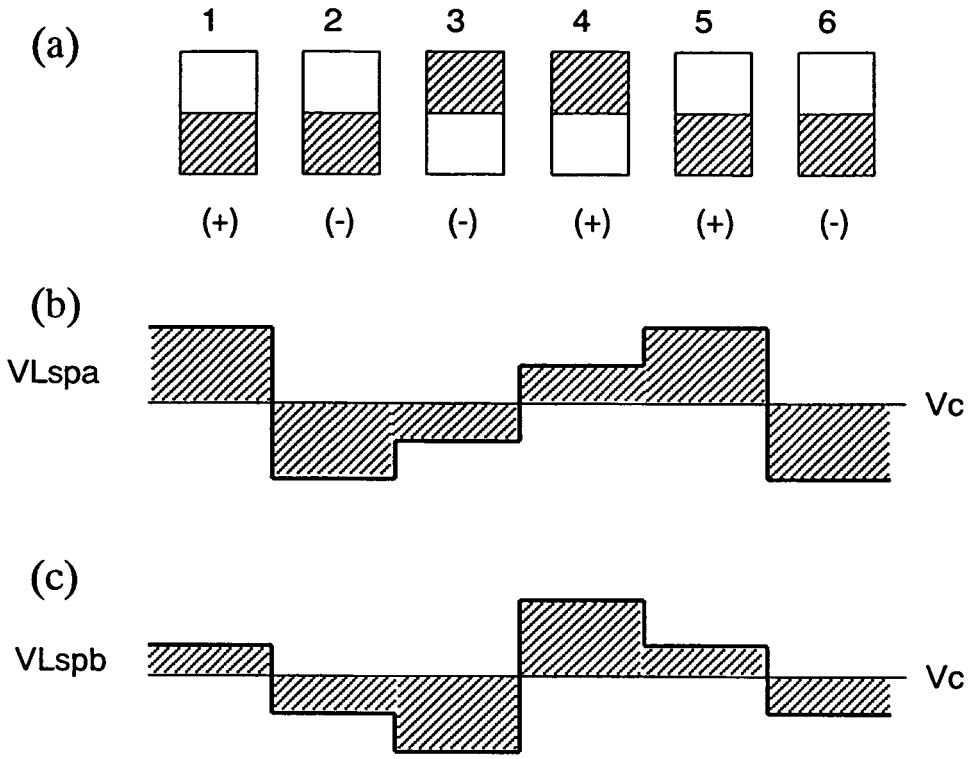

FIG. 33 schematically shows how first and second subpixels change their brightness levels, polarities and effective voltages in a liquid crystal display device as a fifth preferred embodiment of the present invention, wherein portion (*a*) schematically shows how the first and second subpixels change their brightness levels and polarities and portions (*b*) and (*c*) schematically show how the effective voltages applied to the respective liquid crystal layers of the first and second subpixels change.

Figure 34:
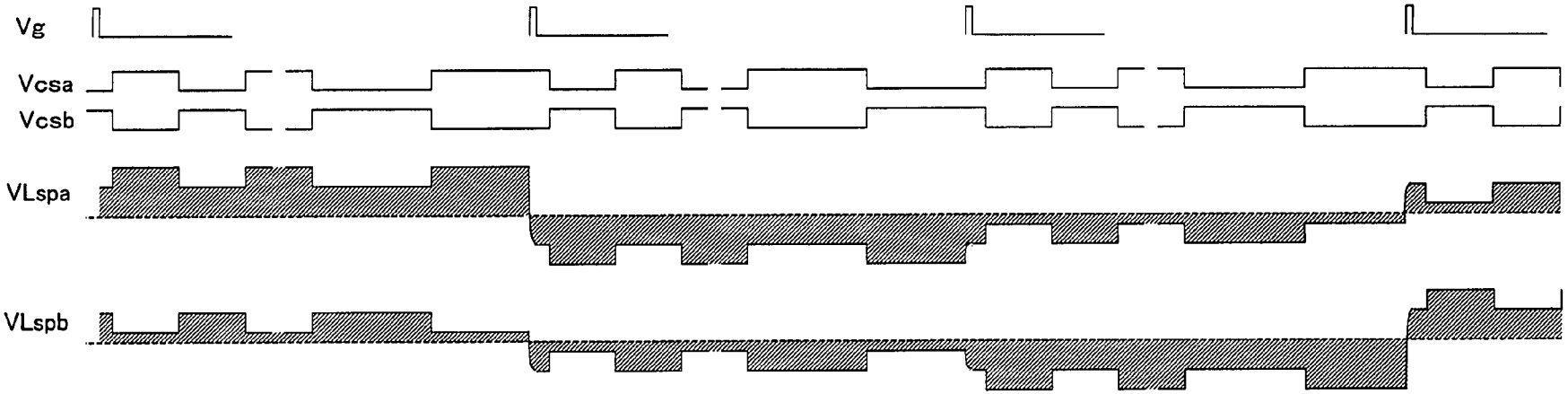

FIG. 34 shows exemplary waveforms of various voltages to be applied to the liquid crystal display device of the fifth preferred embodiment.

Figure 35:
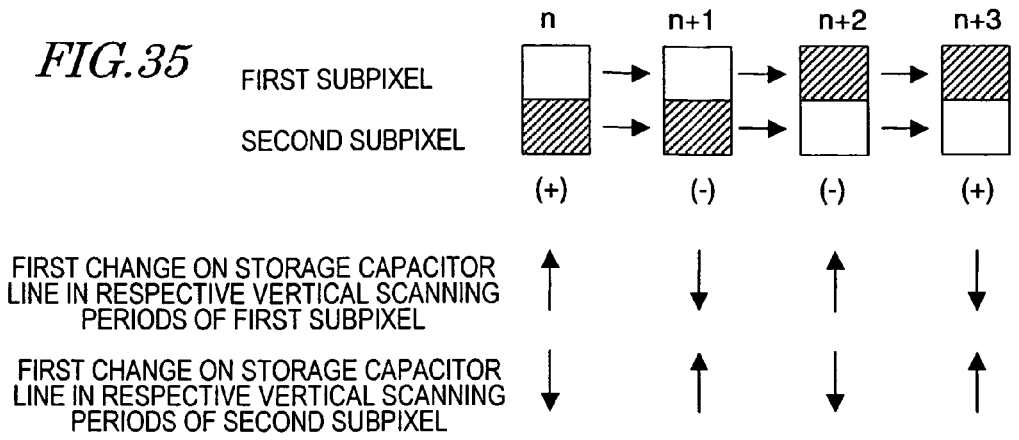

FIG. 35 is a schematic representation illustrating the brightness levels and polarities of respective subpixels and the first change of storage capacitor voltages in respective vertical scanning periods of each subpixel in the liquid crystal display device of the fifth preferred embodiment.

Figure 36:
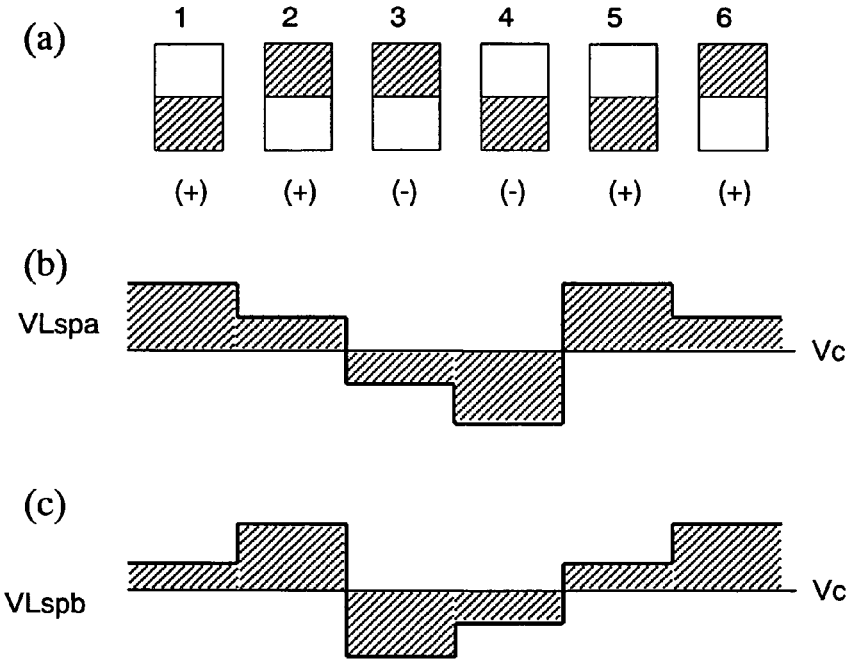

FIG. 36 schematically shows how first and second subpixels change their brightness levels, polarities and effective voltages in a liquid crystal display device as a sixth preferred embodiment of the present invention, wherein portion (*a*) schematically shows how the first and second subpixels change their brightness levels and polarities and portions (*b*) and (*c*) schematically show how the effective voltages applied to the respective liquid crystal layers of the first and second subpixels change.

Figure 37:
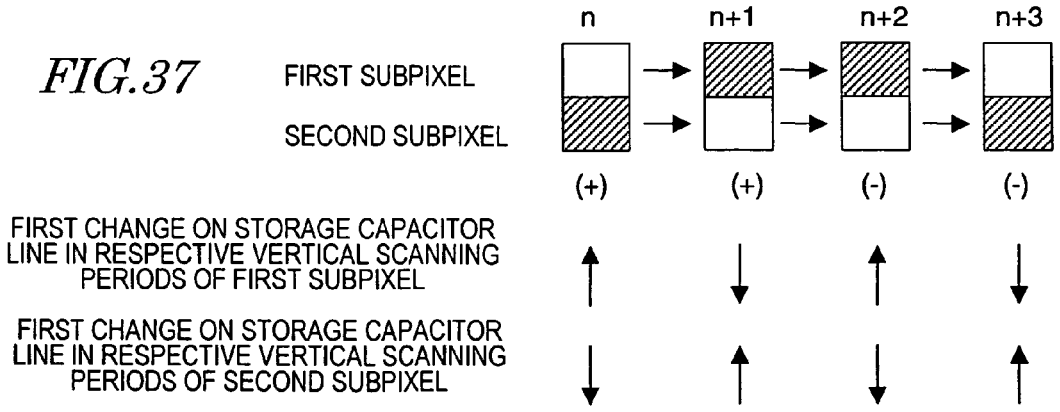

FIG. 37 is a schematic representation illustrating the brightness levels and polarities of respective subpixels and the first change of storage capacitor voltages in respective vertical scanning periods of each subpixel in the liquid crystal display device of the sixth preferred embodiment.

Figure 38:
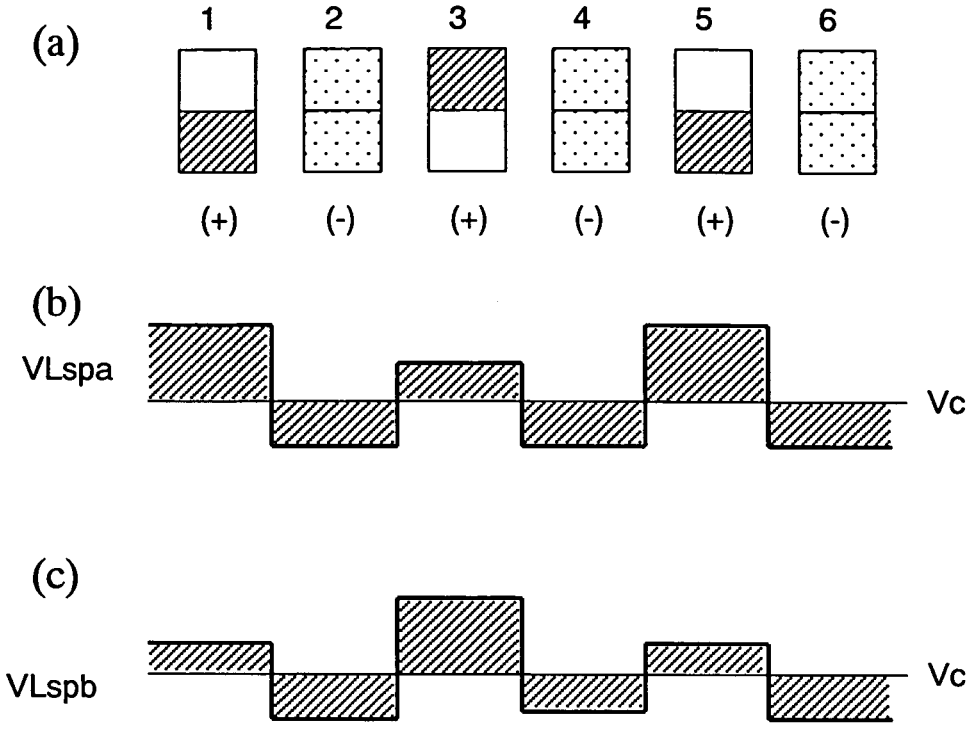

FIG. 38 schematically shows how first and second subpixels change their brightness levels, polarities and effective voltages in a liquid crystal display device as a seventh preferred embodiment of the present invention, wherein portion (*a*) schematically shows how the first and second subpixels change their brightness levels and polarities and portions (*b*) and (*c*) schematically show how the effective voltages applied to the respective liquid crystal layers of the first and second subpixels change.

FIG. 39A is a schematic representation illustrating the brightness levels and polarities of respective subpixels and the first change of storage capacitor voltages in respective vertical scanning periods of each subpixel in one frame for the liquid crystal display device of the seventh preferred embodiment.

FIG. 39B is a schematic representation illustrating the brightness levels and polarities of respective subpixels and the first change of storage capacitor voltages in respective vertical scanning periods of each subpixel in the next frame for the liquid crystal display device of the seventh preferred embodiment.

Figure 40:
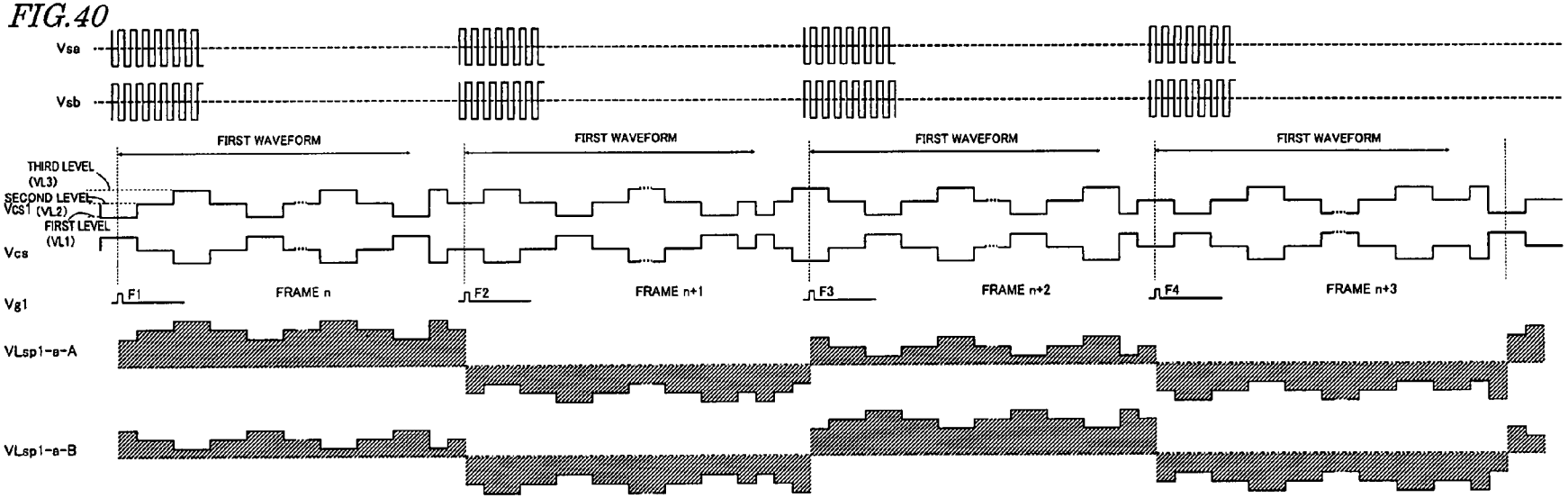

FIG. 40 shows exemplary waveforms of various voltages to be applied to the liquid crystal display device of the seventh preferred embodiment.

DESCRIPTION OF REFERENCE NUMERALS

10 pixel
10*a*, 10*b* subpixel
13 liquid crystal layer
17 counter electrode
18*a*, 18*b* subpixel electrode
100 liquid crystal display device
100A liquid crystal panel

BEST MODE FOR CARRYING OUT THE INVENTION

Embodiment 1

Hereinafter, a first preferred embodiment of a liquid crystal display device according to the present invention will be described with reference to the accompanying drawings.

Figure 1:
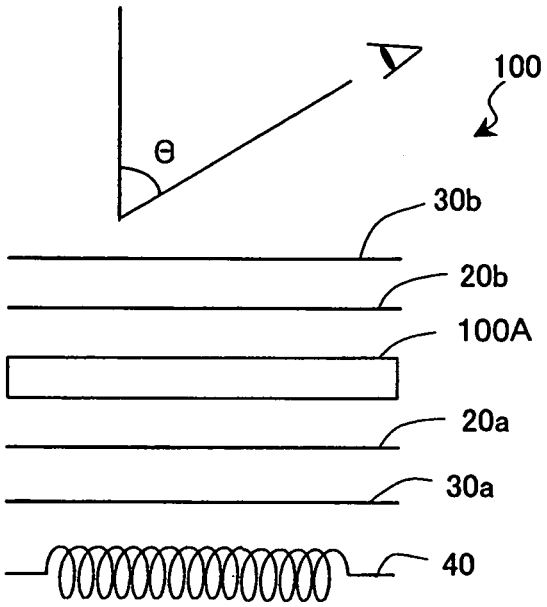
FIG. 1 is a schematic representation illustrating the structure of a liquid crystal display device as a first preferred embodiment of the present invention.
Figure 2:
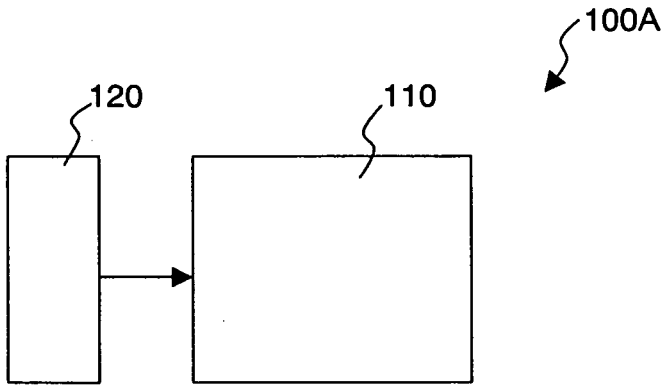
FIG. 2 is a schematic block diagram illustrating a liquid crystal panel for the liquid crystal display device of the first preferred embodiment.
Figure 3:
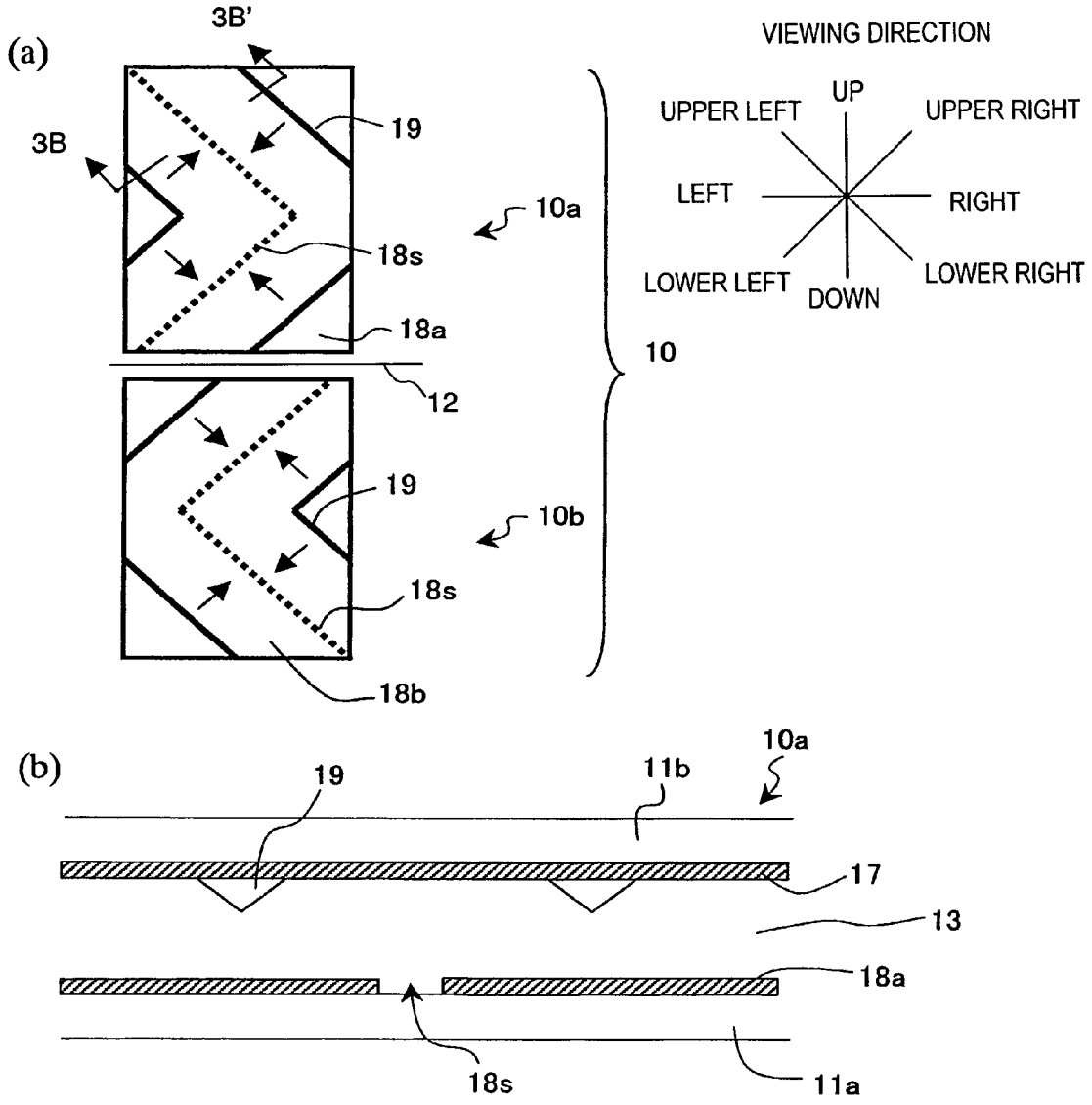
FIG. 3(*a*) is a schematic plan view illustrating a single pixel in the liquid crystal display device of the first preferred embodiment and FIG. 3(*b*) is a schematic cross-sectional view illustrating a single subpixel thereof.

First of all, the configuration of a liquid crystal display device 100 as the first preferred embodiment of the present invention will be outlined with reference to FIGS. 1 to 3. FIG. 1 illustrates the liquid crystal display device 100 of this preferred embodiment. The liquid crystal panel 100A of the liquid crystal display device 100 includes a display section 110 in which a number of pixels are arranged in columns and rows to define a matrix pattern and a driver 120 for driving the display section 110 as shown in FIG. 2. In the display section 110, each pixel includes a liquid crystal layer and a plurality of electrodes for applying a voltage to the liquid crystal layer. The driver 120 generates a drive signal based on an input video signal.

FIG. 3(*a*) is a schematic plan view illustrating the electrode structure of a single pixel, while FIG. 3(*b*) is a schematic cross-sectional view of a single subpixel as viewed on the plane 3B-3B' shown in FIG. 3(*a*). As shown in FIG. 3(*a*), each pixel 10 includes first and second subpixels 10*a* and 10*b* that are arranged in the column direction. As shown in FIG. 3(*b*), the first subpixel 10*a* includes a liquid crystal layer 13, a first subpixel electrode 18*a*, and a counter electrode 17 that faces the first subpixel electrode 18*a* with the liquid crystal layer 13 interposed between them. Although FIG. 3(*b*) illustrates the configuration of only the first subpixel 10*a*, the second subpixel 10*b* has the same configuration as the one illustrated in FIG. 3(*b*). The counter electrode 17 is typically provided as a single common electrode for every pixel 10. In the liquid crystal display device 100 of this preferred embodiment, mutually different voltages are applicable to the first and second subpixel electrodes 18*a* and 18*b*, thus making the effective voltage applied to the liquid crystal layer of the first subpixel 10*a* different from the one applied to that of the second subpixel 10*b*.

Next, it will be described with reference to FIGS. 4 through 6 and in comparison with the liquid crystal display devices disclosed in Patent Documents Nos. 1 and 2 how the brightness levels of the subpixels and the directions of the electric field (or electric line of force) change in the liquid crystal display device 100 of this preferred embodiment. In the following description, each pixel is supposed to display a predetermined grayscale tone for several frames on end for the sake of simplicity.

First of all, it will be described with reference to FIG. 4 how the brightness levels of the subpixels and the directions of the electric field change and how the effective voltages applied to the respective liquid crystal layers of the first and second subpixels change in the liquid crystal display device disclosed in Patent Document No. 1. In portion (*a*) of FIG. 4, the reference numerals 1 through 6 denote respective vertical scanning periods. As used herein, one "vertical scanning period" is defined to be an interval between a point in time when one scan line is selected to write a display signal voltage and a point in time when that scan line is selected to write the next display signal voltage. Also, each of one frame period of a non-interlaced drive input video signal and one field period of an interlaced drive input video signal will be referred to herein as "one vertical scanning period of the input video signal". Normally, one vertical scanning period of a liquid crystal display device corresponds to one vertical scanning period of the input video signal. In the example to be described below, one vertical scanning period of the liquid crystal panel is supposed to correspond to that of the input video signal for the sake of simplicity. However, the present invention is in no way limited to that specific preferred embodiment. The present invention is also applicable to a so-called "2× drive" with a vertical scanning frequency of 120 Hz in which two vertical scanning periods of the liquid crystal panel (that lasts $2\times 1/120$ sec, for example) are allocated to one vertical scanning period of the input video signal (that lasts $1/60$ sec, for example). Also, in this example, the lengths of the respective vertical scanning periods are supposed to be equal to each other. Furthermore, in each vertical scanning period, the interval between a point in time when one scan line is selected and a point in time when the next scan line is selected will be referred to herein as one horizontal scanning period (1H).

Figure 4:
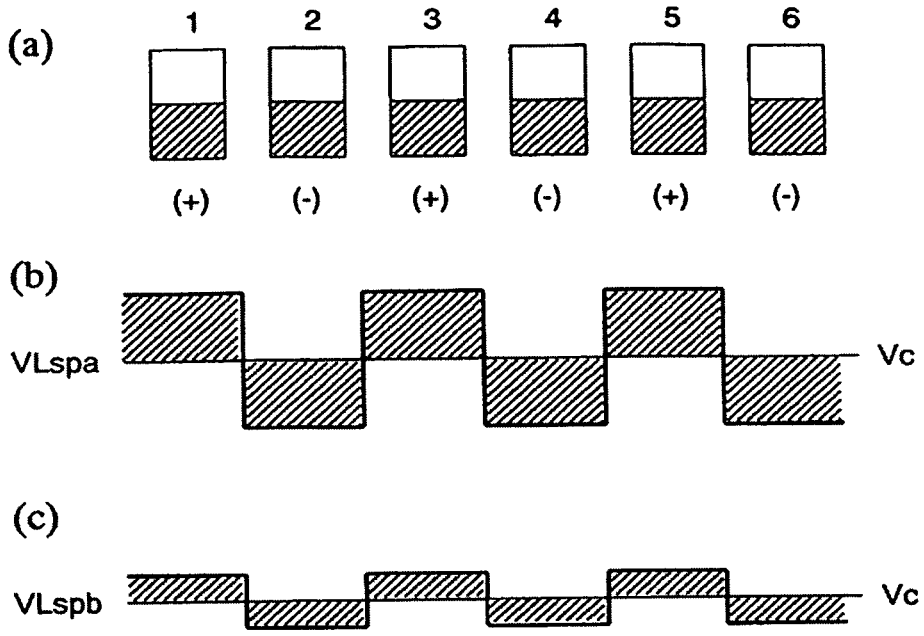
PRIOR ART FIG.4
FIG. 4 schematically shows how first and second subpixels change their brightness levels, polarities and effective voltages in a conventional liquid crystal display device, wherein portion (*a*) schematically shows how the first and second subpixels change their brightness levels and polarities and portions (*b*) and (*c*) schematically show how the effective voltages applied to the respective liquid crystal layers of the first and second subpixels change.

In portion (*a*) of FIG. 4, the upper and lower rectangles represent the first and second subpixels, respectively. Of these two subpixels, the one with the higher luminance is plain, while the other with the lower luminance is shadowed. Also, in portion (*a*) of FIG. 4, "+" and "−" represent the polarities of the display signal voltages when the associated scan line is selected with respect to the common voltage applied to the counter electrode. In this case, "+" indicates that the potential at the first and second subpixel electrodes is higher than the one at the counter electrode and that the electric field is directed from the subpixel electrodes toward the counter electrode. On the other hand, "−" indicates that the potential at the first and second subpixel electrodes is lower than the one at the counter electrode and that the electric field is directed from the counter electrode toward the subpixel electrodes. In the following description, "+" and "−" will be referred to herein as a "first polarity" and a "second polarity", respectively, and will also be collectively referred to herein as "polarities". Also, a period with the "+" polarity and a period with the "−" polarity will be referred to herein as a "first polarity period" and a "second polarity period", respectively.

As shown in portion (*a*) of FIG. 4, the first, third and fifth periods are first polarity periods, the second, fourth and sixth periods are second polarity periods, and the polarity inverts every vertical scanning period in the liquid crystal display device disclosed in Patent Document No. 1. As also shown in portion (*a*) of FIG. 4, in any of the first through sixth periods, the first subpixel has a higher luminance than the second subpixel in the device of Patent Document No. 1.

Portions (*b*) and (*c*) of FIG. 4 show the effective voltages VLspa and VLspb that are applied to the respective liquid crystal layers of the first and second subpixels in the respective vertical scanning periods in the liquid crystal display device of Patent Document No. 1. The levels of these voltages are indicated by the bold lines. The effective voltages VLspa and VLspb applied to the respective liquid crystal layers of the first and second subpixels are the effective values of the differences between the voltages applied to the first and second subpixel electrodes and the voltage Vc applied to the counter electrode. In this example, the voltage Vc applied to the counter electrode is shown as being constant. Although not shown in portions (*b*) and (*c*) of FIG. 4, the voltages applied to the respective liquid crystal layers of the first and second subpixels may also be changed within the same vertical scanning period by varying the voltage on the storage capacitor line as disclosed in Patent Document No. 1.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 4, the first period is a first polarity period and the first subpixel is brighter than the second subpixel. However, on the transition from the first period into the second period, the effective voltages VLspa and VLspb applied to the respective liquid crystal layers of the first and second subpixels change. In the second period, the voltages applied to the first and second subpixel electrodes are lower than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 4, the second period is a second polarity period and the first subpixel is brighter than the second subpixel.

From the third period on, the same brightness levels and polarities of the first and second subpixels as those of the first and second periods just appear repeatedly. Consequently, in the liquid crystal display device disclosed in Patent Document No. 1, the luminance of the first subpixel is always higher than that of the second subpixel, the difference in brightness level between those subpixels is quite sensible, and the image on the screen looks non-smooth as can be seen from portion (*a*) of FIG. 4.

Next, it will be described with reference to FIG. 5 how the brightness levels of the subpixels, the directions of the electric field, and the effective voltages applied to the respective liquid crystal layers of the first and second subpixel change in the liquid crystal display device disclosed in Patent Document No. 2.

Figure 5:
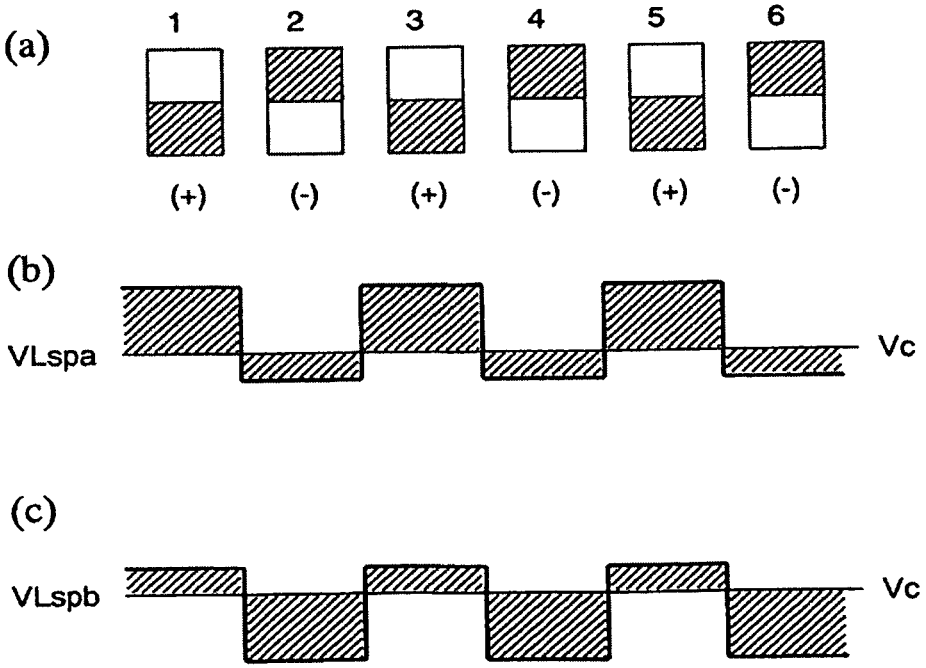
PRIOR ART FIG.5
FIG. 5 schematically shows how first and second subpixels change their brightness levels, polarities and effective voltages in another conventional liquid crystal display device, wherein portion (*a*) schematically shows how the first and second subpixels change their brightness levels and polarities and portions (*b*) and (*c*) schematically show how the effective voltages applied to the respective liquid crystal layers of the first and second subpixels change.

As shown in portion (*a*) of FIG. 5, in the liquid crystal display device disclosed in Patent Document No. 2, the first, third and fifth periods are also first polarity periods, the second, fourth and sixth periods are second polarity periods, and the polarity inverts every vertical scanning period. Meanwhile, in the liquid crystal display device of Patent Document No. 2, the luminance of the first subpixel is higher than that of the second subpixel in the first, third and fifth periods but the luminance of the second subpixel is higher than that of the first subpixel in the second, fourth and sixth periods.

Portions (*b*) and (*c*) of FIG. 5 show the effective voltages VLspa and VLspb that are applied to the respective liquid crystal layers of the first and second subpixels in the respective vertical scanning periods. The levels of these voltages are indicated by the bold lines. Although not shown in portions (*b*) and (*c*) of FIG. 5, the voltages applied to the respective liquid crystal layers of the first and second subpixels may also be changed within the same vertical scanning period by varying the voltage on the storage capacitor line as disclosed in Patent Document No. 1.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 5, the first period is a first polarity period and the first subpixel is brighter than the second subpixel. However, on the transition from the first period into the second period, the effective voltages VLspa and VLspb applied to the respective liquid crystal layers of the first and second subpixels change. In the second period, the voltages applied to the first and second subpixel electrodes are lower than the voltage applied to the counter electrode, and the absolute value of the effective voltage applied to the liquid crystal layer of the second subpixel is greater than that of the effective voltage applied to that of the first subpixel (|VLspa|<|VLspb|). For that reason, as shown in portion (*a*) of FIG. 5, the second period is a second polarity period and the second subpixel is brighter than the first subpixel.

From the third period on, the same brightness levels and polarities of the first and second subpixels as those of the first and second periods just appear repeatedly. In the liquid crystal display device disclosed in Patent Document No. 2, since not only the polarity but also the brightness levels of the subpixels are inverted every vertical scanning period, the first subpixel is sometimes brighter, but sometimes less bright, than the second subpixel unlike the liquid crystal display device disclosed in Patent Document No. 1. Consequently, the degree of non-smoothness on the screen can be reduced. In the liquid crystal display device disclosed in Patent Document No. 2, however, the period in which the first subpixel is brighter than the second subpixel is always the first polarity period and the period in which the second subpixel is brighter than the first subpixel is always the second polarity period. That is why as can be seen from portions (*b*) and (*c*) of FIG. 5, the average of the effective voltages VLspa applied to the liquid crystal layer of the first subpixel over multiple vertical scanning periods (e.g., the first through fourth periods) is higher than the voltage Vc applied to the counter electrode, and the average of the effective voltages VLspb applied to the liquid crystal layer of the second subpixel over multiple vertical scanning periods (e.g., the first through fourth periods) is lower than the voltage Vc applied to the counter electrode. Thus, in the liquid crystal display device disclosed in Patent Document No. 2, the uneven distribution of DC levels among the respective subpixels still remains to produce residual image and other reliability-related problems.

Next, it will be described with reference to FIG. 6 how the brightness levels of the subpixels, the directions of the electric field, and the effective voltages applied to the respective liquid crystal layers of the first and second subpixel change in the liquid crystal display device 100 of this preferred embodiment.

Figure 6:
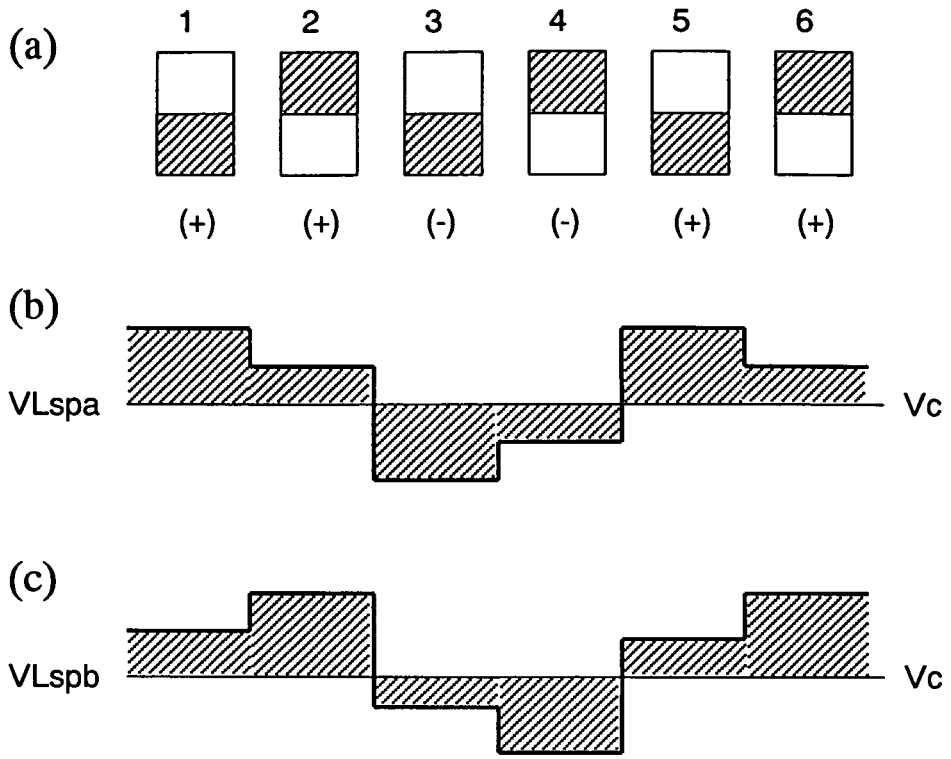
FIG. 6 schematically shows how first and second subpixels change their brightness levels, polarities and effective voltages in the liquid crystal display device as the first preferred embodiment of the present invention, wherein portion (*a*) schematically shows how the first and second subpixels change their brightness levels and polarities and portions (*b*) and (*c*) schematically show how the effective voltages applied to the respective liquid crystal layers of the first and second subpixels change.

As shown in portion (*a*) of FIG. 6, in the liquid crystal display device 100 of this preferred embodiment, the first, second, fifth and sixth periods are first polarity periods, while the third and fourth periods are second polarity periods. As described above, the first polarity period is a period in which the voltages applied to the first and second subpixel electrodes are higher than the one applied to the counter electrode, while the second polarity period is a period in which the voltages applied to the first and second subpixel electrodes are lower than the one applied to the counter electrode. Look at four consecutive vertical scanning periods, and it can be seen that two out of the four periods are first polarity periods and the other two are second polarity periods. For example, in the first through fourth periods shown in portion (*a*) of FIG. 6, the first and second periods are first polarity periods and the third and fourth periods are second polarity periods.

Portions (*b*) and (*c*) of FIG. 6 show the effective voltages VLspa and VLspb that are applied to the respective liquid crystal layers of the first and second subpixels in the respective vertical scanning periods. The levels of these voltages are indicated by the bold lines. In this preferred embodiment, the voltages applied to the respective liquid crystal layers of the first and second subpixels may also be changed within the same vertical scanning period by varying the voltage on the storage capacitor line just as disclosed in Patent Documents Nos. 1 and 2. Also, since the voltage Vc applied to the counter electrode is used as a reference voltage in portions (*b*) and (*c*) of FIG. 6, the voltage Vc applied to the counter electrode is illustrated as being constant irrespective of time. However, the voltage Vc applied to the counter electrode may also vary with time.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 6, the first period is a first polarity period and the first subpixel is brighter than the second subpixel.

However, on the transition from the first period into the second period, the effective voltages VLspa and VLspb applied to the respective liquid crystal layers of the first and second subpixels change. In the second period, the voltages applied to the first and second subpixel electrodes are higher than the voltage applied to the counter electrode, and the absolute value of the effective voltage applied to the liquid crystal layer of the second subpixel is greater than that of the effective voltage applied to that of the first subpixel (|VLspa|<|VLspb|). For that reason, as shown in portion (*a*) of FIG. 6, the second period is a first polarity period and the second subpixel is brighter than the first subpixel.

In the third period, the voltages applied to the first and second subpixel electrodes are lower than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 6, the third period is a second polarity period and the first subpixel is brighter than the second subpixel.

In the fourth period, the voltages applied to the first and second subpixel electrodes are lower than the voltage applied to the counter electrode, and the absolute value of the effective voltage applied to the liquid crystal layer of the second subpixel is greater than that of the effective voltage applied to that of the first subpixel (|VLspa|<|VLspb|). For that reason, as shown in portion (*a*) of FIG. 6, the fourth period is a second polarity period and the second subpixel is brighter than the first subpixel. After that, from the fifth period on, the brightness levels and polarities of the first and second subpixels just repeat those of the first and second subpixels in the first through fourth periods.

As described above, in the liquid crystal display device 100 of this preferred embodiment, two out of four consecutive vertical scanning periods are first polarity periods, one of which satisfies |VLspa|>|VLspb| (e.g., the first period) and the other of which satisfies |VLspa|<|VLspb| (e.g., the second period). The two other ones of the four consecutive vertical scanning periods are second polarity periods, one of which satisfies |VLspa|>|VLspb| (e.g., the third period) and the other of which satisfies |VLspa|<|VLspb| (e.g., the fourth period). As can be seen from portion (*a*) of FIG. 6, in the liquid crystal display device 100 of this preferred embodiment, the brightness levels of the subpixels are inverted every vertical scanning period and the polarity is inverted every other vertical scanning period. Specifically, the (brightness, polarity) combination of the first subpixel changes in the order of (B(right), +), (D(ark), +), (B, −) and (D, −), while the (brightness, polarity) combination of the second subpixel changes in the order of (D, +), (B, +), (D, −) and (B, −), where "B" indicates that the pixel is brighter than the other pixel and "D" indicates that the pixel is darker than the other. Since the effective voltages of the subpixels change in this manner, the difference between the average of the effective voltage applied to the liquid crystal layer of the first subpixel and that of the effective voltages applied to that of the second subpixel in each of the first and second polarity periods becomes substantially equal to zero.

Unlike the liquid crystal display device of Patent Document No. 1, the liquid crystal display device 100 of this preferred embodiment inverts the brightness levels of the subpixels every vertical scanning period, thus minimizing the degree of non-smoothness of the image on the screen. Also, in the liquid crystal display device 100 of this preferred embodiment, each pair of first and second polarity periods has a period that satisfies |VLspa|>|VLspb| and a period that satisfies |VLspa|<VLspb| unlike the liquid crystal display device disclosed in Patent Document No. 2. Thus, as can be seen from portions (*b*) and (*c*) of FIG. 6, the average of the effective voltages VLspa and that of the effective voltages VLspb over multiple vertical scanning periods (e.g., the first through fourth periods) can be both equal to zero. Furthermore, even if the averages of the effective voltages VLspa and VLspb do not become equal to zero, the averages of the effective voltages VLspa and VLspb can be both controlled to zero by adjusting the counter voltage because the average of the effective voltages VLspa is approximately equal to that of the effective voltages VLspb. By controlling the averages of the effective voltages to zero in this manner, the residual image and other reliability-related problems can be overcome. It should be noted that various configurations could be used to apply mutually different voltages to the respective liquid crystal layers of the first and second subpixels such that the relations described above are satisfied.

This preferred embodiment is preferably applied to a liquid crystal display device that uses a vertical alignment liquid crystal layer including a nematic liquid crystal material with negative dielectric anisotropy. Specifically, the liquid crystal layer of each subpixel preferably has four domains in which the liquid crystal molecules tilt in respective azimuth directions that are different from each other by approximately 90 degrees under a voltage applied (i.e., may operate in the MVA mode). Alternatively, the liquid crystal layer of each subpixel may also have axisymmetric alignment at least when a voltage is applied thereto (i.e., may operate in the ASM mode).

Hereinafter, an MVA mode liquid crystal display device 100 according to this preferred embodiment will be described in further detail.

As shown in FIG. 1, the liquid crystal display device 100 includes a liquid crystal panel 10A, a pair of phase compensators (typically phase plates) 20*a* and 20*b* arranged on both sides of the liquid crystal panel 100A, a pair of polarizers 30*a* and 30*b* arranged to sandwich these members between them, and a backlight 40. The polarizers 30*a* and 30*b* are arranged as crossed Nicols such that their axes of transmission (which will also be referred to herein as "axes of polarization") cross each other at right angles. While no voltage is applied to the liquid crystal layer 13 of the liquid crystal panel 100A (see FIG. 3(*b*)), i.e., in a vertical alignment state, this device conducts black display. That is to say, this liquid crystal display device 100 is a normally black mode liquid crystal display device. The phase compensators 20*a* and 20*b* are provided to improve the viewing angle characteristic of the liquid crystal display device and may be designed as best ones by known technologies. Specifically, the phase compensators 20*a* and 20*b* may be optimized such that the difference in luminance between when the image is viewed obliquely and when the image is viewed straight in the black display mode (i.e., the difference in black luminance) is minimized in every azimuth direction.

As shown in FIG. 3(*a*), a scan line 12 is arranged between the first and second subpixel electrodes 18*a* and 18*b*. Naturally, scan lines 12, signal lines, TFTs (not shown in FIG. 3) and circuits for driving them are arranged on the substrate 11*a* to apply predetermined voltages to the first and second subpixel electrodes 18*a* and 18*b* at prescribed timings. On the other substrate 11*b*, color filters and other members are arranged as needed.

Next, the structure of a single pixel in the MVA mode liquid crystal display device 100 will be described with reference to FIGS. 3(*a*) and 3(*b*). The basic configuration and operation of an MVA mode liquid crystal display device are disclosed in Japanese Patent Application Laid-Open Publication No. 11-242225.

As shown in FIG. 3(*b*), the subpixel electrode 18*a* on the glass substrate 11*a* has a slit 18*s*, and the subpixel electrode 18*a* and the counter electrode 17 together generate an oblique electric field in the liquid crystal layer 13. On the other hand, on the surface of the glass substrate 11*b* with the counter electrode 17, arranged are ribs 19 that protrude toward the liquid crystal layer 13, which is made of a nematic liquid crystal material with negative dielectric anisotropy. And by providing a vertical alignment film (not shown) that covers the counter electrode 17, the ribs 19 and the subpixel electrodes 18*a* and 18*b*, the liquid crystal layer 13 exhibits a substantially vertically aligned state when no voltages are applied thereto. That is to say, the vertically aligned liquid crystal molecules can be tilted toward a predetermined direction with stability by using the sloped side surfaces of the ribs 19 and the oblique electric field in combination.

As shown in FIG. 3(*b*), the ribs 19 have sloped side surfaces that are raised toward their center, and the liquid crystal molecules are aligned substantially perpendicularly to those tilted side surfaces. Consequently, the ribs 19 produce a distribution of tilt angles of the liquid crystal molecules. As used herein, the tilt angle of a liquid crystal molecule means the angle defined by the long axis of the molecules with respect to the surface of the substrate. Also, the slit 18*s* changes the directions of the electric field applied to the liquid crystal layer regularly. Due to the combined effects of these ribs 19 and the slit 18*s*, when an electric field is applied, the liquid crystal molecules are aligned in the four directions indicated by the arrows in FIG. 3(*a*), i.e., upper rightward, upper leftward, lower rightward and lower leftward. As a result, a good viewing angle characteristic that is symmetrical both vertically and horizontally is realized. The rectangular display area of the liquid crystal panel 100A is typically arranged such that its longitudinal direction is defined horizontally and the transmission axis of the polarizer 30*a* is defined to be parallel to the longitudinal direction. On the other hand, the pixels 10 are arranged such that the longitudinal direction of the pixels 10 intersects with that of the liquid crystal panel 100A at right angles.

As shown in FIG. 3(*a*), the first and second subpixels 10*a* and 10*b* preferably have the same area. Each of these subpixels preferably has a first rib that runs in a first direction and a second rib that runs in a second direction that intersects with the first direction substantially at right angles, and the first and second ribs are preferably arranged symmetrically to each other within each subpixel with respect to a centerline that is defined parallel to the scan line 12. And the arrangement of the ribs in one of the two subpixels and that of the ribs in the other subpixel are preferably symmetrical to each other with respect to a centerline that is drawn perpendicularly to the scan line 12. By adopting such an arrangement, the liquid crystal molecules are aligned upper rightward, upper leftward, lower rightward and lower leftward within each subpixel and the respective liquid crystal domains come to have substantially the same area in the entire pixel including the first and second subpixels. As a result, a good viewing angle characteristic that is symmetrical both vertically and horizontally is realized. This effect is achieved particularly significantly when a pixel has a small area. Furthermore, it is preferred to adopt a configuration in which the interval between the respective centerlines of the two subpixels that are drawn parallel to the scan line is approximately equal to a half of the arrangement pitch of the scan lines.

Next, the specific structure of each pixel 10 in the liquid crystal display device 100 of this preferred embodiment and application of mutually different voltages to the respective liquid crystal layers of the two subpixels 10*a* and 10*b* included in this pixel 10 will be described with reference to FIGS. 7 through 9.

Figure 7:
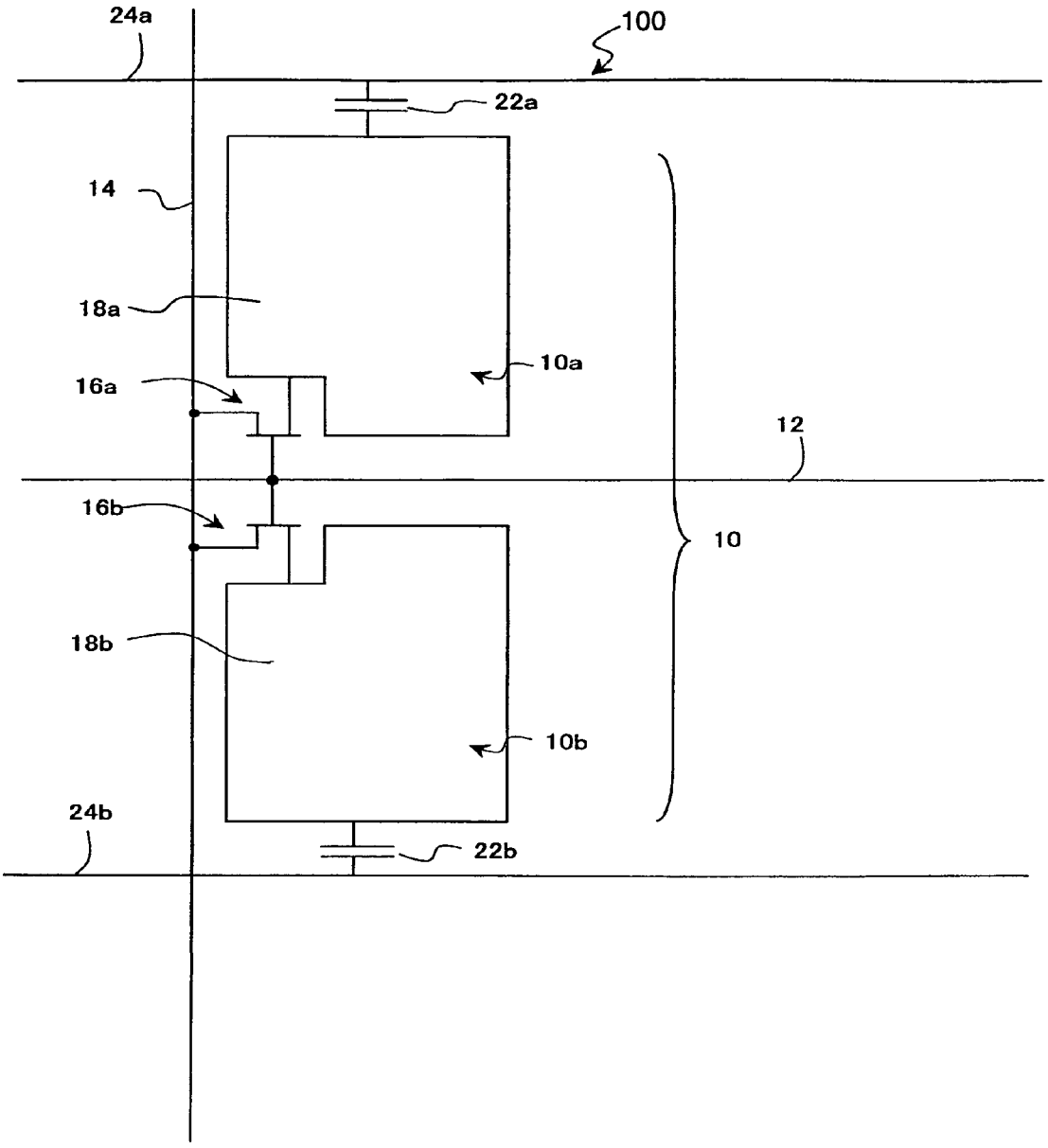
FIG. 7 is a schematic representation illustrating an exemplary pixel structure for the liquid crystal display device of the first preferred embodiment.

As shown in FIG. 7, the pixel 10 includes two subpixels 10*a* and 10*b*. To the subpixel electrodes 18*a* and 18*b* of the subpixels 10*a* and 10*b*, connected are their associated TFTs 16*a* and 16*b* and their associated storage capacitors (CS) 22*a* and 22*b*, respectively. The gate electrodes of the TFTs 16*a* and 16*b* are both connected to the same scan line 12. And the source electrodes of the TFTs 16*a* and 16*b* are connected to the same signal line 14. The storage capacitors 22*a* and 22*b* are connected to their associated storage capacitor lines (CS bus lines) 24*a* and 24*b*, respectively. The storage capacitor 22*a* includes a storage capacitor electrode that is electrically connected to the subpixel electrode 18*a*, a storage capacitor counter electrode that is electrically connected to the storage capacitor line 24*a*, and an insulating layer (not shown) arranged between the electrodes. The storage capacitor 22*b* includes a storage capacitor electrode that is electrically connected to the subpixel electrode 18*b*, a storage capacitor counter electrode that is electrically connected to the storage capacitor line 24*b*, and an insulating layer (not shown) arranged between the electrodes. The respective storage capacitor counter electrodes of the storage capacitors 22*a* and 22*b* are independent of each other and can receive mutually different storage capacitor counter voltages from the storage capacitor lines 24*a* and 24*b*, respectively.

Figure 8:
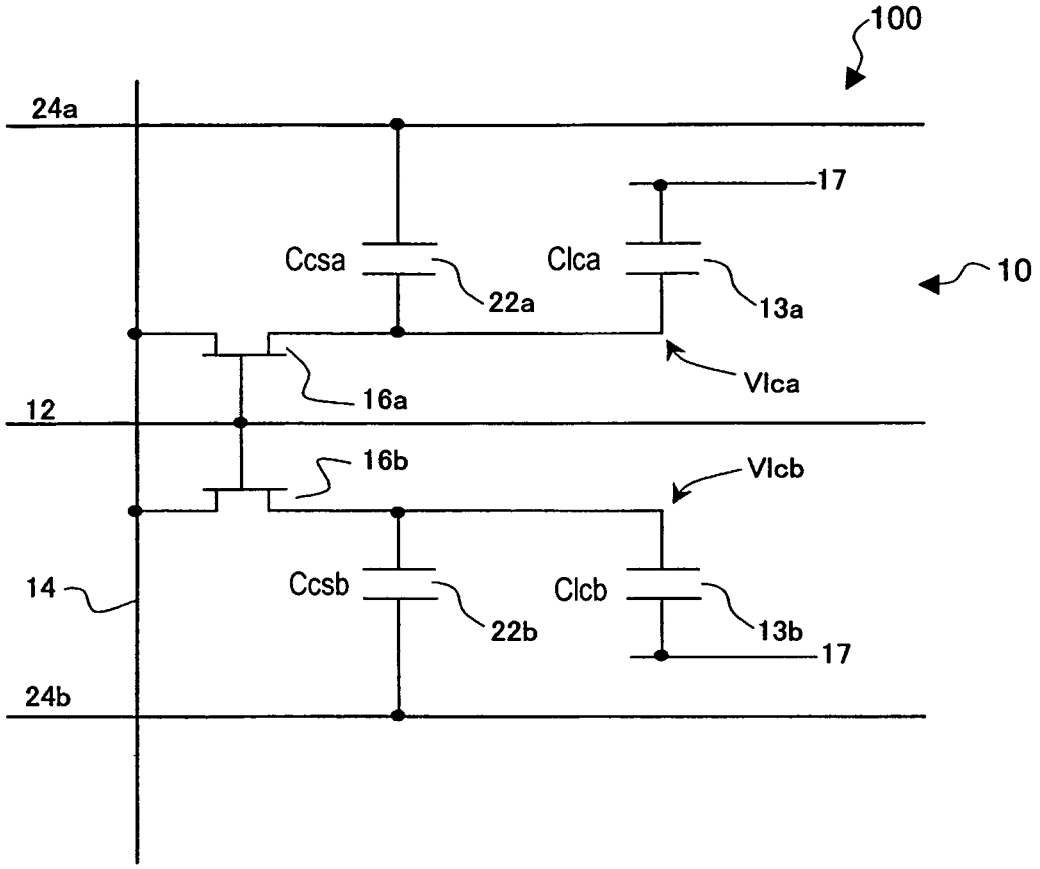
FIG. 8 is an equivalent circuit diagram of a single pixel in the liquid crystal display device of the first preferred embodiment.

FIG. 8 schematically shows the equivalent circuit of one pixel 10 of the liquid crystal display device 100. In this electrical equivalent circuit, the liquid crystal layers of the subpixels 10*a* and 10*b* are identified by the reference numerals 13*a* and 13*b*, respectively. A liquid crystal capacitor formed of the subpixel electrode 18*a*, the liquid crystal layer 13*a*, and the counter electrode 17 will be identified by Clca. On the other hand, a liquid crystal capacitor formed of the subpixel electrode 18*b*, the liquid crystal layer 13*b*, and the counter electrode 17 will be identified by Clcb. The same counter electrode 17 is shared by these two subpixels 10*a* and 10*b*. The liquid crystal capacitors Clca and Clcb are supposed to have the same electrostatic capacitance CLC (V). The value of CLC (V) depends on the effective voltages (V) applied to the liquid crystal layers of the respective subpixels 10*a* and 10*b*. Also, the storage capacitors 22*a* and 22*b* that are connected independently of each other to the liquid crystal capacitors of the respective subpixels 10*a* and 10*b* will be identified herein by Ccsa and Ccsb, respectively, which are supposed to have the same electrostatic capacitance CCS.

In the subpixel 10*a*, one electrode of the liquid crystal capacitor Clca and one electrode of the storage capacitor Ccsa are connected to the drain electrode of the TFT 16*a*, which functions as a switching element for the subpixel 10*a*. The other electrode of the liquid crystal capacitor Clca is connected to the counter electrode 17. And the other electrode of the storage capacitor Ccsa is connected to the storage capacitor line 24*a*. In the subpixel 10*b*, one electrode of the liquid crystal capacitor Clcb and one electrode of the storage capacitor Ccsb are connected to the drain electrode of the TFT 16*b*, which functions as a switching element for the subpixel 10*b*. The other electrode of the liquid crystal capacitor Clcb is connected to the counter electrode 17. And the other electrode of the storage capacitor Ccsb is connected to the storage capacitor line 24*b*. The gate electrodes of the TFTs 16*a* and 16*b* are both connected to the scan line 12 and the source electrodes thereof are both connected to the signal line 14.

Figure 9:
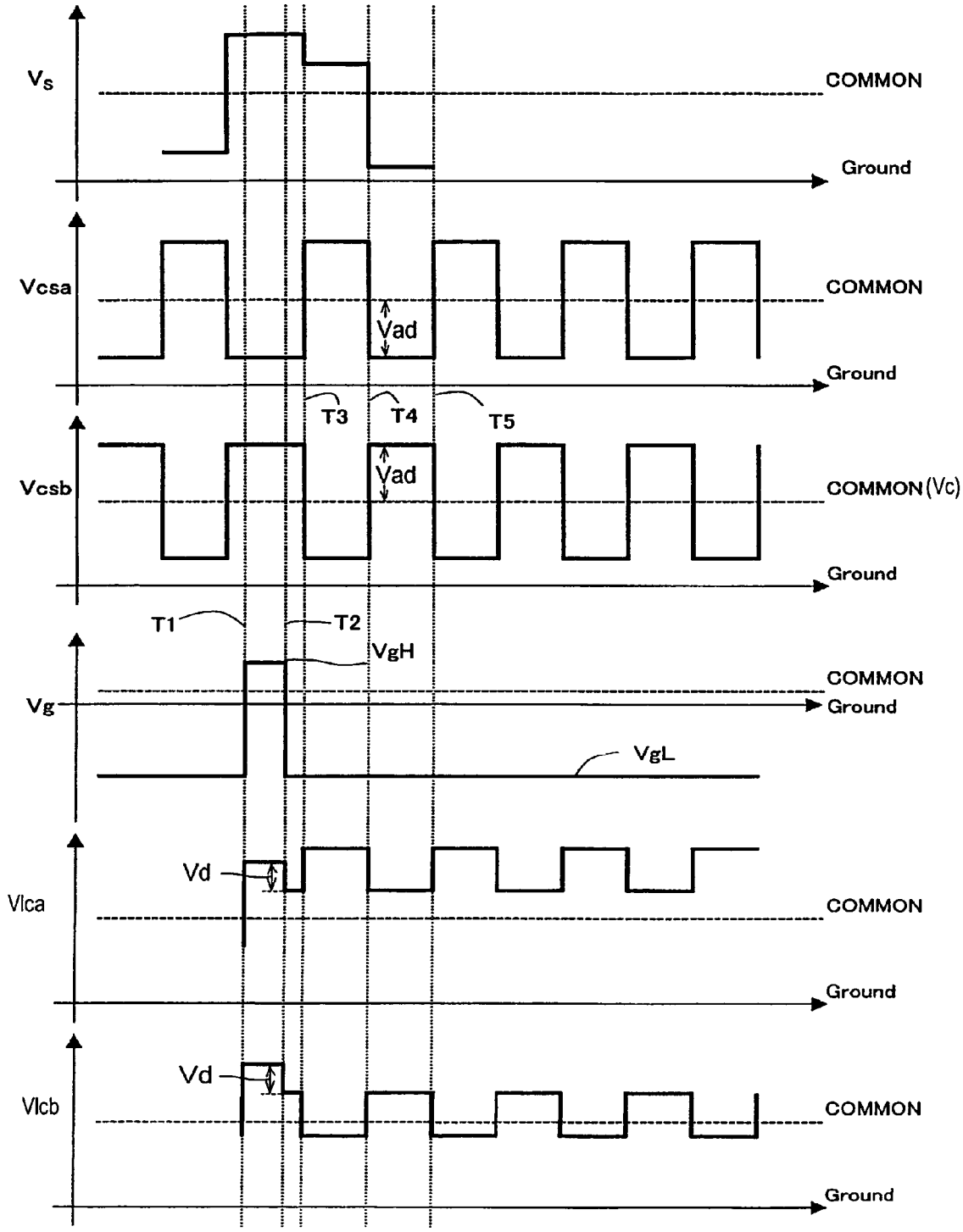
FIG. 9 shows exemplary waveforms of voltages that are applied to drive the liquid crystal display device of the first preferred embodiment.

FIG. 9 schematically shows how the respective voltages that are applied to drive the liquid crystal display device 100 of this preferred embodiment vary within a vertical scanning period. Specifically, in FIG. 9, Vs represents the voltage on the signal line 14; Vcsa represents the voltage on the storage capacitor line 24*a*; Vcsb represents the voltage on the storage capacitor line 24*b*; Vg represents the voltage on the scan line 12; Vlca represents the voltage to the first subpixel electrode 18*a*; and Vlcb represents the voltage to the second subpixel electrode 18*b*. In FIG. 9, the dashed line indicates the voltage COMMON (Vc) to the counter electrode 17. The voltage Vcsa on the storage capacitor line 24*a* varies periodically within the range of Vc−Vad to Vc+Vad. Likewise, the voltage Vcsb on the storage capacitor line 24*b* also varies periodically within the range of Vc−Vad to Vc+Vad. The waveform of the voltage Vcsb on the storage capacitor line 24*b* has a phase that is different by 180 degrees from that of the voltage Vcsa on the storage capacitor line 24*a*.

Hereinafter, it will be described with reference to FIG. 9 how the equivalent circuit shown in FIG. 8 operates.

First, at a time T1, the voltage Vg on the scan line 12 rises from VgL to VgH to turn the TFTs 16*a* and 16*b* ON simultaneously. As a result, the voltage Vs on the signal line 14 is transmitted to the subpixel electrodes 18*a* and 18*b* of the subpixels 10*a* and 10*b* to charge the liquid crystal capacitors Clca and Clcb of the subpixels 10*a* and 10*b*. In the same way, the storage capacitors Csa and Csb of the respective subpixels are also charged with the voltage on the signal line 14.

Next, at a time T2, the voltage Vg on the scan line 12 falls from VgH to VgL to turn the TFTs 16*a* and 16*b* OFF simultaneously and electrically isolate the liquid crystal capacitors Clca and Clcb of the subpixels 10*a* and 10*b* and the storage capacitors Ccsa and Ccsb from the signal line 14. It should be noted that immediately after that, due to the feedthrough phenomenon caused by a parasitic capacitance of the TFTs 16*a* and 16*b*, for example, the voltages Vlca and Vlcb applied to the first and second subpixel electrodes 18*a* and 18*b* decrease by approximately the same voltage Vd to:

$$Vlca=Vs-Vd$$

$$Vlcb=Vs-Vd$$

respectively. Also, in this case, the voltages Vcsa and Vcsb on the storage capacitor lines are:

$$Vcsa=Vc-Vad$$

$$Vcsb=Vc+Vad$$

respectively.

Next, at a time T3, the voltage Vcsa on the storage capacitor line 24*a* connected to the storage capacitor Ccsa rises from Vc−Vad to Vc+Vad and the voltage Vcsb on the storage capacitor line 24*b* connected to the storage capacitor Ccsb falls from Vc+Vad to Vc−Vad. That is to say, these voltages Vcsa and Vcsb both change twice as much as Vad. As the voltages on the storage capacitor lines 24*a* and 24*b* change in this manner, the voltages Vlca and Vlcb applied to the first and second subpixel electrodes change into:

$$Vlca=Vs-Vd+2\times K\times Vad$$

$$Vlcb=Vs-Vd-2\times K\times Vad$$

respectively, where K=CCS/(CLC(V)+CCS).

Next, at a time T4, the voltage Vcsa on the storage capacitor line 24*a* falls from Vc+Vad to Vc−Vad and the voltage Vcsb on the storage capacitor line 24*b* rises from Vc−Vad to Vc+Vad. That is to say, these voltages Vcsa and Vcsb both change twice as much as Vad again. In this case, the voltages Vlca and Vlcb applied to the first and second subpixel electrodes also change from $$Vlca=Vs-Vd+2\times K\times Vad$$

$$Vlcb=Vs-Vd-2\times K\times Vad$$

into $$Vlca=Vs-Vd$$

$$Vlcb=Vs-Vd$$

respectively.

Next, at a time T5, the voltage Vcsa on the storage capacitor line 24*a* rises from Vc−Vad to Vc+Vad and the voltage Vcsb on the storage capacitor line 24*b* falls from Vc+Vad to Vc−Vad. That is to say, these voltages Vcsa and Vcsb both change twice as much as Vad again. In this case, the voltages Vlca and Vlcb applied to the first and second subpixel electrodes also change from $$Vlca=Vs-Vd$$

$$Vlcb=Vs-Vd$$

into $$Vlca=Vs-Vd+2\times K\times Vad$$

$$Vlcb=Vs-Vd-2\times K\times Vad$$

respectively.

After that, every time a period of time that is an integral number of times as long as one horizontal scanning period 1H has passed, the voltages Vcsa, Vcsb, Vlca and Vlcb alternate their levels at the times T4 and T5. The alternation interval between T4 and T5 may be appropriately determined to be one, two, three or more times as long as 1H according to the driving method of the liquid crystal display device (such as the polarity inversion method) or the display state (such as the degree of flicker or non-smoothness of the image displayed). This alternation is continued until the pixel 10 is rewritten next time, i.e., until the current time becomes equivalent to T1. Consequently, the average voltages Vlca and Vlcb applied to the first and second subpixel electrodes become:

$$Vlca=Vs-Vd+K\times Vad$$

$$Vlcb=Vs-Vd-K\times Vad$$

respectively.

Therefore, the effective voltages V1 (=VLspa) and V2 (=VLspb) applied to the liquid crystal layers 13*a* and 13*b* of the subpixels 10*a* and 10*b* become the difference between the voltage at the first subpixel electrode 18*a* and the voltage at the counter electrode 17 and the difference between the voltage at the second subpixel electrode 18*b* and the voltage at the counter electrode 17. That is to say, $$V1=VLspa=Vlca-Vcom$$

$$V2=VLspb=Vlcb-Vcom$$

That is to say, $$V1=Vs-Vd+K\times Vad-Vc$$

$$V2=Vs-Vd-K\times Vad-Vc$$

respectively. As a result, the difference ΔV (=V1−V2) between the effective voltages applied to the liquid crystal layers 13*a* and 13*b* of the subpixels 10*a* and 10*b* becomes ΔV=2×K×Vad (where K=CCS/(CLC(V)+CCS)). Thus, mutually different voltages can be applied to the liquid crystal layers 13*a* and 13*b*.

Figure 10:
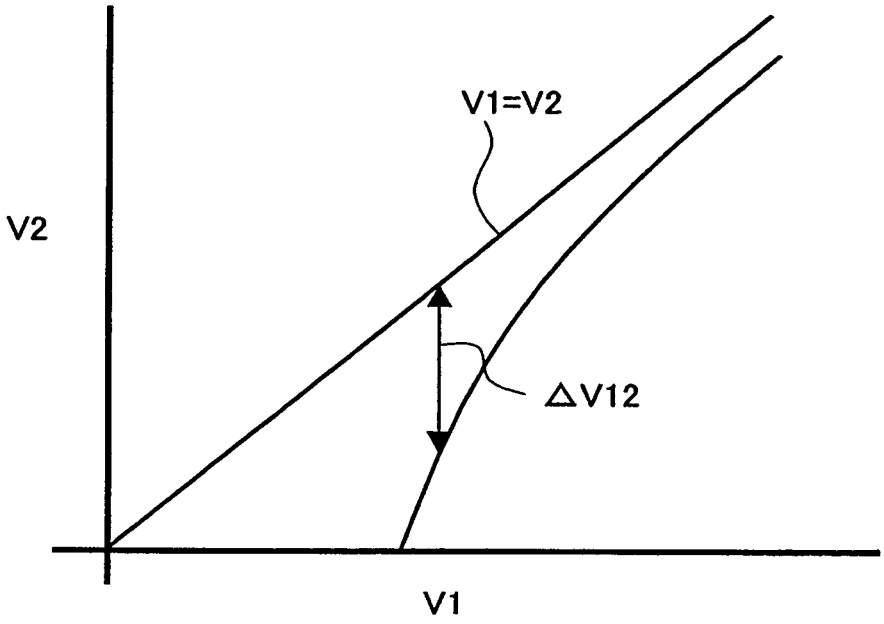
FIG. 10 shows a relation between the effective voltages applied to the respective liquid crystal layers of subpixels in the liquid crystal display device of the first preferred embodiment.

FIG. 10 schematically shows the relation between V1 and V2 in the liquid crystal display device 100 of this preferred embodiment. As can be seen from FIG. 10, the smaller the V1 value, the bigger ΔV in the liquid crystal display device 100 of this preferred embodiment. The ΔV value varies with V1 or V2 because the static capacitance CLC(V) of the liquid crystal capacitor varies with the voltage.

Figure 11:
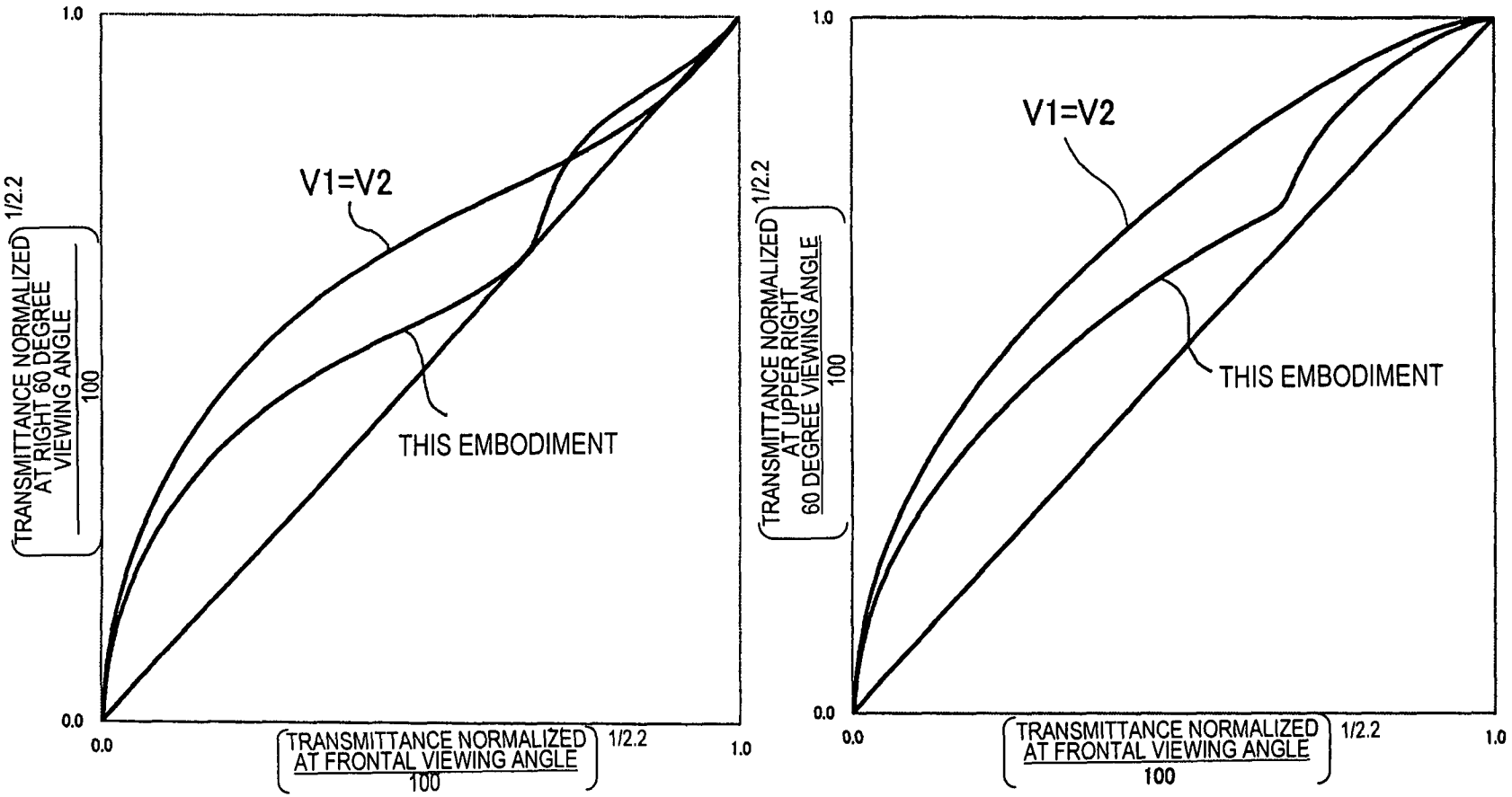
FIGS. 11(*a*) and 11(*b*) show the $\gamma$ characteristics of the liquid crystal display device of the first preferred embodiment at a right 60 degree viewing angle and at an upper right 60 degree viewing angle, respectively.

FIG. 11(*a*) shows the γ characteristic of the liquid crystal display device 100 of this preferred embodiment at a right 60 degree viewing angle, and FIG. 11(*b*) shows the γ characteristic of the liquid crystal display device 100 of this preferred embodiment at an upper right 60 degree viewing angle. FIGS. 11(*a*) and 11(*b*) also show the γ characteristics that were observed when the same voltage was applied to the subpixels 10*a* and 10*b* for the purpose of comparison. As can be seen from FIGS. 11(*a*) and 11(*b*), the grayscale characteristic of the liquid crystal display device 100 of this preferred embodiment is closer to the grayscale characteristic in the frontal viewing direction in which the ordinate is equal to the abscissa (and in which γ=2.2) than the situation where the same voltage was applied to the two subpixel electrodes. That is to say, the γ characteristic is improved by this preferred embodiment. As described above, by varying the respective voltages as shown in FIG. 9 within a single vertical scanning period, mutually different effective voltages are applicable to the respective liquid crystal layers of different subpixels, and the γ characteristic in an oblique viewing direction is improved as a result.

Hereinafter, it will be described with reference to FIG. 12 how the voltage applied to the single pixel 10 that has already been described with reference to FIGS. 7 and 8 changes through a number of vertical scanning periods.

Figure 12:
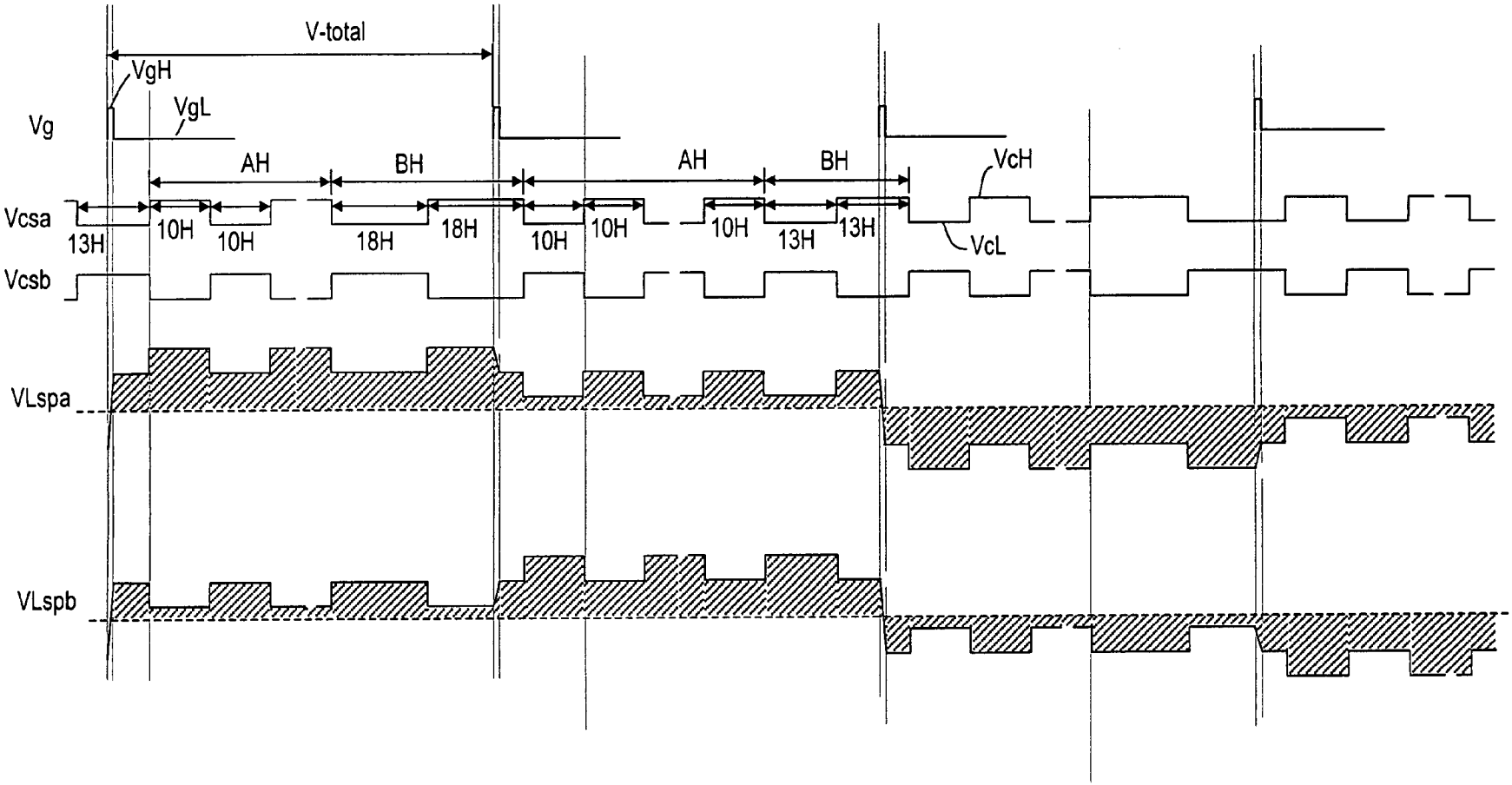
FIG. 12 shows exemplary waveforms of various voltages to be applied over a number of vertical scanning periods to the liquid crystal display device of the first preferred embodiment.

In FIG. 12, Vg represents the voltage on the scan line 12, Vcsa and Vcsb represent the voltages on the first and second storage capacitor lines 24*a* and 24*b*, respectively, and VLspa and VLspb represent the effective voltages applied to the respective liquid crystal layers 13*a* and 13*b* of the first and second subpixel electrodes 10*a* and 10*b*. As described above, one vertical scanning period is an interval between a point in time when a scan line is selected and a point in time when the next scan line is selected, and is represented by V-Total in FIG. 12. It should be noted that the variation in the voltage Vd caused by the feedthrough phenomenon that has already been described with reference to FIG. 9 is not shown in FIG. 12.

Also, the voltages Vcsa and Vcsb on the first and second storage capacitor lines each have display periods AH and regulation periods BH. Each of these voltages Vcsa and Vcsb on the first and second storage capacitor lines varies periodically in different cycles through the display and regulation periods AH and BH. In this example, the voltages Vcsa and Vcsb vary in regular cycles of 20H through the display periods AH and in different regular cycles of either 36H or 26H through the regulation periods BH. The sum of one display period AH and one regulation period BH is equal to one vertical scanning period (V-Total). Furthermore, in this example, the display period AH begins when the voltages Vcsa and Vcsb on the first and second storage capacitor lines change after a vertical scanning period for a certain frame has started. On the other hand, the regulation period BH ends when the voltages Vcsa and Vcsb on the first and second storage capacitor lines change after the vertical scanning period for that frame has terminated. In this preferred embodiment, the frame frequency may be 60 Hz, for example.

FIG. 12 shows how the voltages change through four vertical scanning periods. In the following description, those four vertical scanning periods will be referred to herein as first, second, third and fourth vertical scanning periods, respectively, and the display periods AH and regulation periods BH associated with those vertical scanning periods will be referred to herein as first, second, third and fourth display periods AH and first, second, third and fourth regulation periods BH, respectively. Also, in this example, when the voltage Vcsa on the storage capacitor line 24*a* rises to a higher voltage VcH, the voltage Vcsb on the storage capacitor line 24*b* falls to a lower voltage VcL. Conversely, when Vcsa falls to a lower voltage VcL, Vcsb rises to a higher voltage VcH. The difference between VcH and VcL is equal to 2×Vad that has already been described with reference to FIG. 9.

At a time when the voltage Vcsa on the first storage capacitor line 24*a* is VcL and when the voltage Vcsb on the second storage capacitor line 24*b* is VcH, the voltage Vg on the scan line 12 changes from VgL into VgH. In response to the change of the voltage Vg into VgH, the first vertical scanning period begins and the first and second subpixel electrodes 18*a* and 18*b* are charged. While the voltage Vg on the scan line 12 is VgH, the voltage Vs on the signal line 14 is higher than the voltage Vc at the counter electrode 17. That is why as a result of the charge, the voltages at the first and second subpixel electrodes 18*a* and 18*b* become higher than the voltage Vc at the counter electrode 17. Thereafter, when the voltage Vg on the scan line 12 falls from VgH to VgL again, the first and second subpixel electrodes 18*a* and 18*b* finish being charged.

After that, the voltage Vcsa on the first storage capacitor line 24*a* rises to VcH and the voltage Vcsb on the second storage capacitor line 24*b* falls to VcL. In this example, it is when the voltage Vcsa on the first storage capacitor line 24*a* increases and the voltage Vcsb on the second storage capacitor line 24*b* decreases that the first display period AH begins. Through the first display period AH, the voltages Vcsa and Vcsb on the first and second storage capacitor lines 24*a* and 24*b* increase or decrease every 10H period and vary periodically in regular cycles of 20H. When the first display period AH ends, the first regulation period BH begins. Through the first regulation period BH, the voltages Vcsa and Vcsb on the first and second storage capacitor lines 24*a* and 24*b* increase or decrease every 18H period. The voltages at the first and second subpixel electrodes 18*a* and 18*b* change as the voltages Vcsa and Vcsb on the first and second storage capacitor lines 24*a* and 24*b* vary. That is why in the first vertical scanning period, the absolute value of the effective voltage applied to the liquid crystal layer 13*a* of the first subpixel 10*a* becomes greater than that of the effective voltage applied to the liquid crystal layer 13*b* of the second subpixel 10*b* and the first subpixel 10*a* becomes brighter than the second subpixel 10*b*.

In the first regulation period BH, at a time when the voltage Vcsa on the first storage capacitor line 24*a* is VcH and when the voltage Vcsb on the second storage capacitor line 24*b* is VcL, the voltage Vg on the scan line 12 changes from VgL into VgH. In response to the change of the voltage Vg into VgH, the first vertical scanning period ends and the second vertical scanning period begins and the first and second subpixel electrodes 18*a* and 18*b* are charged. While the voltage Vg on the scan line 12 is VgH, the voltage Vs on the signal line 14 is higher than the voltage Vc at the counter electrode 17. That is why as a result of the charge, the voltages at the first and second subpixel electrodes 18*a* and 18*b* become higher than the voltage Vc at the counter electrode 17. Thereafter, when the voltage Vg on the scan line 12 falls from VgH to VgL again, the first and second subpixel electrodes 18*a* and 18*b* finish being charged.

After that, the voltage Vcsa on the first storage capacitor line 24*a* falls to VcL and the voltage Vcsb on the second storage capacitor line 24*b* rises to VcH. In this example, it is when the voltage Vcsa on the first storage capacitor line 24*a* decreases and the voltage Vcsb on the second storage capacitor line 24*b* increases that the first regulation period ends and the second display period AH begins. Through the second display period AH, the voltages Vcsa and Vcsb on the first and second storage capacitor lines 24*a* and 24*b* also increase or decrease every 10H period and vary periodically in regular cycles of 20H. And through the second regulation period BH, the voltages Vcsa and Vcsb on the first and second storage capacitor lines 24*a* and 24*b* will increase or decrease every 13H period. The voltages at the first and second subpixel electrodes 18*a* and 18*b* change as the voltages Vcsa and Vcsb on the first and second storage capacitor lines 24*a* and 24*b* vary. That is why in the second vertical scanning period, the absolute value of the effective voltage applied to the liquid crystal layer 13*b* of the second subpixel 10*b* becomes greater than that of the effective voltage applied to the liquid crystal layer 13*a* of the first subpixel 10*a* and the second subpixel 10*b* becomes brighter than the first subpixel 10*a*.

Next, in the second regulation period BH, at a time when the voltage Vcsa on the first storage capacitor line 24*a* is VcH and when the voltage Vcsb on the second storage capacitor line 24*b* is VcL, the voltage Vg on the scan line 12 changes from VgL into VgH. In response to the change of the voltage Vg into VgH, the second vertical scanning period ends and the third vertical scanning period begins and the first and second subpixel electrodes 18*a* and 18*b* are charged. While the voltage Vg on the scan line 12 is VgH, the voltage Vs on the signal line 14 is lower than the voltage Vc at the counter electrode 17. That is why as a result of the charge, the voltages at the first and second subpixel electrodes 18*a* and 18*b* become lower than the voltage Vc at the counter electrode 17. Thereafter, when the voltage Vg on the scan line 12 falls from VgH to VgL again, the first and second subpixel electrodes 18*a* and 18*b* finish being charged.

After that, the voltage Vcsa on the first storage capacitor line 24*a* falls to VcL and the voltage Vcsb on the second storage capacitor line 24*b* rises to VcH. In this example, it is when the voltage Vcsa on the first storage capacitor line 24*a* decreases and the voltage Vcsb on the second storage capacitor line 24*b* increases that the second regulation period BH ends and the third display period AH begins. Through the third display period AH, the voltages Vcsa and Vcsb on the first and second storage capacitor lines 24*a* and 24*b* also increase or decrease every 10H period and vary periodically in regular cycles of 20H. And through the third regulation period BH, the voltages Vcsa and Vcsb on the first and second storage capacitor lines 24*a* and 24*b* will increase or decrease every 18H period. The voltages at the first and second subpixel electrodes 18*a* and 18*b* change as the voltages Vcsa and Vcsb on the first and second storage capacitor lines 24*a* and 24*b* vary. That is why in the third vertical scanning period, the absolute value of the effective voltage applied to the liquid crystal layer 13*a* of the first subpixel 10*a* becomes greater than that of the effective voltage applied to the liquid crystal layer 13*b* of the second subpixel 10*b* and the first subpixel 10*a* becomes brighter than the second subpixel 10*b*.

Next, in the third regulation period BH, at a time when the voltage Vcsa on the first storage capacitor line 24*a* is VcL and when the voltage Vcsb on the second storage capacitor line 24*b* is VcH, the voltage Vg on the scan line 12 changes from VgL into VgH. In response to the change of the voltage Vg into VgH, the third vertical scanning period ends and the fourth vertical scanning period begins and the first and second subpixel electrodes 18*a* and 18*b* are charged. While the voltage Vg on the scan line 12 is VgH, the voltage Vs on the signal line 14 is lower than the voltage Vc at the counter electrode 17. That is why as a result of the charge, the voltages at the first and second subpixel electrodes 18*a* and 18*b* become lower than the voltage Vc at the counter electrode 17. Thereafter, when the voltage Vg on the scan line 12 falls from VgH to VgL again, the first and second subpixel electrodes 18*a* and 18*b* finish being charged.

After that, the voltage Vcsa on the first storage capacitor line 24*a* rises to VcH and the voltage Vcsb on the second storage capacitor line 24*b* falls to VcL. In this example, it is when the voltage Vcsa on the first storage capacitor line 24*a* increases and the voltage Vcsb on the second storage capacitor line 24*b* decreases that the third regulation period BH ends and the fourth display period AH begins. Through the fourth display period AH, the voltages Vcsa and Vcsb on the first and second storage capacitor lines 24*a* and 24*b* also increase or decrease every 10H period and vary periodically in regular cycles of 20H. And through the fourth regulation period BH, the voltages Vcsa and Vcsb on the first and second storage capacitor lines 24*a* and 24*b* will increase or decrease every 13H period. The voltages at the first and second subpixel electrodes 18*a* and 18*b* change as the voltages Vcsa and Vcsb on the first and second storage capacitor lines 24*a* and 24*b* vary. That is why in the fourth vertical scanning period, the absolute value of the effective voltage applied to the liquid crystal layer 13*b* of the second subpixel 10*b* becomes greater than that of the effective voltage applied to the liquid crystal layer 13*a* of the first subpixel 10*a* and the second subpixel 10*b* becomes brighter than the first subpixel 10*a*. From the fifth vertical scanning period on, the respective voltages will vary in quite the same way as in the first through fourth vertical scanning periods shown in FIG. 12.

As described above, the (brightness, polarity) combination of the first subpixel changes in the order of (B, +), (D, +), (B, −) and (D, −), while the (brightness, polarity) combination of the second subpixel changes in the order of (D, +), (B, +), (D, −) and (B, −). That is to say, the brightness levels and polarities of the first and second subpixels change just as shown in portion (*a*) of FIG. 6. By changing the voltages Vcsa and Vcsb on the first and second storage capacitor lines in this manner, the deterioration of display quality can be minimized in a liquid crystal display device, of which the γ characteristic has reduced viewing angle dependence.

As described above, the liquid crystal display device of this preferred embodiment is designed such that the potentials at the pixel electrode and at the counter electrode switch their levels at regular intervals and that the direction of the electric field applied to the liquid crystal layer is also inverted at regular intervals. In this case, in a typical liquid crystal display device including a counter electrode and pixel electrodes on two different substrates, the directions of the electric field applied to the liquid crystal layer change from toward the light source side into toward the viewer side, and vice versa. Such a drive method that sets an alternating current voltage is called an "AC drive method". In the liquid crystal display device of this preferred embodiment, the inversion interval of the direction of the electric field applied to the liquid crystal layer may be 66.667 ms, which is twice as long as two frame periods of 33.333 ms, for example. That is to say, in the liquid crystal display device of this preferred embodiment, the direction of the electric field applied to the liquid crystal layer is inverted every time two frame pictures are presented. That is why in presenting a still picture, unless the electric field strengths (i.e., the magnitudes of applied voltages) exactly matched with each other in respective electric field directions (i.e., if the electric field intensities changed every time the directions of the electric field change), the pixel luminances would change and a flicker would be produced on the screen whenever the electric field intensities change.

To eliminate such a flicker, the electric field intensities (or the magnitudes of applied voltages) in the respective electric field directions need to be exactly matched with each other. In liquid crystal display devices that are manufactured on an industrial basis, however, it is difficult to exactly match the electric field intensities with each other in respective electric field directions. That is why the flicker is reduced by arranging pixels with mutually different electric field directions adjacent to each other within a display area and spatially averaging the luminances of those pixels. Such a method is generally called either a "dot inversion" or a "line inversion". It should be noted that there are various "inversion drive" methods that include not just a method in which the polarities of those pixels are inverted in a checkered pattern on a pixel-by-pixel basis (i.e., the polarities are inverted both every row and every column, which is a so-called "dot inversion drive") and a method in which the polarities are inverted on a line-by-line basis (i.e., the polarities are inverted every row, which is a so-called "line inversion drive") but also a method in which the polarities are inverted every other row and every column (which is a so-called "two-row, one-column dot inversion drive"). And an appropriate one of those methods is selected as needed.

In view of these considerations, to avoid the flicker, the following three conditions are preferably satisfied:

First of all, in respective electric field directions (and in both of the two polarities of respective applied voltages), the absolute values of the effective voltages applied to the liquid crystal layer should agree with each other as closely as possible. That is to say, as in resolving the reliability-related problem described above, the average of the voltages applied to the liquid crystal layer should be as close to zero as possible.

Secondly, pixels, among which the electric field is applied to the liquid crystal layer in respectively different directions in each frame period, should be arranged adjacent to each other.

And a third condition is that one type of subpixels that are brighter than subpixels of the other type be arranged as randomly as possible within the same frame. To achieve the maximum display effect on the screen, those subpixels are preferably arranged such that the one type of subpixels, which are brighter than the subpixels of the other type, are adjacent to each other in neither the column direction nor the row direction. In other words, the one type of subpixels that are brighter than the other type are preferably arranged in a checkered pattern.

Hereinafter, it will be described how and why the liquid crystal display device of this preferred embodiment satisfies these three conditions. But before describing exactly how the device satisfies those conditions, it will be described with reference to FIGS. 13 and 14 that the liquid crystal display device 100 of this preferred embodiment has a pixel arrangement that can be used effectively to get the one-dot inversion drive done with those conditions satisfied.

Figure 13:
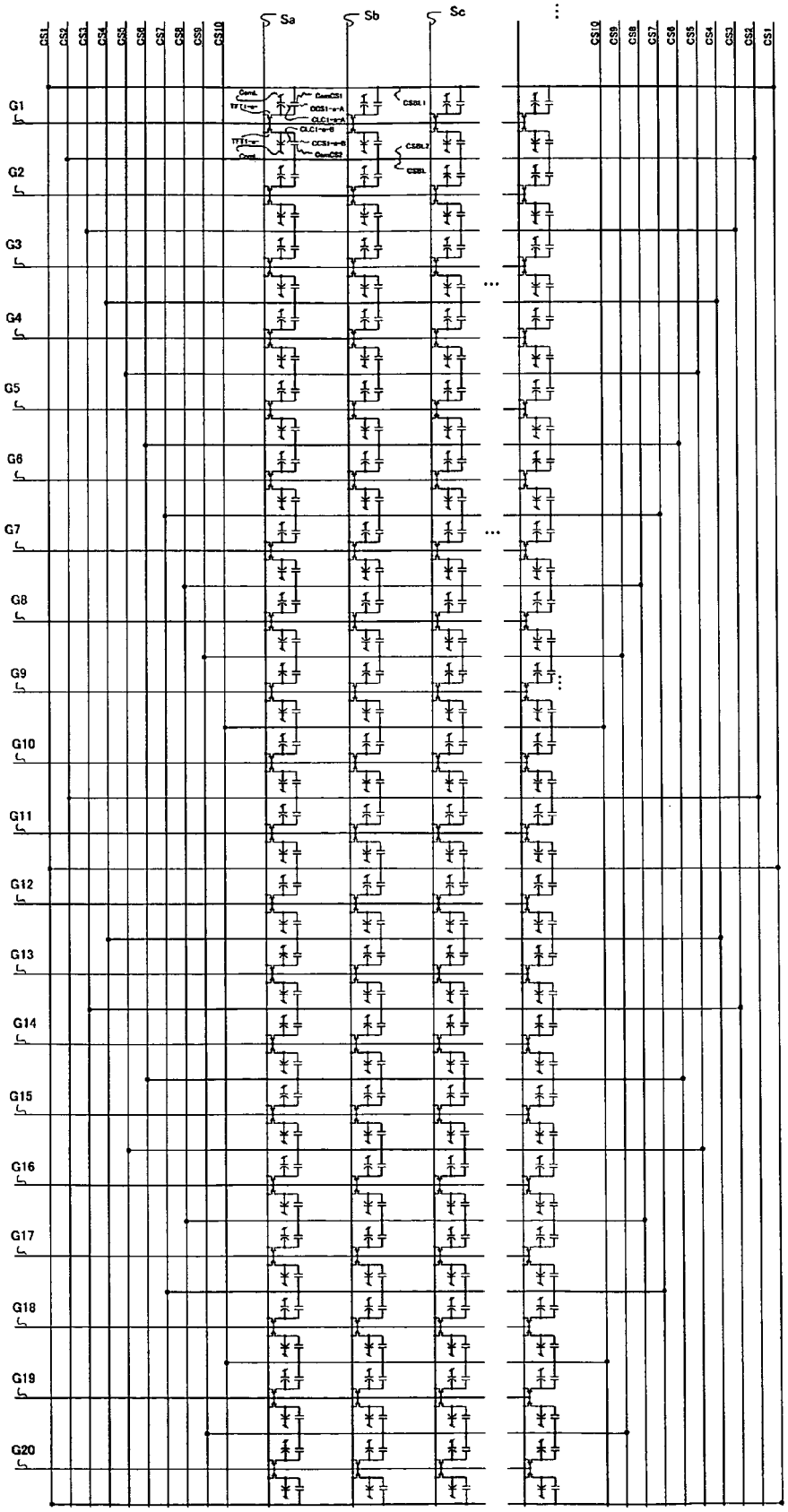
FIG. 13 shows an exemplary equivalent circuit diagram of the liquid crystal display device of the first preferred embodiment.

FIG. 13 illustrates an equivalent circuit of the liquid crystal display device 100. In FIG. 13, each pixel is supposed to have the structure shown in FIGS. 7 and 8. Those pixels are arranged in a matrix pattern. In the following description, a pixel located at an $n^{th}$ row and an $m^{th}$ column will be referred to herein as "pixel n-m" and the two subpixels that form the pixel n-m will be referred to herein as "subpixel n-m-A" and "subpixel n-m-B", respectively.

The liquid crystal display device 100 includes ten storage capacitor trunks CS1 through CS10, and each subpixel is connected to one of those storage capacitor trunks CS1 through CS10 by way of a storage capacitor line (CS bus line). For example, the storage capacitor trunk CS2 is connected to subpixels 1-*a*-B, 1-*b*-B, 1-*c*-B, etc. on the first pixel row and to subpixels 2-*a*-A, 2-*b*-A, 2-*c*-A, etc. on the second pixel row. In this configuration, each subpixel and another subpixel included in a different pixel that is adjacent to the former subpixel are connected to the same storage capacitor trunk by way of the same storage capacitor line.

Hereinafter, the configurations of first and second subpixels 1-*a*-A and 1-*a*-B included in a pixel 1-*a* that is specified by a scan line G1 and a signal line Sa will be described. The first and second subpixels 1-*a*-A and 1-*a*-B include liquid crystal capacitors CLC1-*a*-A and CLC1-*a*-B and storage capacitors CCS1-*a*-A and CCS1-*a*-B, respectively. Each of the liquid crystal capacitors is formed by a subpixel electrode, the counter electrode ComLC and the liquid crystal layer interposed between them. Each of the storage capacitors is formed by a storage capacitor electrode, an insulating film and a storage capacitor counter electrode ComCS1 or ComCS2.

The first and second subpixels 1-*a*-A and 1-*a*-B are connected in common to the same signal line Sa by way of their associated TFTs 1-*a*-A and 1-*a*-B, respectively. The TFTs 1-*a*-A and 1-*a*-B have their ON/OFF states controlled with a voltage supplied onto their common signal line G1. And when these two TFTs are ON, voltages are applied through the same signal line Sa to the respective subpixel electrodes and respective storage capacitor electrodes of the first and second subpixels 1-*a*-A and 1-*a*-B. The storage capacitor counter electrode of the subpixel 1-*a*-A is connected to the storage capacitor trunk CS1 by way of its associated storage capacitor line (CS bus line) CS1. Meanwhile, the storage capacitor counter electrode of the subpixel 1-*a*-B is connected to the storage capacitor trunk CS2 by way of its associated storage capacitor line (CS bus line) CS2. In this manner, the configuration shown in FIG. 13, either a single storage capacitor line or a single scan line is shared by two subpixels, thus increasing the aperture ratio of each pixel, which is beneficial.

Figure 15:
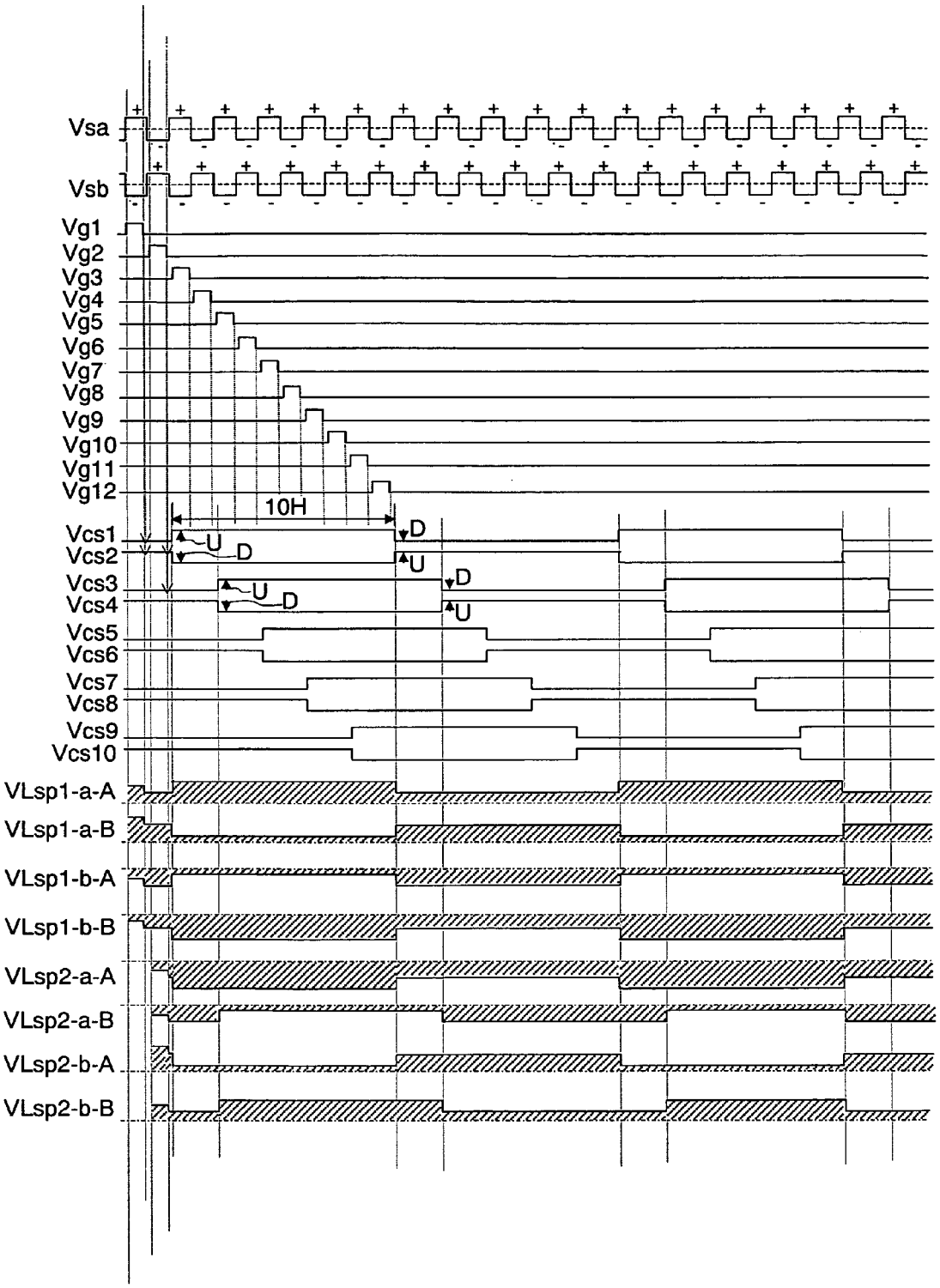
FIG. 15 shows exemplary waveforms of various voltages to be applied to the liquid crystal display device of the first preferred embodiment.

FIG. 14 shows the brightness levels and polarities of respective subpixels that have changed within the effective scanning period of a certain frame. Specifically, in FIG. 14, illustrated are pixels on the first through twelfth rows and the $a^{th}$ through $f^{th}$ columns. FIG. 15 shows the waveforms of respective voltages (or signals) to drive a liquid crystal display device with the configuration shown in FIG. 13. In FIG. 15, Vsa and Vsb represent the voltages on the signal lines Sa and Sb, Vg1 through Vg12 represent the voltages on the scan lines G1 through G12, Vcs1 through Vcs10 represent the voltages on the storage capacitor trunks CS1 through CS10 and VLsp1-*a*-A through VLsp2-*b*-B represent the effective voltages applied to the liquid crystal layer of associated subpixels, respectively. What is shown in FIG. 15 is voltage waveforms within one vertical scanning period.

The liquid crystal display device with the configuration shown in FIG. 13 is driven with voltages having the waveforms shown in FIG. 15. In the following description, every pixel is supposed to display the same grayscale tone to avoid complicating the description excessively. In a situation where every pixel displays the same grayscale tone, the voltages Vsa and Vsb on the signal lines Sa and Sb oscillate in regular cycles and with a predetermined amplitude as shown in FIG. 15. One cycle time of oscillation of these voltages Vsa and Vsb is two horizontal scanning periods (2H). Specifically, the voltage Vsb on the signal line Sb varies with a phase difference of 180 degrees with respect to the voltage Vsa on the signal line Sa. In FIG. 15, a period in which the voltage Vsa or Vsb is higher than the voltage at the counter electrode is identified by "+" and a period in which the former is lower than the latter is identified by "−". As already described with reference to FIG. 9, in a liquid crystal display device that uses TFTs, a voltage on a signal line is transmitted to a subpixel electrode by way of one of the TFTs and then changes due to a variation in the voltage Vg on a scan line, thus producing a feedthrough phenomenon. The voltage at the counter electrode is determined in view of this feedthrough phenomenon. Also, although not shown in FIG. 15, the voltages on other signal lines Sc and Se also vary in the same way as the voltage Vsa on the signal line Sa and the voltages on other signal lines Sd and Sf also vary in the same way as the voltage Vsb on the signal line Sb. Furthermore, as described above, an interval between a point in time when a voltage Vg on a certain scan line rises from Low level (VgL) to High level (VgH) and a point in time when the voltage Vg on the next scan line rises from VgL to VgH is one horizontal scanning period (1H).

As shown in FIG. 15, the voltages Vcs1 through Vcs10 on the storage capacitor trunks CS1 through CS10 oscillate with the same amplitude and in the same regular cycles. In this example, one oscillation cycle time is 20H. For example, the voltages Vcs1 and Vcs2 have such a relation that if one of these two voltages changes into VcH, the other voltage will change into VcL and that if one of these two voltages changes into VcL, the other voltage will change into VcH. The other four pairs of voltages Vcs3 and Vcs4, Vcs5 and Vcs6, Vcs7 and Vcs8, and Vcs9 and Vcs10 too have the same relation as that pair of voltages Vcs1 and Vcs2. Also, the voltages Vcs3 and Vcs4 change 2H after the voltages Vcs1 and Vcs2 have changed. In the same way, there is a time lag of 2H between the changes of the voltages Vcs5 and Vcs6, the voltages Vcs7 and Vcs8 and the voltages Vcs9 and Vcs10.

When a voltage Vg on a scan line changes from VgL into VgH, the TFTs that are connected to that scan line are turned ON and a voltage Vs on the associated scan line is applied to the subpixels that are connected to those TFTs. Next, after the voltage on the scan line changes into VgL, the voltages on the storage capacitor trunks will vary. And the magnitudes of the changes in voltages on those storage capacitor trunks (including the directions and signs of the changes) are different from each other between the respective subpixels. As a result, the effective voltages applied to the respective liquid crystal layers of those subpixels become different from each other.

Hereinafter, it will be described how the voltages at the subpixels 1-*a*-A and 1-*a*-B change as an example. When the voltage Vg1 on the scan line G1 changes from VgL into VgH, the liquid crystal capacitors CLC1-*a*-A and CLC1-*a*-B of the subpixels 1-*a*-A and 1-*a*-B are charged. If the voltage Vg1 on the scan line G1 is VgH, the voltage Vsa on the signal line Sa is positive "+" and the liquid crystal capacitors CLC1-*a*-A and CLC1-*a*-B of the subpixels 1-*a*-A and 1-*a*-B are charged to a higher potential level than the one at the counter electrode. Thereafter, when the voltage Vg1 on the scan line G1 changes from VgH into VgL, the liquid crystal capacitors CLC1-*a*-A and CLC1-*a*-B of the subpixels 1-*a*-A and 1-*a*-B get electrically isolated from the signal line Sa and finish being charged. After the voltage Vg1 on the scan line G1 has changed from VgH into VgL, the first change of the voltage Vcs1 on the storage capacitor trunk CS1 is increase but the first change of the voltage Vcs2 on the storage capacitor trunk CS2 is decrease. After that, these voltages Vcs1 and Vcs2 will alternately increase and decrease a number of times on a 10H basis. Consequently, in the pixel 1-*a* specified by the scan line G1 and the signal line Sa, the absolute value of the effective voltage applied to the liquid crystal layer of the subpixel 1-*a*-A that is electrically connected to the storage capacitor trunk CS1 becomes greater than that of the effective voltage applied to that of the subpixel 1-*a*-B that is electrically connected to the storage capacitor trunk CS2.

As described above, if the first change in voltage on a storage capacitor trunk associated with a given subpixel is increase after the voltage on its associated scan line has changed from VgH into VgL, the effective voltage applied to the liquid crystal layer of that subpixel becomes higher than the voltage on its associated signal line when the voltage on its associated scan line is VgH. On the other hand, if the first change in voltage on its associated storage capacitor trunk is decrease, the effective voltage applied to the liquid crystal layer of that subpixel becomes lower than the voltage on its associated signal line when the voltage on its associated scan line is VgH. Consequently, if the sign of the voltage on the signal line when the associated scan line is selected is positive "+" and if the variation in the voltage on the storage capacitor trunk is increase, then the absolute value of the effective voltage applied to the liquid crystal layer increases compared to a situation where the voltage variation is decrease. On the other hand, if the sign of the voltage on the signal line when the associated scan line is selected is negative "−" and if the variation in the voltage on the storage capacitor trunk is increase, then the absolute value of the effective voltage applied to the liquid crystal layer decreases compared to a situation where the voltage variation is decrease.

As described above, FIG. 14 shows the brightness levels and polarities of subpixels that have changed during the effective scanning period of a certain frame. In FIG. 14, the sign "B" indicates that the given subpixel is brighter than the other subpixel (i.e., the absolute value of the effective voltage applied to the liquid crystal layer of that subpixel is greater than that of the effective voltage applied to the liquid crystal layer of the other). On the other hand, the sign "D" indicates that the given subpixel is darker than the other subpixel (i.e., the absolute value of the effective voltage applied to the liquid crystal layer of that subpixel is smaller than that of the effective voltage applied to that of the other). In FIG. 14, the sign "+" also indicates that the voltage at the subpixel electrode is higher than the one at the counter electrode and the sign "−" also indicates that the voltage at the subpixel electrode is lower than the one at the counter electrode. Two subpixels included in each pixel are adjacent to a pixel with a smaller row number and a pixel with a bigger row number. In this example, of the two subpixels included in a single pixel, the subpixel adjacent to the pixel with the smaller row number will be identified herein by "A" and the subpixel adjacent to the pixel with the bigger row number will be identified herein by "B".

Hereinafter, the brightness levels and polarities of respective subpixels will be described with reference to FIGS. 14 and 15.

First of all, the brightness levels and polarities of the subpixels 1-*a*-A and 1-*a*-B included in the pixel 1-*a* will be described. As can be seen from FIG. 15, while the voltage Vg1 on the scan line G1 is VgH, the voltage Vsa on the signal line Sa is higher than the voltage at the counter electrode. Therefore, the polarities of the subpixels 1-*a*-A and 1-*a*-B are both positive "+". On the other hand, when the voltage Vg1 on the scan line G1 changes from VgH into VgL, the voltages Vcs1 and Vcs2 on the storage capacitor trunks CS1 and CS2 associated with the respective subpixels are as indicated by the leftmost arrows in FIG. 15. That is why as can be seen from FIG. 15, after the voltage Vg1 on the scan line G1 has changed from VgH into VgL, the first change in the voltage Vcs1 associated with the subpixel 1-*a*-A is increase as indicated by "U" in FIG. 15 and the first change in the voltage Vcs2 on the storage capacitor trunk CS2 associated with the subpixel 1-*a*-B is decrease as indicated by "D" in FIG. 15. Consequently, the effective voltage applied to the subpixel 1-*a*-A increases, the one applied to the subpixel 1-*a*-B decreases, and the subpixel 1-*a*-A becomes brighter than the subpixel 1-*a*-B.

Next, the brightness levels and polarities of subpixels 2-*a*-A and 2-*a*-B included in the pixel 2-*a* will be described. As can be seen from FIG. 15, while the voltage Vg2 on the scan line G2 is VgH, the voltage Vsa on the signal line Sa is lower than the voltage at the counter electrode. Thus, the polarities of the subpixels 2-*a*-A and 2-*a*-B are both negative "−". On the other hand, when the voltage Vg2 on the scan line G2 changes from VgH into VgL, the voltages Vcs2 and Vcs3 on the storage capacitor trunks CS2 and CS3 associated with the respective subpixels 2-*a*-A and 2-*a*-B are as indicated by the second leftmost arrows in FIG. 15. That is why as can be seen from FIG. 15, after the voltage Vg1 on the scan line G1 has changed from VgH into VgL, the first change in the voltage Vcs2 on the storage capacitor trunk CS2 associated with the subpixel 2-*a*-A is decrease as indicated by "D" in FIG. 15 and the first change in the voltage Vcs3 on the storage capacitor trunk CS3 associated with the subpixel 2-*a*-B is increase as indicated by "U" in FIG. 15. Consequently, the effective voltage applied to the subpixel 2-*a*-A increases, the one applied to the subpixel 2-*a*-B decreases, and the subpixel 2-*a*-A becomes brighter than the subpixel 2-*a*-B.

Next, the brightness levels and polarities of subpixels 1-*b*-A and 1-*b*-B included in the pixel 1-*b* will be described. While the voltage Vg1 on the scan line G1 is VgH, the voltage Vsb on the signal line Sb is lower than the voltage at the counter electrode. Thus, the polarities of the subpixels 1-*b*-A and 1-*b*-B are both negative "−". On the other hand, when the voltage Vg1 on the scan line G1 changes from VgH into VgL, the voltages Vcs1 and Vcs2 on the storage capacitor trunks CS1 and CS2 associated with the respective subpixels 1-*b*-A and 1-*b*-B are as indicated by the leftmost arrows in FIG. 15. That is why as can be seen from FIG. 15, after the voltage Vg1 on the scan line G1 has changed from VgH into VgL, the first change in the voltage on the storage capacitor trunk CS1 associated with the subpixel 1-*b*-A is increase as indicated by "U" in FIG. 15 and the first change in the voltage Vcs2 on the storage capacitor trunk CS2 associated with the subpixel 1-*b*-B is decrease as indicated by "D" in FIG. 15. Consequently, the effective voltage applied to the liquid crystal layer of the subpixel 1-*b*-A decreases, the one applied to the subpixel 1-*b*-B increases, and the subpixel 1-*b*-B becomes brighter than the subpixel 1-*b*-A.

Next, the brightness levels and polarities of subpixels 2-*b*-A and 2-*b*-B included in the pixel 2-*b* will be described. As can be seen from FIG. 15, while the voltage Vg2 on the scan line G2 is VgH, the voltage Vsb on the signal line Sb is higher than the voltage at the counter electrode. Thus, the polarities of the subpixels 2-*b*-A and 2-*b*-B are both positive "+". On the other hand, when the voltage Vg2 on the scan line G2 changes from VgH into VgL, the voltages Vcs2 and Vcs3 on the storage capacitor trunks CS2 and CS3 associated with the respective subpixels 2-*b*-A and 2-*b*-B are as indicated by the second leftmost arrows in FIG. 15. That is why as can be seen from FIG. 15, after the voltage Vg1 on the scan line G1 has changed from VgH into VgL, the first change in the voltage Vcs2 on the storage capacitor trunk CS2 associated with the subpixel 2-*b*-A is decrease as indicated by "D" in FIG. 15 and the first change in the voltage Vcs3 on the storage capacitor trunk CS3 associated with the subpixel 2-*b*-B is increase as indicated by "U" in FIG. 15. Consequently, the effective voltage applied to the subpixel 2-*b*-A decreases, the one applied to the subpixel 2-*b*-B increases, and the subpixel 2-*b*-B becomes brighter than the subpixel 2-*b*-A. As a result, the brightness levels and polarities of the respective subpixels become as shown in FIG. 14.

Hereinafter, it will be described how and why the liquid crystal display device of this preferred embodiment satisfies the three conditions mentioned above. First of all, the liquid crystal display device of this preferred embodiment satisfies the first condition for the following reasons.

At first, it will be described that the liquid crystal display device of this preferred embodiment satisfies the first condition, i.e., the absolute values of the effective voltages applied to the liquid crystal layers of respective subpixels agree with each other in respective electric field directions. In the liquid crystal display device of this preferred embodiment, each pixel includes two subpixels, of which the liquid crystal layers are supplied with mutually different effective voltages. However, it is the brighter subpixel (i.e., the subpixel marked "B" in FIG. 14) that will have a decisive effect on the display quality such a flicker on the screen. For that reason, this first condition is imposed on the subpixels marked "B", in particular.

The first condition will be discussed with reference to the respective voltage waveforms shown in FIG. 15, which shows the voltages VLsp1-*a*-A and VLsp2-*a*-A to be applied to the liquid crystal layers of the "B" subpixels 1-*a*-A and 2-*a*-A with mutually different electric field directions (or polarities). In VLsp1-*a*-A and VLsp2-*a*-A shown in FIG. 15, the solid line represents the voltages applied to the subpixel electrodes of the subpixels 1-*a*-A and 2-*a*-A and the dashed line represents the voltage applied to the counter electrode. The effective voltage applied to the liquid crystal layer is a difference between the voltages represented by the solid and dashed lines. That is why if the effective voltages applied to the liquid crystal layer in respective electric field directions (or the quantities of charge stored in the liquid crystal capacitors) are matched with each other as closely as possible by appropriately defining the voltage applied to the counter electrode, the first condition can be satisfied.

Next, it will be described that the liquid crystal display device of this preferred embodiment satisfies the second condition, i.e., pixels with mutually different polarities are arranged adjacent to each other in each frame period. In the liquid crystal display device of this preferred embodiment, however, each pixel includes two subpixels, of which the liquid crystal layers are supplied with different effective voltages. That is why this second condition is imposed on not only on each pixel but also subpixels with the same effective voltage as well. Among other things, it is particularly important for bright subpixels, i.e., the subpixels marked "B" in FIG. 14, to satisfy this second condition as in the first condition described above.

As shown in FIG. 14, the signs "+" and "−" representing the polarities (or electric field directions) of respective subpixels are inverted every other pixel (i.e., every second column) in the row direction (i.e., in the horizontal direction) in the order of (+, −), (+, −), (+, −), and so on, and also inverted every other pixel (i.e., every second row) in the column direction (i.e., in the vertical direction) in the order of (+, −), (+, −), (+, −), (+, −), and so on. That is to say, looking on a pixel-by-pixel basis, this device achieves the so-called "dot inversion" state, and therefore, satisfies the second condition.

Next, the bright subpixels, i.e., the subpixels marked "B" in FIG. 14, will be checked out. As shown in FIG. 14, looking at subpixels on the same row (e.g., the subpixels 1-*a*-A, 1-*b*-A, 1-*c*-A, etc., on the first row), it can be seen that the polarity of every "B" subpixel is positive "+". However, looking at subpixels on the same column (e.g., the subpixels 1-*a*-A, 1-*a*-B, 2-*a*-A, 2-*a*-B, 3-*a*-A, 3-*a*-B, etc., on the first column), it can be seen that the polarities of the "B" subpixels are inverted every other pixel (i.e., every second row) in the order of "+", "−", "+", "−" and so on. That is to say, looking at subpixels with high-order luminances, which are particularly important ones, this device achieve the so-called "line inversion" state, and therefore, satisfies the second condition. Likewise, the "D" subpixels are also arranged with the same regularity, thus satisfying the second condition, too.

Next, it will be described how the device of this preferred embodiment satisfies the third condition. To satisfy the third condition, multiple subpixels, of which the luminance levels are intentionally different from each other, should be arranged such that subpixels with the same luminance level are adjacent to each other at as small a number of locations as possible. In FIG. 14, looking at a total of four subpixels that are arranged on two rows and two columns (e.g., the subpixels 1-*a*-A, 1-*a*-B, 1-*b*-A and 1-*b*-B), it can be seen that "B" and "D" subpixels are arranged in this order along the first column and then "D" and "B" subpixels are arranged in this order along the next column. Supposing these four subpixels form a "group of subpixels", the subpixels are arranged such that the entire screen is filled with such groups of subpixels with no gap left at all. That is to say, the "B" and "D" signs are arranged in a checkered pattern on a subpixel-by-subpixel basis as shown in FIG. 14. Consequently, it can be seen that this device satisfies the third condition, too.

As described above, the liquid crystal display device of this preferred embodiment that has just been described with reference to FIGS. 14 and 15 satisfies all of the three conditions mentioned above, and therefore, realizes a display of quality images with a flicker eliminated.

The brightness levels and polarities of subpixels that have changed within the effective scanning period of a certain frame and the voltage waveforms are shown in FIGS. 14 and 15. In the next frame, however, the voltages on the signal lines change according to the waveforms shown in FIG. 15 with respect to the voltages on the scan lines but the voltages on the storage capacitor trunks change inversely to the waveforms shown in FIG. 15. That is why in that frame, the polarities of the respective subpixels are the same as those of the subpixels shown in FIG. 14 but the brightness levels of the respective subpixels are inverted compared to the counterparts shown in FIG. 14.

In the frame after that next frame, with respect to the voltages on the scan lines, not only the voltages on the signal lines but also the voltages on the storage capacitor trunks change in the patterns opposite to the waveforms shown in FIG. 15. Consequently, in that frame, the brightness levels of the respective subpixels are the same as those of the subpixels shown in FIG. 14 but the polarities of the respective subpixels are inverted compared to the counterparts shown in FIG. 14.

And in the frame next to that frame, with respect to the voltages on the scan lines, the voltages on the signal lines change in the patterns opposite to the waveforms shown in FIG. 15 but the voltages on the storage capacitor trunks change according to the waveforms shown in FIG. 15. Consequently, in that frame, the brightness levels and polarities of the respective subpixels are inverted compared to the counterparts shown in FIG. 14.

Figure 16:
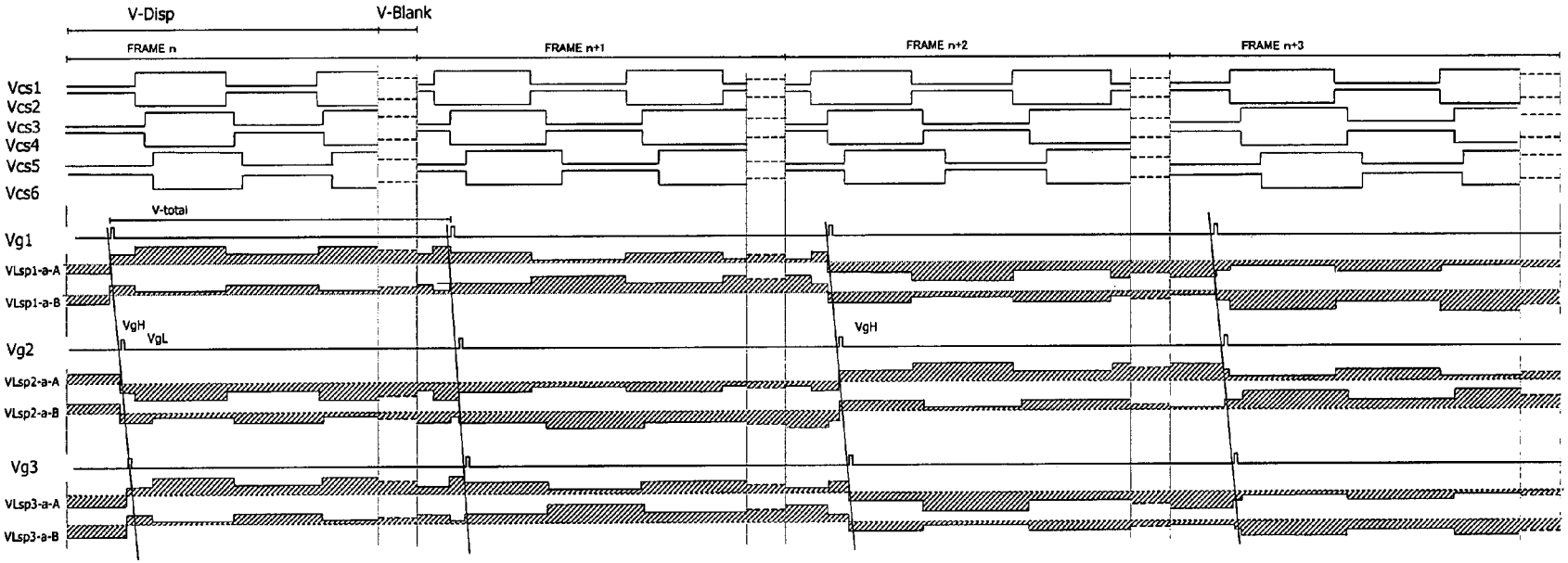
FIG. 16 shows exemplary waveforms of various voltages to be applied over a number of vertical scanning periods to the liquid crystal display device of the first preferred embodiment.

Next, it will be described with reference to FIG. 16 how the voltages change in multiple pixels of the liquid crystal display device of this preferred embodiment. In FIG. 16, Vcs1 through Vcs6 represent the voltages on the storage capacitor trunks CS1 through CS6, Vg1 through Vg3 represent the voltages on the scan lines G1 through G3, and VLsp1-*a*-A through VLsp3-*a*-B represent the effective voltages applied to the respective liquid crystal layers of the subpixels 1-*a*-A through 3-*a*-B. In the following example, the four consecutive frames will be identified herein by n, n+1, n+2 and n+3, respectively.

FIG. 16 also shows vertical scanning periods of an input video signal. Each vertical scanning period of the input video signal consists of an effective scanning period V-Disp during which pixels in the liquid crystal panel 100A (see FIG. 1) are selected on a row-by-row basis and a vertical-blanking interval V-Blank during which no pixels in the liquid crystal panel 100A are selected at all. The duration of the effective scanning period is determined by the display area (or the number of rows of effective pixels) of the liquid crystal panel 100A.

In this description, when simply a "vertical scanning period" is mentioned, the "vertical scanning period" refers to a "vertical scanning period of a liquid crystal panel". That is to say, a "vertical scanning period" (i.e., a "vertical scanning period of the liquid crystal panel") is used herein in a different sense from a "vertical scanning period of an input video signal". A "vertical scanning period of an input video signal" is either a one-frame period or a one-field period, which begins and ends simultaneously for every pixel. On the other hand, a "vertical scanning period" means an interval between a point in time when a scan line is selected to write a display signal voltage and a point in time when that scan line is selected to write the next display signal voltage as described above. The vertical scanning periods start at different timing and end at different timing according to the associated scan line.

In FIG. 16, the oblique lines indicate that the start and end times of a vertical scanning period change according to the row of pixels selected. As can be seen from FIG. 16, within each frame, scan lines are sequentially selected one after another from the first one. And when a scan line is selected, a voltage applied to its associated subpixel electrode changes to start a vertical scanning period for that subpixel. As described above, one vertical scanning period of an input video signal consists of an effective scanning period V-Disp and a vertical-blanking interval V-Blank. However, the vertical scanning period of a certain subpixel begins in the middle of the effective scanning period of a frame n, continues through the vertical-blanking interval, and then ends halfway through the effective scanning period of the next frame n+1. After that, when its associated scan line is selected next time, the next vertical scanning period will begin for that subpixel. It should be noted that in any pixel, the length of the "vertical scanning period" is equal to that of the "vertical scanning period of the input video signal".

As can be seen from FIG. 16, in the frames n to n+3, the (brightness, polarity) combinations of the subpixel 1-*a*-A change in the order of (B, +), (D, +), (B, −), and (D, −); the (brightness, polarity) combinations of the subpixel 1-*a*-B change in the order of (D, +), (B, +), (D, −), and (B, −); the (brightness, polarity) combinations of the subpixel 2-*a*-A change in the order of (B, −), (D, −), (B, +), and (D, +); and the (brightness, polarity) combinations of the subpixel 2-*a*-B change in the order of (D, −), (B, −), (D, +), and (B, +).

Figure 17:
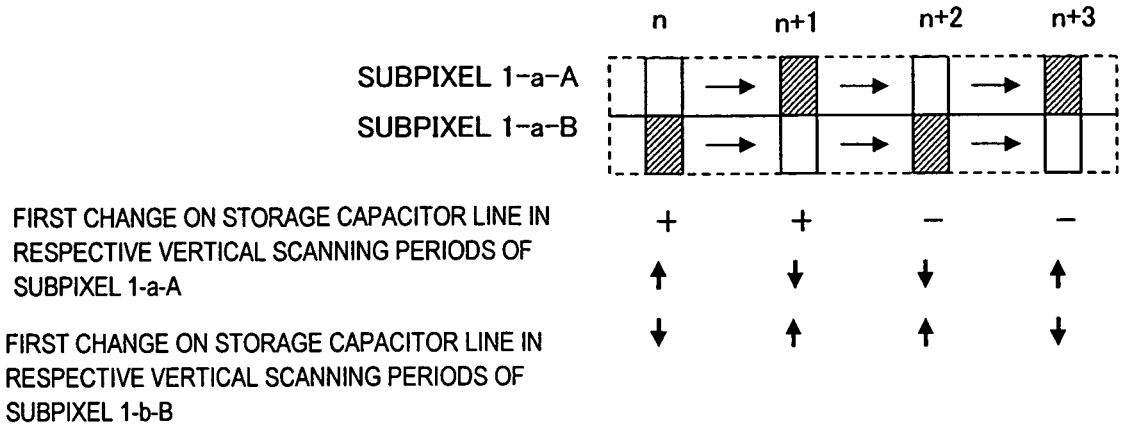
FIG. 17 is a schematic representation illustrating the brightness levels and polarities of respective subpixels and the first change of storage capacitor voltages in respective vertical scanning periods of each subpixel in the liquid crystal display device of the first preferred embodiment.

FIG. 17 shows the brightness levels and polarities of the subpixels 1-*a*-A and 1-*a*-B and the first change of voltages on the storage capacitor lines at the vertical scanning period of the subpixels 1-*a*-A and 1-*a*-B. As shown in FIG. 17, in frame n, the polarity of the subpixels 1-*a*-A and 1-*a*-B is positive "+", the first change of voltages on the storage capacitor line at the vertical scanning period of the subpixel 1-*a*-A is increase "↑", and the first change of voltages on the storage capacitor line at the vertical scanning period of the subpixel 1-*a*-B is decrease "↓". In the next frame n+1, the polarity of the subpixels 1-*a*-A and 1-*a*-B is positive "+", the first change of voltages on the storage capacitor line at the vertical scanning period of the subpixel 1-*a*-A is decrease "↓", and the first change of voltages on the storage capacitor line at the vertical scanning period of the subpixel 1-*a*-B is increase "↑".

In the frame n+2, the polarity of the subpixels 1-*a*-A and 1-*a*-B is negative "−", the first change of voltages on the storage capacitor line at the vertical scanning period of the subpixel 1-*a*-A is decrease "↓", and the first change of voltages on the storage capacitor line at the vertical scanning period of the subpixel 1-*a*-B is increase "↑". In the next frame n+3, the polarity of the subpixels 1-*a*-A and 1-*a*-B is negative "−", the first change of voltages on the storage capacitor line at the vertical scanning period of the subpixel 1-*a*-A is increase "↑", and the first change of voltages on the storage capacitor line at the vertical scanning period of the subpixel 1-*a*-B is decrease "↓".

As described above, the (polarity, first change of voltages on storage capacitor line) combinations of the subpixel 1-*a*-A from frame n through frame n+3 change (+, ↑), (+, ↓), (−, ↓) and (−, ↑) in this order. That is to say, mutually different combinations appear one after another. On the other hand, the (polarity, first change of voltages on storage capacitor line) combinations of the subpixel 1-*a*-B from frame n through frame n+3 change (+, ↓), (+, ↑), (−, ↑) and (−, ↓) in this order. That is to say, these combinations of the subpixel 1-*a*-B have the same polarity change pattern as, but a different storage capacitor line voltage variation pattern from, those of the subpixel 1-*a*-A.

In the preferred embodiment described above, the voltage on each storage capacitor line is supposed to change periodically in regular cycles of 20H during the display period. However, the present invention is in no way limited to that specific preferred embodiment. The voltage on each storage capacitor line may also change in regular cycles of 16H during the display period as shown in portion (*a*) of FIG. 18. In that case, the storage capacitor line voltage changes every 13H in the first and third regulation periods BH but changes every 9H in the second and fourth regulation periods BH, for example. Alternatively, the storage capacitor line voltage may also change in regular cycles of 24H during the display period as shown in portion (*b*) of FIG. 18. In that case, the storage capacitor line voltage changes every 15H in the first and third regulation periods BH but changes every 21H in the second and fourth regulation periods BH, for example. The intervals of the variation in storage capacitor line voltage during the BH period may be appropriately changed according to the V-total value.

Also, in the preferred embodiment described above, the voltage on each storage capacitor line is supposed to complete one cycle of change during each regulation period. However, the present invention is in no way limited to that specific preferred embodiment. The voltage on each storage capacitor line may also change periodically during each regulation period either in a cycle time of 2H as shown in portion (*a*) of FIG. 19 or in a cycle time of 1H as shown in portion (*b*) of FIG. 19. Alternatively, the voltage on each storage capacitor line may also be maintained at the average of VcH and VcL during each regulation period as shown in portion (*c*) of FIG. 19.

Furthermore, in the preferred embodiment described above, one regulation period is supposed to be included in each vertical scanning period for one frame. However, the present invention is in no way limited to that specific preferred embodiment. One regulation period may be provided for every two vertical scanning periods for two frames as shown in FIG. 20. In the example illustrated in FIG. 20, each vertical scanning period has a duration of 810H and the storage capacitor voltages Vcs1 through Vcs3 change periodically in regular cycles of 20H during the display period but changes every 5H during the regulation period. If two vertical scanning periods (e.g., 810H×2=1,620H in this example) are an integral number of times as long as one cycle time (e.g., 20H in this example) of the display period in this manner, then a half-cycle period may be provided as a regulation period for the storage capacitor line voltage and the polarity may be inverted every other vertical scanning period. Then, as already described with reference to FIG. 17, the first change of storage capacitor voltages at the beginning of the third vertical scanning period can be different from the first change of storage capacitor voltages at the beginning of the first vertical scanning period. As a result, the brightness levels and polarities of subpixels can be changed as shown in portion (*a*) of FIG. 6.

Furthermore, in the preferred embodiment described above, each regulation period is supposed to be an even number of times as long as one horizontal scanning period. However, the present invention is in no way limited to that specific preferred embodiment. Each regulation period may also be an odd number of times as long as one horizontal scanning period. Even if the first and third regulation periods have a cycle time of 37H and if the second and fourth regulation periods have a cycle time of 27H as shown in FIG. 21, the degree of non-smoothness of the image on the screen can also be reduced by inverting the brightness levels and polarities of respective subpixels as in a situation where each regulation period is an even number of times as long as one horizontal scanning period.

Furthermore, in the preferred embodiment described above, the same storage capacitor line is supposed to be connected to two subpixels belonging to two different adjacent pixels. However, the present invention is in no way limited to that specific preferred embodiment. Two different storage capacitor lines may also be provided for two subpixels belonging to two different adjacent pixels and the voltages on those two storage capacitor lines may be changed independently of each other.

FIG. 22 shows the brightness levels and polarities of respective subpixels that have changed within the effective scanning period of a certain frame. Specifically, in FIG. 22, illustrated are pixels on the first through sixth rows and the $a^{th}$ through $f^{th}$ columns. In this example, the liquid crystal display device 100 also has ten storage capacitor trunks CS1 through CS10. As shown in FIG. 22, the storage capacitor trunk CS1 is connected to subpixels 1-*a*-A, 1-*b*-A, 1-*c*-A, etc. on the first row of pixels and to subpixels 6-*a*-A, 6-*b*-A, 6-*c*-A, etc. on the sixth row of pixels. The storage capacitor trunk CS2 is connected to subpixels 1-*a*-B, 1-*b*-B, 1-*c*-B, etc. on the first row of pixels and to subpixels 6-*a*-B, 6-*b*-B, 6-*c*-B, etc. on the sixth row of pixels. And the storage capacitor trunk CS3 is connected to subpixels 2-*a*-A, 2-*b*-A, 2-*c*-A, etc. on the second row of pixels. In this manner, in the liquid crystal display device 100 with the configuration shown in FIG. 22, a given subpixel and a subpixel belonging to another pixel adjacent to the former subpixel are connected to two different storage capacitor trunks and are electrically independent of each other.

FIG. 23 illustrates an equivalent circuit of the liquid crystal display device 100 with the configuration shown in FIG. 22. And FIG. 24 shows the waveforms of various voltages (or signals) to drive the liquid crystal display device. In FIG. 24, Vsa and Vsb represent the voltages on the signal lines Sa and Sb, Vg1 through Vg12 represent the voltages on the scan lines G1 through G12, Vcs1 through Vcs10 represent the voltages on the storage capacitor trunks CS1 through CS10 and VLsp1-*a*-A through VLsp2-*b*-B represent the effective voltages applied to the liquid crystal layers of the subpixels 1-*a*-A through 2-*b*-B, respectively. What is shown in FIG. 24 is voltage waveforms within one vertical scanning period.

As shown in FIG. 24, the voltages Vcs1 through Vcs10 on the storage capacitor trunks CS1 through CS10 oscillate with the same amplitude and in the same regular cycles. In this example, one oscillation cycle time is 10H. For example, the voltages Vcs1 and Vcs2 have such a relation that if one of these two voltages changes into VcH, the other voltage will change into VcL and that if one of these two voltages changes into VcL, the other voltage will change into VcH. The other four pairs of voltages Vcs3 and Vcs4, Vcs5 and Vcs6, Vcs7 and Vcs8, and Vcs9 and Vcs10 too have the same relation as that pair of voltages Vcs1 and Vcs2. As can be seen from FIG. 24, after the voltage Vg1 on the scan line G1 has become VgL, the voltage Vcs1 increases (↑) and the voltage Vcs2 decreases (↓). As also can be seen from FIG. 24, after the voltage Vg2 on the scan line G2 has become VgL, the voltage Vcs3 decreases (↓) and the voltage Vcs4 increases (↑).

In the configuration shown in FIG. 22, subpixels belonging to two different rows are connected to mutually different storage capacitor trunks, and therefore, in each of multiple pixels, the voltages applied to the liquid crystal layer of the subpixels can be increased or decreased at the same time. In this case, all of the three conditions mentioned above can be satisfied by driving the liquid crystal display device having the configuration shown in FIG. 22 with the voltage waveforms shown in FIG. 24. As a result, a display of a quality image is realized with a flicker eliminated.

The brightness levels and polarities of subpixels that have changed within the effective scanning period of a certain frame and the voltage waveforms have been described with reference to FIGS. 22 to 24. In the next frame, however, the voltages on the signal lines change according to the waveforms shown in FIG. 24 with respect to the voltages on the scan lines but the voltages on the storage capacitor trunks change inversely to the waveforms shown in FIG. 24. That is why in that frame, the polarities of the respective subpixels are the same as those of the subpixels shown in FIG. 22 but the brightness levels of the respective subpixels are inverted compared to the counterparts shown in FIG. 22.

In the frame after that next frame, with respect to the voltages on the scan lines, not only the voltages on the signal lines but also the voltages on the storage capacitor trunks change in the patterns opposite to the waveforms shown in FIG. 24. Consequently, in that frame, the brightness levels of the respective subpixels are the same as those of the subpixels shown in FIG. 22 but the polarities of the respective subpixels are inverted compared to the counterparts shown in FIG. 22.

And in the frame next to that frame, with respect to the voltages on the scan lines, the voltages on the signal lines change in the patterns opposite to the waveforms shown in FIG. 24 but the voltages on the storage capacitor trunks change according to the waveforms shown in FIG. 24. Consequently, in that frame, the brightness levels and polarities of the respective subpixels are inverted compared to the counterparts shown in FIG. 22. In this manner, the liquid crystal display device with the configuration shown in FIG. 22 can also reduce the viewing angle dependence of the r characteristic and minimize the deterioration of display quality.

Furthermore, in the preferred embodiment described above, a single signal line 14 is provided as a common line for two subpixels 10*a* and 10*b* included in the same pixel 10 as shown in FIG. 8. However, the present invention is in no way limited to that specific preferred embodiment. Two different signal lines may also be provided for two subpixels included in the same pixel. In that case, even if the voltages on storage capacitor lines are not changed subpixel by subpixel, mutually different effective voltages can also be applied to the liquid crystal layers of subpixels by varying the voltages on the signal lines.

FIG. 25 illustrates a pixel 10, of which the two subpixels 10*a* and 10*b* are provided with signal lines 14*a* and 14*b*, respectively. As shown in FIG. 25, the pixel 10 includes two subpixel electrodes 18*a* and 18*b* that are connected to the two different signal lines 14*a* and 14*b* via their associated TFTs 16*a* and 16*b*, respectively. As these two subpixels 10*a* and 10*b* form one pixel 10, the TFTs 16*a* and 16*b* have their gates connected to the same scan line (i.e., gate bus line) 12 in common and have their ON/OFF states controlled using the same scan signal. On the other hand, signal voltages (or grayscale voltages) are supplied to the signal lines (i.e., source bus lines) 14*a* and 14*b* so as to satisfy the relation described above. It is preferred that the gates of the TFTs 16*a* and 16*b* be used in common.

In the above description, the voltage applied to the counter electrode is shown to be constant. However, the present invention is in no way limited to that specific preferred embodiment. The voltage applied to the counter electrode may be changed with time.

Furthermore, FIG. 10 shows that the effective voltages applied to the first and second subpixels are different from each other in a broad grayscale range. However, the present invention is in no way limited to that specific preferred embodiment. The effective voltages applied to the subpixels could be different from each other only in a particular grayscale range (e.g., in the range of $36^{th}$ through $128^{th}$ grayscales in a 256 grayscale display in which the grayscale range from black to white is divided into 256 levels consisting of $0^{th}$ through $255^{th}$ grayscales).

Furthermore, although it has been described how effectively the present invention contributes to improving the display quality of a normally black mode liquid crystal display device (e.g., an MVA mode LCD, among other things), the present invention is in no way limited to that specific preferred embodiment. If necessary, this invention is also applicable for use in an IPS mode liquid crystal display device. The viewing angle dependence of the γ characteristic is more significant in the MVA and ASM modes than in the IPS mode. In the IPS mode, however, it is more difficult to manufacture panels that can have a high contrast ratio in the frontal viewing direction than in the MVA and ASM modes. In view of these considerations, it can be seen that it is a more urgent task to overcome the viewing angle dependence problem of the γ characteristic of the MVA and ASM mode liquid crystal display devices.

Embodiment 2

Hereinafter, a second preferred the present invention will be described. The liquid crystal embodiment of a liquid crystal display device 100 according to display device 100 of this preferred embodiment is different from the counterpart of the first preferred embodiment described above in the brightness levels and polarities of subpixels and the order of change of the effective voltages in the four consecutive vertical scanning periods. In the following description, the similar description as that of the Embodiment 1 is omitted for avoiding redundancy.

It will be described with reference to FIG. 26 how the brightness levels and electric field directions change in the subpixels and how the effective voltages applied to the liquid crystal layers of the first and second subpixels change in the liquid crystal display device 100 of this preferred embodiment.

As shown in portion (*a*) of FIG. 26, the first, fourth and fifth periods are first polarity periods, while the second, third and sixth periods are second polarity periods. Looking at any series of four vertical scanning periods, it can be seen that two out of the four are first polarity periods and the rest is second polarity periods. For example, in the first through fourth periods shown in portion (*a*) of FIG. 26, the first and fourth periods are first polarity periods and the second and third periods are second polarity periods. In the liquid crystal display device 100 of this preferred embodiment, however, the first polarity periods include a period that satisfies |VLspa|>|VLspb| (e.g., the first period in this example) and a period that satisfies |VLspa|<|VLspb| (e.g., the fourth period in this example). Also, in this liquid crystal display device 100, the second polarity periods include a period that satisfies |VLspa|>|VLspb| (e.g., the third period in this example) and a period that satisfies |VLspa|<|VLspb| (e.g., the second period in this example).

Portions (*b*) and (*c*) of FIG. 26 show the effective voltages VLspa and VLspb that are applied to the respective liquid crystal layers of the first and second subpixels in the respective vertical scanning periods. The levels of these voltages are indicated by the bold lines. The effective voltages VLspa and VLspb applied to the respective liquid crystal layers of the first and second subpixels are the effective values of the differences between the voltages applied to the first and second subpixel electrodes and the voltage Vc applied to the counter electrode. In this example, the voltage Vc applied to the counter electrode is shown as being constant.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 26, the first period is a first polarity period and the first subpixel is brighter than the second subpixel.

In the second period, the voltages applied to the first and second subpixel electrodes are lower than the voltage applied to the counter electrode, and the absolute value of the effective voltage applied to the liquid crystal layer of the second subpixel is greater than that of the effective voltage applied to that of the first subpixel (|VLspa|<|VLspb|). For that reason, as shown in portion (*a*) of FIG. 26, the second period is a second polarity period and the second subpixel is brighter than the first subpixel.

In the third period, the voltages applied to the first and second subpixel electrodes are lower than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 26, the third period is a second polarity period and the first subpixel is brighter than the second subpixel.

In the fourth period, the voltages applied to the first and second subpixel electrodes are higher than the voltage applied to the counter electrode, and the absolute value of the effective voltage applied to the liquid crystal layer of the second subpixel is greater than that of the effective voltage applied to that of the first subpixel (|VLspa|<|VLspb|). For that reason, as shown in portion (*a*) of FIG. 26, the fourth period is a first polarity period and the second subpixel is brighter than the first subpixel. From the fifth period on, the brightness levels and polarities of the first and second subpixels will vary in quite the same pattern as the first and second subpixels in the first through fourth periods.

Thus, the (brightness, polarity) combination of the first subpixel changes in the order of (B, +), (D, −), (B, −) and (D, +), while the (brightness, polarity) combination of the second subpixel changes in the order of (D, +), (B, −), (D, −) and (B, +) as shown in portion (*a*) of FIG. 26. In this manner, the liquid crystal display device of this preferred embodiment inverts the brightness levels of the subpixels every vertical scanning period and also inverts their polarities every other vertical scanning period. In the liquid crystal display device of this preferred embodiment, since the brightness levels of the subpixels are inverted every vertical scanning period as in the liquid crystal display device of the first preferred embodiment, the degree of non-smoothness of the image on the screen can be reduced. Also, in the liquid crystal display device of this preferred embodiment, each set of first and second polarity periods has a period in which the first subpixel is brighter than the second subpixel as in the liquid crystal display device of the first preferred embodiment. Thus, as can be seen from portions (*b*) and (*c*) of FIG. 26, the average of the effective voltages VLspa and that of the effective voltages VLspb over multiple vertical scanning periods (e.g., the first through fourth periods) can be equal to each other. Furthermore, the averages of the effective voltages VLspa and VLspb can be both controlled to zero by adjusting the counter voltage. As a result, the residual image and other reliability-related problems can be overcome.

FIG. 27 shows the brightness levels and polarities of the first and second subpixels and the first change of voltages on the storage capacitor lines at the vertical scanning period of the first and second subpixels. In FIG. 27, the four consecutive frames are identified by n, n+1, n+2 and n+3, respectively.

As shown in FIG. 27, in frame n, the polarity of the first and second subpixels is positive "+", the first change of voltages on the storage capacitor line at the vertical scanning period of the first subpixel is increase "↑", and the first change of voltages on the storage capacitor line at the vertical scanning period of the second subpixel is decrease "↓". In the next frame n+1, the polarity of the first and second subpixels is negative "−", the first change of voltages on the storage capacitor line at the vertical scanning period of the first subpixel is increase "↑", and the first change of voltages on the storage capacitor line at the vertical scanning period of the second subpixel is decrease "↓".

In the frame n+2, the polarity of the first and second subpixels is negative "−", the first change of voltages on the storage capacitor line at the vertical scanning period of the first subpixel is decrease "↓", and the first change of voltages on the storage capacitor line at the vertical scanning period of the second subpixel is increase "↑". In the next frame n+3, the polarity of the first and second subpixels is positive "+", the first change of voltages on the storage capacitor line at the vertical scanning period of the first subpixel is decrease "↓", and the first change of voltages on the storage capacitor line at the vertical scanning period of the second subpixel is increase "↑".

If the first and second subpixels shown in portion (*a*) of FIG. 6, which have been referred to for the description of the first preferred embodiment, were interchanged with each other, the brightness levels and polarities of the subpixels in the second through fifth periods would correspond with those of the subpixels in the first through fourth periods shown in portion (*a*) of FIG. 26. That is why if the display area of the first subpixel electrode is as large as that of the second subpixel electrode, then the liquid crystal display device of this preferred embodiment will achieve substantially the same effects as the counterpart of the first preferred embodiment described above.

Embodiment 3

Hereinafter, a third preferred embodiment of a liquid crystal display device 100 according to the present invention will be described. The liquid crystal display device 100 of this preferred embodiment is different from the counterparts described above in the brightness levels and polarities of subpixels and the order of change of the effective voltages in the four consecutive vertical scanning periods. In the following description, the repeated description is omitted for avoiding redundancy.

It will be described with reference to FIG. 28 how the brightness levels and polarities change in the subpixels and how the effective voltages applied to the liquid crystal layers of the first and second subpixels change in the liquid crystal display device 100 of this preferred embodiment.

As shown in portion (*a*) of FIG. 28, the first, third and fifth periods are first polarity periods, while the second, fourth and sixth periods are second polarity periods in the liquid crystal display device 100 of this preferred embodiment. Looking at any series of four vertical scanning periods, it can be seen that two out of the four are first polarity periods and the rest is second polarity periods. For example, in the first through fourth periods shown in portion (*a*) of FIG. 28, the first and third periods are first polarity periods and the second and fourth periods are second polarity periods. In the liquid crystal display device 100 of this preferred embodiment, however, the first polarity periods include a period that satisfies $|VLspa|>|VLspb|$ (e.g., the first period in this example) and a period that satisfies $|VLspa|<|VLspb|$ (e.g., the third period in this example). Also, in this liquid crystal display device 100, the second polarity periods include a period that satisfies $|VLspa|>|VLspb|$ (e.g., the second period in this example) and a period that satisfies $|VLspa|<|VLspb|$ (e.g., the fourth period in this example).

Portions (*b*) and (*c*) of FIG. 28 show the effective voltages VLspa and VLspb that are applied to the respective liquid crystal layers of the first and second subpixels in the respective vertical scanning periods. The levels of these voltages are indicated by the bold lines. The effective voltages VLspa and VLspb applied to the respective liquid crystal layers of the first and second subpixels are the effective values of the differences between the voltages applied to the first and second subpixel electrodes and the voltage Vc applied to the counter electrode. In this example, the voltage Vc applied to the counter electrode is shown as being constant.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel ($|VLspa|>|VLspb|$). For that reason, as shown in portion (*a*) of FIG. 28, the first period is a first polarity period and the first subpixel is brighter than the second subpixel.

In the second period, the voltages applied to the first and second subpixel electrodes are lower than the voltage applied to the counter electrode, and the absolute value of the effective voltage applied to the liquid crystal layer of the first subpixel is greater than that of the effective voltage applied to that of the second subpixel ($|VLspa|>|VLspb|$). For that reason, as shown in portion (*a*) of FIG. 28, the second period is a second polarity period and the first subpixel is brighter than the second subpixel.

In the third period, the voltages applied to the first and second subpixel electrodes are higher than the voltage applied to the counter electrode, and the absolute value of the effective voltage applied to the liquid crystal layer of the second subpixel is greater than that of the effective voltage applied to that of the first subpixel ($|VLspa|<|VLspb|$). For that reason, as shown in portion (*a*) of FIG. 28, the third period is a first polarity period and the second subpixel is brighter than the first subpixel.

In the fourth period, the voltages applied to the first and second subpixel electrodes are lower than the voltage applied to the counter electrode, and the absolute value of the effective voltage applied to the liquid crystal layer of the second subpixel is greater than that of the effective voltage applied to that of the first subpixel ($|VLspa|<|VLspb|$). For that reason, as shown in portion (*a*) of FIG. 28, the fourth period is a second polarity period and the second subpixel is brighter than the first subpixel. From the fifth period on, the brightness levels and polarities of the first and second subpixels will vary in quite the same pattern as the first and second subpixels in the first through fourth periods. In the liquid crystal display device of this preferred embodiment, the frame frequency may be 120 Hz, for example.

Thus, the (brightness, polarity) combination of the first subpixel changes in the order of (B, +), (B, −), (D, +) and (D, −), while the (brightness, polarity) combination of the second subpixel changes in the order of (D, +), (D, −), (B, +) and (B, −) as shown in portion (*a*) of FIG. 28. In this manner, the liquid crystal display device of this preferred embodiment inverts the brightness levels of the subpixels every other vertical scanning period and also inverts their polarities every vertical scanning period. In the liquid crystal display device of this preferred embodiment, since the brightness levels of the subpixels are inverted every other vertical scanning period unlike the liquid crystal display device disclosed in Patent Document No. 1, the degree of non-smoothness of the image on the screen can be reduced. Also, in the liquid crystal display device of this preferred embodiment, the brightness levels of the first and second subpixels are inverted in any of the first and second polarity periods unlike the liquid crystal display device disclosed in Patent Document No. 2. Thus, as can be seen from portions (*b*) and (*c*) of FIG. 28, the average of the effective voltages VLspa and that of the effective voltages VLspb over multiple vertical scanning periods (e.g., the first through fourth periods) can be approximately equal to each other. Furthermore, the averages of the effective voltages VLspa and VLspb can be both controlled to zero by adjusting the counter voltage. As a result, the residual image and other reliability-related problems can be overcome.

Next, it will be described with reference to FIG. 29 how the effective voltages applied to the respective liquid crystal layers of the first and second subpixels change over multiple vertical scanning periods. In FIG. 29, Vg represents the voltage on the scan line, Vcsa and Vcsb represent the voltages on the first and second storage capacitor lines, respectively, and VLspa and VLspb represent the effective voltages applied to the respective liquid crystal layers of the first and second subpixels. In this example, the voltages on the first and second storage capacitor lines vary in regular cycles of 20H by increasing or decreasing every 10H through the display periods AH. On the other hand, the voltages on the first and second storage capacitor lines increase or decrease every 18H during the first and third regulation periods BH and increase or decrease every 13H during the second and fourth regulation periods BH.

The effective voltages applied to the respective liquid crystal layers of the first and second subpixels change as the voltages on the first and second storage capacitor lines vary. As a result, the (brightness, polarity) combination of the first subpixel changes in the order of (B, +), (B, −), (D, +) and (D, −), while the (brightness, polarity) combination of the second subpixel changes in the order of (D, +), (D, −), (B, +) and (B, −). In this manner, the brightness levels and polarities of the first and second subpixels change as shown in portion (*a*) of FIG. 28. Consequently, the liquid crystal display device of this preferred embodiment can minimize the deterioration of display quality with the viewing angle dependence of the γ characteristic reduced.

FIG. 30 shows the brightness levels and polarities of the first and second subpixels and the first change of voltages on the storage capacitor lines at the vertical scanning period of the first and second subpixels. In FIG. 30, the four consecutive frames are identified by n, n+1, n+2 and n+3, respectively.

As shown in FIG. 30, in frame n, the polarity of the first and second subpixels is positive "+", the first change of voltages on the storage capacitor line at the vertical scanning period of the first subpixel is increase "↑", and the first change of voltages on the storage capacitor line at the vertical scanning period of the second subpixel is decrease "↓". In the next frame n+1, the polarity of the first and second subpixels is negative "−", the first change of voltages on the storage capacitor line at the vertical scanning period of the first subpixel is decrease "↓", and the first change of voltages on the storage capacitor line at the vertical scanning period of the second subpixel is increase "↑".

In the frame n+2, the polarity of the first and second subpixels is positive "+", the first change of voltages on the storage capacitor line at the vertical scanning period of the first subpixel is decrease "↓", and the first change of voltages on the storage capacitor line at the vertical scanning period of the second subpixel is increase "↑". In the next frame n+3, the polarity of the first and second subpixels is negative "−", the first change of voltages on the storage capacitor line at the vertical scanning period of the first subpixel is increase "↑", and the first change of voltages on the storage capacitor line at the vertical scanning period of the second subpixel is decrease "↓".

Comparing FIGS. 17 and 30 to each other, it can be seen that the first change of voltages on the storage capacitor line at the vertical scanning period of the first or second subpixel in the liquid crystal display device of this preferred embodiment is the same as in the counterpart of the first preferred embodiment described above. However, the polarities change differently in the liquid crystal display device of this preferred embodiment from in the first preferred embodiment described above.

Hereinafter, the difference in the brightness inversion interval of the subpixels between the liquid crystal display device of this preferred embodiment and the counterpart of the first preferred embodiment will be described. Specifically, in the liquid crystal display device of this preferred embodiment, the brightness levels of the subpixels invert every other vertical scanning period as shown in FIG. 28. On the other hand, in the liquid crystal display device of the first preferred embodiment described above, the brightness levels of the subpixels invert every vertical scanning period as shown in FIG. 6. That is to say, the subpixel brightness inversion interval of the liquid crystal display device of this preferred embodiment is twice as long as that of the liquid crystal display device of the first preferred embodiment. The non-smoothness of the image on the screen can be reduced by inverting the brightness levels of the subpixels as described above. In this case, the shorter the subpixel brightness inversion interval, the more significantly the non-smoothness can be reduced. Nevertheless, if one vertical scanning period became too short, then the orientations of the liquid crystal molecules could not change so much within one vertical scanning period that the luminance could fall short of a predetermined value. That is to say, if one vertical scanning period were too short for the response speed of liquid crystal molecules, the difference in luminance between the subpixels would not be so much as to reduce the viewing angle dependence of the r characteristic significantly.

The following Table 1 summarizes how the display qualities of the liquid crystal display devices disclosed in Patent Documents Nos. 1 and 2 and the device of the first and this preferred embodiments of the present invention were affected when the frame frequencies were changed. In Table 1, a good display quality is indicated by the open circle O, while a poor display quality is indicated by the cross X.

TABLE 1

| Frame frequency | 50 Hz | 60 Hz | 75 Hz | 90 Hz | 120 Hz |
|---|---|---|---|---|---|
| PATENT DOCUMENT #1 | | | | | |
| Improvement of viewing angle characteristic | ○ | ○ | ○ | ○ | ○ |
| Image non-smoothness | X | X | X | X | X |
| Flicker | ○ | ○ | ○ | ○ | ○ |
| Reliability | ○ | ○ | ○ | ○ | ○ |
| PATENT DOCUMENT #2 | | | | | |
| Improvement of viewing angle characteristic | ○ | ○ | ○ | ○ | X |
| Image non-smoothness | ○ | ○ | ○ | ○ | ○ |
| Flicker | ○ | ○ | ○ | ○ | ○ |
| Reliability | X | X | X | X | X |
| EMBODIMENT 1 (see FIG. 6) | | | | | |
| Improvement of viewing angle characteristic | ○ | ○ | ○ | ○ | X |
| Image non-smoothness | ○ | ○ | ○ | ○ | ○ |
| Flicker | X | ○ | ○ | ○ | ○ |
| Reliability | ○ | ○ | ○ | ○ | ○ |
| EMBODIMENT 3 (see FIG. 28) | | | | | |
| Improvement of viewing angle characteristic | ○ | ○ | ○ | ○ | ○ |
| Image non-smoothness | ○ | ○ | ○ | ○ | ○ |
| Flicker | X | X | X | X | ○ |
| Reliability | ○ | ○ | ○ | ○ | ○ |

According to Table 1, the liquid crystal display device of Patent Document No. 1 improves the viewing angle characteristic at every frame frequency but made the viewer find the image on the screen non-smooth at any frame frequency, which is a problem. Meanwhile, as for the liquid crystal display device disclosed in Patent Document No. 2, its reliability was too questionable to manufacture it on an industrial basis.

On the other hand, the liquid crystal display devices of the first and third preferred embodiments of the present invention raised no reliability issues unlike the device of Patent Document No. 2, and therefore, can be manufactured on an industrial basis with no problem at all. Added to that, the liquid crystal display devices of the first and third preferred embodiments could also overcome the image non-smoothness problem with the device of Patent Document No. 1.

Comparing the liquid crystal display devices of the first and third preferred embodiments to each other, however, it can be seen that the best selection should be made according to the frame frequency so that the improvement of the viewing angle characteristic and the reduction of the flicker are achieved at the same time. Specifically, as shown in Table 1, the liquid crystal display device of the first preferred embodiment achieved good display qualities at frame frequencies of equal to or more than 60 Hz and equal to less than 90 Hz. On the other hand, the liquid crystal display device of this preferred embodiment could present a flicker-free image as long as the frame frequency was equal to or higher than 120 Hz. The present inventors confirmed via experiments that if the frame frequency was equal to or higher than 120 Hz, the liquid crystal display device of this preferred embodiment could reduce the viewing angle dependence of the γ characteristic sufficiently effectively. Once the frame frequency exceeds that value, however, it is preferred that the response speed be increased by changing the liquid crystal materials or driving methods into more appropriate ones.

Embodiment 4

Hereinafter, a fourth preferred embodiment of a liquid crystal display device 100 according to the present invention will be described. The liquid crystal display device 100 of this preferred embodiment is different from the counterparts described above in the brightness levels and polarities of subpixels and the order of change of the effective voltages in the four consecutive vertical scanning periods. In the following description, the repeated description is omitted for avoiding redundancy.

It will be described with reference to FIG. 31 how the brightness levels and polarities change in the subpixels and how the effective voltages applied to the liquid crystal layers of the first and second subpixels change in the liquid crystal display device 100 of this preferred embodiment.

As shown in portion (*a*) of FIG. 31, the first, third and fifth periods are first polarity periods, while the second, fourth and sixth periods are second polarity periods in the liquid crystal display device 100 of this preferred embodiment. Looking at any series of four vertical scanning periods, it can be seen that two out of the four are first polarity periods and the rest is second polarity periods. For example, in the first through fourth periods shown in portion (*a*) of FIG. 31, the first and third periods are first polarity periods and the second and fourth periods are second polarity periods. In the liquid crystal display device 100 of this preferred embodiment, however, the first polarity periods include a period that satisfies $|VLspa|>|VLspb|$ (e.g., the first period in this example) and a period that satisfies $|VLspa|<|VLspb|$ (e.g., the third period in this example). Also, in this liquid crystal display device 100, the second polarity periods include a period that satisfies $|VLspa|>|VLspb|$ (e.g., the fourth period in this example) and a period that satisfies $|VLspa|<|VLspb|$ (e.g., the second period in this example).

Portions (*b*) and (*c*) of FIG. 31 show the effective voltages VLspa and VLspb that are applied to the respective liquid crystal layers of the first and second subpixels in the respective vertical scanning periods. The levels of these voltages are indicated by the bold lines. The effective voltages VLspa and VLspb applied to the respective liquid crystal layers of the first and second subpixels are the effective values of the differences between the voltages applied to the first and second subpixel electrodes and the voltage Vc applied to the counter electrode. In this example, the voltage Vc applied to the counter electrode is shown as being constant.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel ($|VLspa|>|VLspb|$). For that reason, as shown in portion (*a*) of FIG. 31, the first period is a first polarity period and the first subpixel is brighter than the second subpixel.

In the second period, the voltages applied to the first and second subpixel electrodes are lower than the voltage applied to the counter electrode, and the absolute value of the effective voltage applied to the liquid crystal layer of the second subpixel is greater than that of the effective voltage applied to that of the first subpixel ($|VLspa|<|VLspb|$). For that reason, as shown in portion (*a*) of FIG. 31, the second period is a second polarity period and the second subpixel is brighter than the first subpixel.

In the third period, the voltages applied to the first and second subpixel electrodes are higher than the voltage applied to the counter electrode, and the absolute value of the effective voltage applied to the liquid crystal layer of the second subpixel is greater than that of the effective voltage applied to that of the first subpixel ($|VLspa|<|VLspb|$). For that reason, as shown in portion (*a*) of FIG. 31, the third period is a first polarity period and the second subpixel is brighter than the first subpixel.

In the fourth period, the voltages applied to the first and second subpixel electrodes are lower than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 31, the fourth period is a second polarity period and the first subpixel is brighter than the second subpixel. From the fifth period on, the brightness levels and polarities of the first and second subpixels will vary in quite the same pattern as the first and second subpixels in the first through fourth periods.

Thus, the (brightness, polarity) combination of the first subpixel changes in the order of (B, +), (D, −), (D, +) and (B, −), while the (brightness, polarity) combination of the second subpixel changes in the order of (D, +), (B, −), (B, +) and (D, −) as shown in portion (*a*) of FIG. 31. In this manner, the liquid crystal display device of this preferred embodiment inverts the brightness levels of the subpixels every other vertical scanning period and also inverts their polarities every vertical scanning period. In this preferred embodiment, the frame frequency may be 120 Hz, for example.

FIG. 32 shows the brightness levels and polarities of the first and second subpixels and the first change of voltages on the storage capacitor lines at the vertical scanning period of the first and second subpixels. In FIG. 32, the four consecutive frames are identified by n, n+1, n+2 and n+3, respectively.

As shown in FIG. 32, in frame n, the polarity of the first and second subpixels is positive "+", the first change of voltages on the storage capacitor line at the vertical scanning period of the first subpixel is increase "↑", and the first change of voltages on the storage capacitor line at the vertical scanning period of the second subpixel is decrease "↓". In the next frame n+1, the polarity of the first and second subpixels is negative "−", the first change of voltages on the storage capacitor line at the vertical scanning period of the first subpixel is increase "↑", and the first change of voltages on the storage capacitor line at the vertical scanning period of the second subpixel is decrease "↓".

In the frame n+2, the polarity of the first and second subpixels is positive "+", the first change of voltages on the storage capacitor line at the vertical scanning period of the first subpixel is decrease "↓", and the first change of voltages on the storage capacitor line at the vertical scanning period of the second subpixel is increase "↑". In the next frame n+3, the polarity of the first and second subpixels is negative "−", the first change of voltages on the storage capacitor line at the vertical scanning period of the first subpixel is decrease "↓", and the first change of voltages on the storage capacitor line at the vertical scanning period of the second subpixel is increase "↑".

In the liquid crystal display device of this preferred embodiment as the liquid crystal display device of the third preferred embodiment, since the brightness levels of the subpixels are inverted every other vertical scanning period, the degree of non-smoothness of the image on the screen can be reduced. In the liquid crystal display device of this preferred embodiment as the liquid crystal display device of the third preferred embodiment, since the brightness levels of the first and second subpixels are inverted in each of the first and second polarity periods, as can be seen from portions (*b*) and (*c*) of FIG. 31, the average of the effective voltages VLspa and that of the effective voltages VLspb over multiple vertical scanning periods (e.g., the first through fourth periods) can be approximately equal to each other. Furthermore, the averages of the effective voltages VLspa and VLspb can be both controlled to zero by adjusting the counter voltage. As a result, the residual image and other reliability-related problems can be overcome.

If the polarities were inverted in portion (*a*) of FIG. 28, which has been referred to for the description of the liquid crystal display device of the third preferred embodiment, then the brightness levels and polarities of the subpixels in the second through fifth periods would correspond with those of the subpixels in the first through fourth periods shown in portion (*a*) of FIG. 31. Consequently, the liquid crystal display device of this preferred embodiment would achieve substantially the same effects as the counterpart of the third preferred embodiment described above.

If the brightness levels and polarities of the subpixels 1-*a*-A and 1-*a*-B change as in the first through fourth periods shown in portion (*a*) of FIG. 31 when the liquid crystal display device of the third preferred embodiment is subjected to the dot inversion drive as already described with reference to FIGS. 14 and 15, then the brightness levels and polarities of the subpixels 2-*a*-A and 2-*a*-B will change as in the second through fifth periods shown in portion (*a*) of FIG. 28.

Embodiment 5

Hereinafter, a fifth preferred embodiment of a liquid crystal display device according to the present invention will be described. The liquid crystal display device 100 of this preferred embodiment is different from the counterparts described above in the brightness levels and polarities of subpixels and the order of change of the effective voltages in the four consecutive vertical scanning periods. In the following description, the repeated description is omitted for avoiding redundancy.

It will be described with reference to FIG. 33 how the brightness levels and polarities change in the subpixels and how the effective voltages applied to the liquid crystal layers of the first and second subpixels change in the liquid crystal display device 100 of this preferred embodiment.

As shown in portion (*a*) of FIG. 33, the first, fourth and fifth periods are first polarity periods, while the second, third and sixth periods are second polarity periods in the liquid crystal display device 100 of this preferred embodiment. Looking at any series of four vertical scanning periods, it can be seen that two out of the four are first polarity periods and the rest is second polarity periods. For example, in the first through fourth periods shown in portion (*a*) of FIG. 33, the first and fourth periods are first polarity periods and the second and third periods are second polarity periods. In the liquid crystal display device 100 of this preferred embodiment, however, the first polarity periods include a period that satisfies |VLspa|>|VLspb| (e.g., the first period in this example) and a period that satisfies |VLspa|<|VLspb| (e.g., the fourth period in this example). Also, in this liquid crystal display device 100, the second polarity periods include a period that satisfies |VLspa|>|VLspb| (e.g., the second period in this example) and a period that satisfies |VLspa|<|VLspb| (e.g., the third period in this example).

Portions (*b*) and (*c*) of FIG. 33 show the effective voltages VLspa and VLspb that are applied to the respective liquid crystal layers of the first and second subpixels in the respective vertical scanning periods. The levels of these voltages are indicated by the bold lines. The effective voltages VLspa and VLspb applied to the respective liquid crystal layers of the first and second subpixels are the effective values of the differences between the voltages applied to the first and second subpixel electrodes and the voltage Vc applied to the counter electrode. In this example, the voltage Vc applied to the counter electrode is shown as being constant.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 33, the first period is a first polarity period and the first subpixel is brighter than the second subpixel.

In the second period, the voltages applied to the first and second subpixel electrodes are lower than the voltage applied to the counter electrode, and the absolute value of the effective voltage applied to the liquid crystal layer of the first subpixel is greater than that of the effective voltage applied to that of the second subpixel (|VLspa|>|VLspb|). For that reason, as shown in portion (*a*) of FIG. 33, the second period is a second polarity period and the first subpixel is brighter than the second subpixel.

In the third period, the voltages applied to the first and second subpixel electrodes are lower than the voltage applied to the counter electrode, and the absolute value of the effective voltage applied to the liquid crystal layer of the second subpixel is greater than that of the effective voltage applied to that of the first subpixel (|VLspa|<|VLspb|). For that reason, as shown in portion (*a*) of FIG. 33, the third period is a second polarity period and the second subpixel is brighter than the first subpixel.

In the fourth period, the voltages applied to the first and second subpixel electrodes are higher than the voltage applied to the counter electrode, and the absolute value of the effective voltage applied to the liquid crystal layer of the second subpixel is greater than that of the effective voltage applied to that of the first subpixel (|VLspa|<|VLspb|). For that reason, as shown in portion (*a*) of FIG. 33, the fourth period is a first polarity period and the second subpixel is brighter than the first subpixel. From the fifth period on, the brightness levels and polarities of the first and second subpixels will vary in quite the same pattern as the first and second subpixels in the first through fourth periods. In the liquid crystal display device of this preferred embodiment, the frame frequency may be 120 Hz, for example.

Thus, the (brightness, polarity) combination of the first subpixel changes in the order of (B, +), (B, −), (D, −) and (D, +), while the (brightness, polarity) combination of the second subpixel changes in the order of (D, +), (D, −), (B, −) and (B, +) as shown in portion (*a*) of FIG. 33. In this manner, the liquid crystal display device of this preferred embodiment inverts the brightness levels of the subpixels every other vertical scanning period and also inverts their polarities every other vertical scanning period. But the timing of inversion of the polarities is shifted by one vertical scanning period from that of the brightness levels of the subpixels. In the liquid crystal display device of this preferred embodiment, since the brightness levels of the subpixels are inverted every other vertical scanning period unlike the liquid crystal display device disclosed in Patent Document No. 1, the degree of non-smoothness of the image on the screen can be reduced. Also, in the liquid crystal display device of this preferred embodiment, the brightness levels of the first and second subpixels are inverted in any of the first and second polarity periods unlike the liquid crystal display device disclosed in Patent Document No. 2. Thus, as can be seen from portions (*b*) and (*c*) of FIG. 33, the average of the effective voltages VLspa and that of the effective voltages VLspb over multiple vertical scanning periods (e.g., the first through fourth periods) can be approximately equal to each other. Furthermore, the averages of the effective voltages VLspa and VLspb can be both controlled to zero by adjusting the counter voltage. As a result, the residual image and other reliability-related problems can be overcome.

Next, it will be described with reference to FIG. 34 how the voltages change over multiple vertical scanning periods.

In FIG. 34, Vg represents the voltage on the scan line, Vcsa and Vcsb represent the voltages on the first and second storage capacitor lines, respectively, and VLspa and VLspb represent the effective voltages applied to the respective liquid crystal layers of the first and second subpixels. In this example, the voltages on the first and second storage capacitor lines vary in regular cycles of 20H by increasing or decreasing every 10H through the display periods AH. On the other hand, the voltages on the first and second storage capacitor lines increase or decrease every 18H during the first through fourth regulation periods BH.

FIG. 35 shows the brightness levels and polarities of the first and second subpixels and the first change of voltages on the storage capacitor lines at the vertical scanning period of the first and second subpixels. In FIG. 35, the four consecutive frames are identified by n, n+1, n+2 and n+3, respectively.

As shown in FIG. 35, in frame n, the polarity of the first and second subpixels is positive "+", the first change of voltages on the storage capacitor line at the vertical scanning period of the first subpixel is increase "↑", and the first change of voltages on the storage capacitor line at the vertical scanning period of the second subpixel is decrease "↓". In the next frame n+1, the polarity of the first and second subpixels is negative "−", the first change of voltages on the storage capacitor line at the vertical scanning period of the first subpixel is decrease "↓", and the first change of voltages on the storage capacitor line at the vertical scanning period of the second subpixel is increase "↑".

In the frame n+2, the polarity of the first and second subpixels is negative "−", the first change of voltages on the storage capacitor line at the vertical scanning period of the first subpixel is increase "↑", and the first change of voltages on the storage capacitor line at the vertical scanning period of the second subpixel is decrease "↓". In the next frame n+3, the polarity of the first and second subpixels is positive "+", the first change of voltages on the storage capacitor line at the vertical scanning period of the first subpixel is decrease "↓", and the first change of voltages on the storage capacitor line at the vertical scanning period of the second subpixel is increase "↑".

As described above, the effective voltages applied to the respective liquid crystal layers of the first and second subpixels change as the voltages on the first and second storage capacitor lines vary. As a result, the (brightness, polarity) combination of the first subpixel changes in the order of (B, +), (B, −), (D, −) and (D, +), while the (brightness, polarity) combination of the second subpixel changes in the order of (D, +), (D, −), (B, −) and (B, +). Consequently, the liquid crystal display device of this preferred embodiment can minimize the deterioration of display quality with the viewing angle dependence of the r characteristic reduced.

Embodiment 6

Hereinafter, a sixth preferred embodiment of a liquid crystal display device according to the present invention will be described. The liquid crystal display device 100 of this preferred embodiment is different from the counterparts described above in the brightness levels and polarities of subpixels and the order of change of the effective voltages in the four consecutive vertical scanning periods. In the following description, the repeated description is omitted for avoiding redundancy.

It will be described with reference to FIG. 36 how the brightness levels and polarities change in the subpixels and how the effective voltages applied to the liquid crystal layers of the first and second subpixels change in the liquid crystal display device 100 of this preferred embodiment.

As shown in portion (*a*) of FIG. 36, the first, second, fifth and sixth periods are first polarity periods, while the third and fourth periods are second polarity periods in the liquid crystal display device 100 of this preferred embodiment. Looking at any series of four vertical scanning periods, it can be seen that two out of the four are first polarity periods and the rest is second polarity periods. For example, in the first through fourth periods shown in portion (*a*) of FIG. 36, the first and second periods are first polarity periods and the third and fourth periods are second polarity periods. In the liquid crystal display device 100 of this preferred embodiment, however, the first polarity periods include a period that satisfies $|VLspa|>|VLspb|$ (e.g., the first period in this example) and a period that satisfies $|VLspa|<|VLspb|$ (e.g., the second period in this example). Also, in this liquid crystal display device 100, the second polarity periods include a period that satisfies $|VLspa|>|VLspb|$ (e.g., the fourth period in this example) and a period that satisfies $|VLspa|<|VLspb|$ (e.g., the third period in this example).

Portions (*b*) and (*c*) of FIG. 36 show the effective voltages VLspa and VLspb that are applied to the respective liquid crystal layers of the first and second subpixels in the respective vertical scanning periods. The levels of these voltages are indicated by the bold lines. The effective voltages VLspa and VLspb applied to the respective liquid crystal layers of the first and second subpixels are the effective values of the differences between the voltages applied to the first and second subpixel electrodes and the voltage Vc applied to the counter electrode. In this example, the voltage Vc applied to the counter electrode is shown as being constant.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel ($|VLspa|>|VLspb|$). For that reason, as shown in portion (*a*) of FIG. 36, the first period is a first polarity period and the first subpixel is brighter than the second subpixel.

In the second period, the voltages applied to the first and second subpixel electrodes are higher than the voltage applied to the counter electrode, and the absolute value of the effective voltage applied to the liquid crystal layer of the second subpixel is greater than that of the effective voltage applied to that of the first subpixel ($|VLspa|<|VLspb|$). For that reason, as shown in portion (*a*) of FIG. 36, the second period is a first polarity period and the second subpixel is brighter than the first subpixel.

In the third period, the voltages applied to the first and second subpixel electrodes are lower than the voltage applied to the counter electrode, and the absolute value of the effective voltage applied to the liquid crystal layer of the first subpixel is smaller than that of the effective voltage applied to that of the second subpixel ($|VLspa|<|VLspb|$). For that reason, as shown in portion (*a*) of FIG. 36, the third period is a second polarity period and the second subpixel is brighter than the first subpixel.

In the fourth period, the voltages applied to the first and second subpixel electrodes are lower than the voltage applied to the counter electrode, and the absolute value of the effective voltage applied to the liquid crystal layer of the first subpixel is greater than that of the effective voltage applied to that of the second subpixel ($|VLspa|>|VLspb|$). For that reason, as shown in portion (*a*) of FIG. 36, the fourth period is a second polarity period and the first subpixel is brighter than the second subpixel. From the fifth period on, the brightness levels and polarities of the first and second subpixels will vary in quite the same pattern as the first and second subpixels in the first through fourth periods.

Thus, the (brightness, polarity) combination of the first subpixel changes in the order of (B, +), (D, +), (D, −) and (B, −), while the (brightness, polarity) combination of the second subpixel changes in the order of (D, +), (B, +), (B, −) and (D, −) as shown in portion (*a*) of FIG. 36. In this manner, the liquid crystal display device of this preferred embodiment inverts the brightness levels of the subpixels every other vertical scanning period and also inverts their polarities every other vertical scanning period. But the timing of inversion of the polarities is shifted by one vertical scanning period from that of the brightness levels of the subpixels. In the liquid crystal display device of this preferred embodiment, since the brightness levels of the subpixels are inverted every other vertical scanning period as in the liquid crystal display device of the fifth preferred embodiment, the degree of non-smoothness of the image on the screen can be reduced. Also, in the liquid crystal display device of this preferred embodiment, the brightness levels of the first and second subpixels are inverted in any of the first and second polarity periods as in the liquid crystal display device of the fifth preferred embodiment. Thus, as can be seen from portions (*b*) and (*c*) of FIG. 36, the average of the effective voltages VLspa and that of the effective voltages VLspb over multiple vertical scanning periods (e.g., the first through fourth periods) can be approximately equal to each other. Furthermore, the averages of the effective voltages VLspa and VLspb can be both controlled to zero by adjusting the counter voltage. As a result, the residual image and other reliability-related problems can be overcome.

FIG. 37 shows the brightness levels and polarities of the first and second subpixels and the first change of voltages on the storage capacitor lines at the vertical scanning period of the first and second subpixels. In FIG. 37, the four consecutive frames are identified by n, n+1, n+2 and n+3, respectively.

As shown in FIG. 37, in frame n, the polarity of the first and second subpixels is positive "+", the first change of voltages on the storage capacitor line at the vertical scanning period of the first subpixel is increase "↑", and the first change of voltages on the storage capacitor line at the vertical scanning period of the second subpixel is decrease "↓". In the next frame n+1, the polarity of the first and second subpixels is positive "+", the first change of voltages on the storage capacitor line at the vertical scanning period of the first subpixel is decrease "↓", and the first change of voltages on the storage capacitor line at the vertical scanning period of the second subpixel is increase "↑".

In the frame n+2, the polarity of the first and second subpixels is negative "−", the first change of voltages on the storage capacitor line at the vertical scanning period of the first subpixel is increase "↑", and the first change of voltages on the storage capacitor line at the vertical scanning period of the second subpixel is decrease "↓". In the next frame n+3, the polarity of the first and second subpixels is negative "−", the first change of voltages on the storage capacitor line at the vertical scanning period of the first subpixel is decrease "↓", and the first change of voltages on the storage capacitor line at the vertical scanning period of the second subpixel is increase "↑".

If the first and second subpixels shown in portion (*a*) of FIG. 36 were interchanged with each other, the brightness levels and polarities of the subpixels in the second through fifth periods would correspond with those of the subpixels in the first through fourth periods shown in portion (*a*) of FIG. 33, which has been referred to for the description of the fifth preferred embodiment. That is why if the display area of the first subpixel electrode is as large as that of the second subpixel electrode, then the liquid crystal display device of this preferred embodiment will achieve substantially the same effects as the counterpart of the fifth preferred embodiment described above.

If the brightness levels and polarities of the subpixels 1-*a*-A and 1-*a*-B change as in the first through fourth periods shown in portion (*a*) of FIG. 36 when the liquid crystal display device of this sixth preferred embodiment is subjected to the dot inversion drive as already described with reference to FIGS. 14 and 15, then the brightness levels and polarities of the subpixels 2-*a*-A and 2-*a*-B will change as in the second through fifth periods shown in portion (*a*) of FIG. 33.

Embodiment 7

Hereinafter, a seventh preferred embodiment of a liquid crystal display device according to the present invention will be described. The liquid crystal display device 100 of this preferred embodiment is different from the counterparts of the first through sixth preferred embodiments described above in the subpixels change their luminances by way of a moderate luminance. In the following description, the repeated description is omitted for avoiding redundancy.

It will be described with reference to FIG. 38 how the brightness levels and polarities change in the subpixels and how the effective voltages applied to the liquid crystal layers of the first and second subpixels change in the liquid crystal display device 100 of this preferred embodiment. As shown in portion (*a*) of FIG. 38, the first, third, and fifth periods are first polarity periods, while the second, fourth and sixth periods are second polarity periods in the liquid crystal display device 100 of this preferred embodiment. Looking at any series of four vertical scanning periods, it can be seen that two out of the four are first polarity periods and the rest is second polarity periods. For example, in the first through fourth periods, the first and third periods are first polarity periods and the second and fourth periods are second polarity periods. The first polarity periods include a period that satisfies $|VLspa|>|VLspb|$ (e.g., the first period in this example) and a period that satisfies $|VLspa|<|VLspb|$ (e.g., the third period in this example). On the other hand, in the second polarity periods, VLspa=VLspb (e.g., the second and fourth periods in this example).

Portions (*b*) and (*c*) of FIG. 38 show the effective voltages VLspa and VLspb that are applied to the respective liquid crystal layers of the first and second subpixels in the respective vertical scanning periods. The levels of these voltages are indicated by the bold lines. The effective voltages VLspa and VLspb applied to the respective liquid crystal layers of the first and second subpixels are the effective values of the differences between the voltages applied to the first and second subpixel electrodes and the voltage Vc applied to the counter electrode. In this example, the voltage Vc applied to the counter electrode is shown as being constant.

In the first period, the voltages applied to the first and second subpixel electrodes are higher than the voltage applied to the counter electrode, and the absolute value of the effective voltage applied to the liquid crystal layer of the first subpixel is greater than that of the effective voltage applied to that of the second subpixel ($|VLspa|>|VLspb|$). For that reason, as shown in portion (*a*) of FIG. 38, the first period is a first polarity period and the first subpixel is brighter than the second subpixel.

In the second period, the voltages applied to the first and second subpixel electrodes are lower than the voltage applied to the counter electrode, and the effective voltage applied to the liquid crystal layer of the first subpixel is equal to the one applied to that of the second subpixel (VLspa=VLspb). For that reason, as shown in portion (*a*) of FIG. 38, the second period is a second polarity period and the first subpixel is as bright as the second subpixel.

In the third period, the voltages applied to the first and second subpixel electrodes are higher than the voltage applied to the counter electrode, and the absolute value of the effective voltage applied to the liquid crystal layer of the second subpixel is greater than that of the effective voltage applied to that of the first subpixel ($|VLspa|<|VLspb|$). For that reason, as shown in portion (*a*) of FIG. 38, the third period is a first polarity period and the second subpixel is brighter than the first subpixel.

In the fourth period, the voltages applied to the first and second subpixel electrodes are lower than the voltage applied to the counter electrode, and the effective voltage applied to the liquid crystal layer of the first subpixel is equal to the one applied to that of the second subpixel (VLspa=VLspb). For that reason, as shown in portion (*a*) of FIG. 38, the fourth period is a second polarity period and the first subpixel is as bright as the second subpixel. From the fifth period on, the brightness levels and polarities of the first and second subpixels will vary in quite the same pattern as the first and second subpixels in the first through fourth periods.

Thus, the (brightness, polarity) combination of the first subpixel changes in the order of (B, +), (M(oderate), −), (D, +) and (M, −), while the (brightness, polarity) combination of the second subpixel changes in the order of (D, +), (M, −), (B, +) and (M, −) as shown in portion (*a*) of FIG. 38, where "M" means that the brightness (or luminance) of the first subpixel is equal to that of the second subpixel. In this manner, the liquid crystal display device of this preferred embodiment changes the luminances of the subpixels in three steps by way of a moderate luminance every vertical scanning period and also inverts the polarities every vertical scanning period.

In the liquid crystal display device of this preferred embodiment, since the brightness levels of the subpixels are inverted, the degree of non-smoothness of the image on the screen can be reduced. Also, as can be seen from portions (*b*) and (*c*) of FIG. 38, in the liquid crystal display device of this preferred embodiment, the average of the effective voltages VLspa and that of the effective voltages VLspb over multiple vertical scanning periods (e.g., the first through fourth periods) can be approximately equal to each other. Furthermore, the averages of the effective voltages VLspa and VLspb can be both controlled to zero by adjusting the counter voltage. As a result, the residual image and other reliability-related problems can be overcome.

Next, it will be described with reference to FIGS. 39A, 39B and 40 how the effective voltages applied to the respective liquid crystal layers of subpixels vary in the liquid crystal display device of this preferred embodiment. In the following description, a series of four frames (corresponding to four vertical scanning periods) will be identified herein by n, n+1, n+2 and n+3, respectively.

FIG. 39A illustrates the brightness levels and polarities of respective subpixels that have changed in frame n, while FIG. 39B illustrates the brightness levels and polarities of respective subpixels that have changed in frame n+1. The liquid crystal display device of this preferred embodiment has a pixel arrangement such as the one shown in FIGS. 39A and 39B, which is the same as the one that has been described for the liquid crystal display device of the first preferred embodiment with reference to FIG. 14. Thus, the repeated description is omitted in order to avoid complicating the description excessively. The liquid crystal display device of this preferred embodiment includes twelve storage capacitor trunks. In FIGS. 39A and 39B, the storage capacitor lines that are connected to the twelve storage capacitor trunks are identified herein by CS1, CS2, CS3, . . . and CS12, respectively.

As an example, it will be described how the brightness levels and polarities of subpixels that are included in pixels 1-*a*, 1-*b*, 2-*a* and 2-*b* change. In the frame n, the pixels 1-*a* and 2-*b* have the first polarity (+), while the pixels 1-*b* and 2-*a* have the second polarity (−) as shown in FIG. 39A. Also, each of the subpixels 1-*a*-A, 1-*b*-B, 2-*a*-A and 2-*b*-A is brighter than the other subpixel of the pixel. Next, in the frame n+1, the luminances of the respective subpixels change into a moderate one and the polarities of the respective subpixels are inverted compared to the ones during the frame n as shown in FIG. 39B. Subsequently, in the frame n+2, the polarities of the respective subpixels are inverted compared to the ones during the frame n+1 to be the same as the ones shown in FIG. 39A, while the brightness levels of the respective subpixels are inverted compared to the ones shown in FIG. 39A. Thereafter, in the frame n+3, the luminances of the respective subpixels change into a moderate one and the polarities of the respective subpixels are inverted to be the same as the ones shown in FIG. 39B.

Next, it will be described how the liquid crystal display device of this preferred embodiment satisfies the three conditions described above to minimize a flicker.

Just like the liquid crystal display device of the first preferred embodiment that has already been described with reference to FIG. 15, the liquid crystal display device of this preferred embodiment regulates the voltages on the respective signal lines and the voltage applied to the counter electrode appropriately, thereby equalizing the effective voltages applied to the liquid crystal layer in respective electric field directions as closely as possible and satisfying the first condition. In addition, in the liquid crystal display device of this preferred embodiment, pixels with mutually different polarities are arranged adjacent to each other as shown in FIGS. 39A and 39B, thereby satisfying the second condition as well. Furthermore, in the liquid crystal display device of this preferred embodiment, subpixels, each of which is brighter than the other subpixel of the same pixel, are arranged as randomly as possible, e.g., such that the "B" and "D" signs are arranged on a subpixel-by-subpixel basis in a checkered pattern as shown in FIG. 39A, thereby satisfying the third condition, too.

The following Table 2 summarizes how the display qualities of the liquid crystal display devices of the first, third and the present preferred embodiments were affected when the frame frequencies were changed. In Table 2, a good display quality is indicated by the open circle O, while a poor display quality is indicated by the cross X. As shown in Table 2, the liquid crystal display device of this preferred embodiment achieved good display qualities at frame frequencies of 90 Hz or more.

TABLE 2

| Frame frequency | 50 Hz | 60 Hz | 75 Hz | 90 Hz | 120 Hz |
|---|---|---|---|---|---|
| EMBODIMENT 1 (see FIG. 6) | | | | | |
| Improvement of viewing angle characteristic | ○ | ○ | ○ | ○ | X |
| Image non-smoothness | ○ | ○ | ○ | ○ | ○ |
| Flicker | X | ○ | ○ | ○ | ○ |
| Reliability | ○ | ○ | ○ | ○ | ○ |
| EMBODIMENT 3 (see FIG. 28) | | | | | |
| Improvement of viewing angle characteristic | ○ | ○ | ○ | ○ | ○ |
| Image non-smoothness | ○ | ○ | ○ | ○ | ○ |
| Flicker | X | X | X | X | ○ |
| Reliability | ○ | ○ | ○ | ○ | ○ |
| EMBODIMENT 7 (see FIG. 38) | | | | | |
| Improvement of viewing angle characteristic | ○ | ○ | ○ | ○ | ○ |
| Image non-smoothness | ○ | ○ | ○ | ○ | ○ |
| Flicker | X | X | X | ○ | ○ |
| Reliability | ○ | ○ | ○ | ○ | ○ |

Hereinafter, the changes in the voltages on the signal lines, the voltages on the first and second storage capacitor trunks, the voltages on the scan line, and the effective voltages applied to the respective liquid crystal layers of subpixels 1-*a*-A and 1-*a*-B that are enclosed with the dashed lines in FIGS. 39A and 39B in the liquid crystal display device of this preferred embodiment will be described with reference to FIG. 40. In FIG. 40, Vsa and Vsb represent the voltages on the signal lines Sa and Sb, Vcs1 and Vcs2 represent the voltages on the first and second storage capacitor trunks CS1 and CS2, Vg1 represents the voltages on the scan line G1, and VLsp1-*a*-A and VLsp1-*b*-B represent the effective voltages applied to the liquid crystal layer of the subpixels 1-*a*-A and 1-*a*-B, respectively.

FIG. 40 shows the waveforms of the respective voltages in the four frames of n through n+3. As described with reference to FIGS. 38, 39A and 39B, the subpixels 1-*a*-A and 1-*a*-B have their polarities inverted in the order of (+, −, +, −) while having their luminances changed in the patterns (B, M, D, M) and (D, M, B, M), respectively. In each frame, the write operation is started when the voltage Vg1 on the scan line G1 goes VgH (high level). One vertical scanning period V-Total of the input video signal has a duration of 801H. The voltage Vcs1 on the first storage capacitor trunk CS1 has such a waveform that completes one cycle of its level change in the order of the first, second, third and second levels VL1, VL2, VL3 and VL2 every 6H period. And the voltages Vcs1 and Vcs2 have phases that are different from each other by 180 degrees.

In FIG. 40, the interval between the point in time when the voltage Vg1 on the scan line G1 goes VgL (i.e., low level) and the point in time when the voltages Vcs1 and Vcs2 on the storage capacitor lines change for the first time is 3H. The display period of the voltage Vcs1 on the first storage capacitor trunk CS1 (i.e., the first waveform period) has a cycle of 24H and each period in which its amplitude continues to be constant at the first, second or third level has a length of 6H. That is why 3H is a half of the period in which the voltage Vcs on the storage capacitor line has constant amplitude (i.e., a quarter of one cycle of each display period).

In the frames n and n+2, while the scan line G1 is selected, the voltage Vsa on the signal line Sa is higher than the voltage at the counter electrode. On the other hand, in the frames n+1 and n+3, while the scan line G1 is selected, the voltage Vsa on the signal line Sa is lower than the voltage at the counter electrode.

Hereinafter, it will be described with reference to FIG. 40 how the brightness levels and polarities of these subpixels 1-*a*-A and 1-*a*-B of the pixel 1-*a* change from the frame n through the frame n+3.

In the frame n, when the voltage Vcs1 on the first storage capacitor trunk is maintained at the first level after having decreased from the second level, the scan line G1 is selected (i.e., the voltage Vg on the scan line goes VgH). When the scan line G1 is selected, voltages higher than the one at the counter electrode are applied to the subpixel electrodes of the subpixels 1-*a*-A and 1-*a*-B. After the voltage Vg1 on the scan line G1 has fallen to VgL again, the voltage Vcs1 on the first storage capacitor trunk will vary periodically. In the case that the voltage Vg1 on the scan line G1 goes down from VgH to VgL again, the voltage Vcs1 on the first storage capacitor trunk is VL1, while the voltage Vcs2 on the second storage capacitor trunk is VL3. Since the average voltage VL2 of the voltages Vcs1 and Vcs2 on the first and second storage capacitor trunks is higher than VL1 but lower than VL3, the absolute value of the effective voltage applied to the liquid crystal layer of the subpixel 1-*a*-A becomes greater than that of the effective voltage applied to that of the subpixel 1-*a*-B. As a result, the subpixel 1-*a*-A looks brighter than the subpixel 1-*a*-B.

Next, in the frame n+1, when the voltage Vcs1 on the first storage capacitor trunk is maintained at the second level after having decreased from the third level, the scan line G1 is selected (i.e., the voltage Vg on the scan line goes VgH). When the scan line G1 is selected, voltages lower than the one at the counter electrode are applied to the subpixel electrodes of the subpixels 1-*a*-A and 1-*a*-B. After the voltage Vg1 on the scan line G1 has fallen to VgL again, the voltage Vcs1 on the first storage capacitor trunk will vary periodically. In the case that the voltage Vg1 on the scan line G1 goes down to VgL again, the voltages Vcs1 and Vcs2 on the first and second storage capacitor trunks are equal to the average voltage VL2 of the voltages Vcs1 and Vcs2 on the first and second storage capacitor trunks. That is why the absolute value of the effective voltage applied to the liquid crystal layer of the subpixel 1-*a*-A becomes equal to that of the effective voltage applied to that of the subpixel 1-*a*-B. As a result, the subpixel 1-*a*-A looks as bright as the subpixel 1-*a*-B.

Next, in the frame n+2, when the voltage Vcs1 on the first storage capacitor trunk goes up from the second level to the third level, the scan line G1 is selected (i.e., the voltage Vg on the scan line goes VgH). When the scan line G1 is selected, voltages higher than the one at the counter electrode are applied to the subpixel electrodes of the subpixels 1-*a*-A and 1-*a*-B. When the voltage Vg1 on the scan line G1 goes down from VgH to VgL again, the voltage Vcs1 on the first storage capacitor trunk is VL3, while the voltage Vcs2 on the second storage capacitor trunk is VL1. That is why the absolute value of the effective voltage applied to the liquid crystal layer of the subpixel 1-*a*-A becomes smaller than that of the effective voltage applied to that of the subpixel 1-*a*-B. As a result, the subpixel 1-*a*-A looks darker than the subpixel 1-*a*-B.

Next, in the frame n+3, after the voltage Vcs1 on the first storage capacitor trunk goes up from the first level to the second level, the scan line G1 is selected (i.e., the voltage Vg on the scan line goes VgH). When the scan line G1 is selected, voltages lower than the one at the counter electrode are applied to the subpixel electrodes of the subpixels 1-*a*-A and 1-*a*-B. When the voltage Vg1 on the scan line G1 goes down from VgH to VgL again, the voltages Vcs1 and Vcs2 on the first and second storage capacitor trunks are equal to VL2. That is why the absolute value of the effective voltage applied to the liquid crystal layer of the subpixel 1-*a*-A becomes equal to that of the effective voltage applied to that of the subpixel 1-*a*-B. As a result, the subpixel 1-*a*-A looks as bright as the subpixel 1-*a*-B.

As can be seen from the description that has just been given with reference to FIG. 40, the (brightness, polarity) combination of the subpixel 1-*a*-A changes in the order of (B, +), (M, −), (D, +) and (M, −), while the (brightness, polarity) combination of the subpixel 1-*a*-B changes in the order of (D, +), (M, −), (B, +) and (M, −). Also, although not shown, the (brightness, polarity) combination of the subpixel 2-*a*-A changes in the order of (B, −), (M, +), (D, −) and (M, +). In this manner, the liquid crystal display device of this preferred embodiment not only changes the brightness levels of each subpixel in the order of bright, moderate, dark and moderate every vertical scanning period but also inverts the polarity every vertical scanning period, thereby reducing the degree of non-smoothness of the image on the screen. Also, in the liquid crystal display device of this preferred embodiment, each set of first and second polarity periods has a period in which the first subpixel is brighter than the second subpixel as in the liquid crystal display device of the first preferred embodiment. Thus, as can be seen from portions (*b*) and (*c*) of FIG. 38, the average of the effective voltages VLspa and that of the effective voltages VLspb over multiple vertical scanning periods (e.g., the first through fourth periods) can be equal to each other. Furthermore, the averages of the effective voltages VLspa and VLspb can be both controlled to zero by adjusting the counter voltage. As a result, the residual image and other reliability-related problems can be overcome.

In the liquid crystal display device of the first through seventh preferred embodiments of the present invention described above, each pixel is supposed to consist of two subpixels. However, the present invention is in no way limited to those specific preferred embodiments. Each pixel may also consist of three or more subpixels. The greater the number of subpixels per pixel, the more significantly the non-uniformity in γ characteristic can be reduced. For example, if the pixel division number is increased from two to four, the degree of the non-uniformity produced by a variation in display gray-scale can be reduced and the display qualities can be further improved. However, the greater the division number, the lower the (frontal) transmittance will be in the case of white display. Particularly if the division number is increased from two to four, the transmittance in the white display will decrease significantly. Such a significant decrease is caused partly because each subpixel has a much smaller display area in that case. Thus, the division number needs to be appropriately adjusted according to the intended application of the liquid crystal display device so as to strike an adequate balance between the degree of reduction in the viewing angle dependence of the γ characteristic and the magnitude of decrease in the transmittance in the white display. It should be noted that the reduction in the viewing angle dependence of the γ characteristic is most noticeable if a non-divided pixel is divided into two subpixels (i.e., when each pixel consists of two subpixels). Considering the inevitable decreases in transmittance in the white display and in mass-productivity when each pixel is divided into a greater number of subpixels, each pixel preferably consists of two subpixels, after all.

Optionally, a configuration for supplying the voltages Vcs to respective storage capacitor lines independently of each other may also be adopted as already described with reference to FIGS. 13 and 14. In that case, each voltage Vcs will have an increased number of waveform options in the display period and the regulation period, which is beneficial. Nevertheless, the voltage Vcs should change its levels at least once after the voltage on the scan line has gone low during one vertical scanning period. For example, in a liquid crystal display device that includes twice as many storage capacitor lines as scan lines and that has a configuration for supplying voltages Vcs to those storage capacitor lines independently of each other, if the voltage Vcs needs to change its levels only once after the voltage on each scan line has gone low, then the interval between the point in time when the voltage on the scan line goes low and the point in time when the voltage Vcs changes its levels or the interval between the point in time when the voltage Vcs changes its levels and the point in time when the voltage on the scan line goes high next time is preferably defined equally for every display line.

Meanwhile, if a configuration in which a number of storage capacitor lines are provided for each storage capacitor trunk is adopted, then the voltages Vcs on those multiple storage capacitor lines connected to a single storage capacitor trunk can have their oscillation amplitudes exactly matched with each other, which is advantageous. Naturally, the circuit configuration can also be simpler than a situation where a lot of voltages should be supplied independently of each other.

Furthermore, the liquid crystal display device according to any of the first through seventh preferred embodiments of the present invention described above is supposed to adopt the multi-picture element driving method disclosed in Patent Document No. 1, i.e., make the luminances of two subpixels that form one pixel different from each other by applying a rectangular wave voltage to a CS bus line. However, the present invention is in no way limited to those specific preferred embodiments.

The present invention has the following two important points, and embodiments embodied these points are in no way limited to the above described embodiments.

The first point of the present invention is to switch the luminance levels of multiple subpixels that form a single pixel one after another, thereby averaging the luminance levels of those subpixels over a predetermined period of time and optimizing the variation in the luminance level of each subpixel with time such that the difference in luminance level between the subpixels becomes substantially equal to zero.

The second point of the present invention is to invert the polarities of respective subpixels such that the averages of the voltages applied to those subpixels over a certain period of time becomes substantially equal to each other among them, thereby optimizing the variation in the effective voltage applied to the liquid crystal layer (or the variation in luminance). It should be noted that to ensure reliability, the difference in average effective voltage between the subpixels is preferably 1 V or less.

Examples of liquid crystal display devices that embody these two important points include a device in which subpixels that form each pixel have the same number of sets of four frames with the pixel polarity-subpixel brightness combinations (B, +), (B, −), (D, +) and (D, −) (where B and D stand for "bright" and "dark", respectively) within a certain period and another device in which subpixels that form each pixel have the same number of sets of four frames with the pixel polarity-subpixel brightness combinations (B, +), (D, +), (M, −) and (M, −) or (B, −), (D, −), (M, −) and (M, −) (where M stands for "moderate") within a certain period.

To embody these points, the polarities and luminances of subpixels may be controlled on a frame-by-frame basis unlike the liquid crystal display device according to any of the first through seventh preferred embodiments of the present invention described above. For example, in an alternative liquid crystal display device, a TFT provided for each subpixel may drive it with data signals and scan signals applied independently to respective subpixels.

Alternatively, the liquid crystal display device according to the present invention may also be designed such that a TFT provided for each subpixel controls the luminance with a data signal that has been applied independently on a subpixel-by-subpixel basis but that those TFTs are driven through a common scan line as shown in FIG. 25. In that case, the luminances and polarities of respective subpixels can be controlled with independent data signals applied to those subpixels.

Still alternatively, the liquid crystal display device according to the present invention may also be designed such that a TFT provided for each subpixel controls its luminance with a data signal applied in common for respective subpixels but that the TFTs are driven through respectively different scan lines. In that case, by further subdividing one frame period, defining luminances and polarities for respective subpixels with the same data signal applied thereto, and setting the scan periods or timings for the respective subpixels (i.e., by performing time sharing within one frame), the luminances and polarities of the respective subpixels can be controlled.

It should be noted that the disclosure of Japanese Patent Application No. 2006-228476, upon which the present application claims the benefit of priority, and the disclosure of its related Japanese Patent Application No. 2006-228475 are hereby incorporated by reference.

Industrial Applicability

The present invention provides a big-screen or high-definition liquid crystal display device that realizes very high display qualities with the viewing angle dependence of the γ characteristic reduced significantly. The liquid crystal display device of the present invention can be used effectively as a TV monitor of a big screen size of 30 inches or more.

The invention claimed is:

1. A liquid crystal display device comprising a plurality of pixels, each including a first subpixel and a second subpixel, wherein each of the first and second subpixels includes:

a counter electrode;

a subpixel electrode; and a liquid crystal layer interposed between the counter electrode and the subpixel electrode, and wherein the subpixel electrodes of the first and second subpixels are provided separately from each other as first and second subpixel electrodes, respectively, while the first and second subpixels share the same counter electrode with each other, and wherein when a predetermined grayscale tone is displayed through four or more consecutive even number of vertical scanning periods, the first and second subpixels have mutually different luminances in at least two of the even number of vertical scanning periods, first polarity periods that are included in the even number of vertical scanning periods and that maintain a first polarity are as long as second polarity periods that are also included in the even number of vertical scanning periods and that maintain a second polarity for each of the first and second subpixels, and in each of the first and second polarity periods, the difference between the average of effective voltages applied to the liquid crystal layer of the first subpixel and that of effective voltages applied to the liquid crystal layer of the second subpixel is substantially equal to zero, and wherein the polarities of the first and second subpixels are inverted every other vertical scanning period, wherein in either the first polarity periods or the second polarity periods, one of the two vertical scanning periods satisfies |VLspa|>|VLspb| and the other vertical scanning period satisfies |VLspa|<[VLspb|, and wherein in the other polarity periods, VLspa is equal to VLspb in each of the two vertical scanning periods, wherein the effective voltages applied to the respective liquid crystal layers of the first and second subpixels of each said pixel are represented by VLspa and VLspb, respectively.

2. The liquid crystal display device of claim 1, wherein two of the four consecutive vertical scanning periods are the first polarity periods and the other two vertical scanning periods are the second polarity periods, and wherein in at least one the first polarity periods and the second polarity periods, one of the two vertical scanning periods thereof satisfies |VLspa [>|VLspb| and the other vertical scanning period satisfies |VLspa|<|VLspb|.

3. The liquid crystal display device of claim 1, wherein two of the four consecutive vertical scanning periods are the first polarity periods and the other two vertical scanning periods are the second polarity periods, and wherein in at least one of the first polarity periods and the second polarity periods, the |VLspa| and |VLspb[ values of one of the two vertical scanning periods thereof are equal to those of the other vertical scanning period.

4. The liquid crystal display device of claim 1 wherein the plurality of the pixels are arranged in column and row directions so as to form a matrix pattern, and wherein in each of the plurality of the pixels the first and second subpixels are arranged in the column direction.

5. The liquid crystal display device of claim 1, wherein in each of the plurality of the pixels, voltages applied to the first and second subpixel electrodes change as voltages on their associated storage capacitor lines vary.

6. The liquid crystal display device of claim 1, wherein in each of the plurality of the pixels, the first and second subpixel electrodes are connected to the same signal line by way of their associated switching element.

7. The liquid crystal display device of claim 1, wherein in each of the plurality of the pixels, the first and second subpixel electrodes are respectively connected to first and second signal lines by way of first and second switching elements, respectively.

8. The liquid crystal display device of claim 1, wherein the frame frequency is 60 Hz.

9. The liquid crystal display device of claim 1, wherein in each of the plurality of the pixels, |VLspa| and |VLspb| switch their magnitudes every other vertical scanning period, and wherein |VLspa| and |VLspb| switch their magnitudes non-synchronously with the inversion of the polarities of the first and second subpixels.

10. The liquid crystal display device of claim 1, wherein voltages on storage capacitor lines associated with the first and second subpixel electrodes change between a first level, a second level that is higher than the first level, and a third level that is higher than the second level.

11. The liquid crystal display device of claim 1, wherein the first and second subpixel electrodes have the same display area.

12. The liquid crystal display device of claim 2, wherein of the four vertical scanning periods, the number of vertical scanning periods that satisfy |VLspa|>|VLspb| is equal to that of vertical scanning periods that satisfy |VLspa|<|VLspb|.

13. The liquid crystal display device of claim 3, wherein of the four vertical scanning periods, the number of vertical scanning periods that satisfy |VLspa|>|VLspb| is equal to that of vertical scanning periods that satisfy |VLspa|<|VLspb|.

14. The liquid crystal display device of claim 4, wherein a voltage applied to the second subpixel electrode of a particular one of the plurality of the pixels and a voltage applied to the first subpixel electrode of another pixel that is adjacent to the particular pixel in the column direction change as the voltage on their common storage capacitor line varies.

15. The liquid crystal display device of claim 4, wherein a voltage applied to the second subpixel electrode of a particular one of the plurality of the pixels and a voltage applied to the first subpixel electrode of another pixel that is adjacent to the particular pixel in the column direction change as voltages on their associated storage capacitor lines vary.

16. The liquid crystal display device of claim 5, wherein in each of the plurality of the pixels, a voltage on a storage capacitor line associated with the first subpixel electrode and a voltage on a storage capacitor line associated with the second subpixel electrode change mutually differently.

* * * * *